US009539459B2

(12) United States Patent
Nakamura

(10) Patent No.: US 9,539,459 B2
(45) Date of Patent: Jan. 10, 2017

(54) UPPER LIMB TRAINING APPARATUS

(75) Inventor: Yoichi Nakamura, Kyoto (JP)

(73) Assignee: MURATA MACHINERY, LTD., Kyoto (JP)

( * ) Notice: Subject to any disclaimer, the term of this patent is extended or adjusted under 35 U.S.C. 154(b) by 807 days.

(21) Appl. No.: 14/001,856

(22) PCT Filed: Feb. 28, 2011

(86) PCT No.: PCT/JP2011/054437

§ 371 (c)(1),
(2), (4) Date: Aug. 27, 2013

(87) PCT Pub. No.: WO2012/117482

PCT Pub. Date: Sep. 7, 2012

(65) Prior Publication Data

US 2013/0331743 A1 Dec. 12, 2013

(51) Int. Cl.
*A63B 23/00* (2006.01)
*A63B 21/02* (2006.01)
(Continued)

(52) U.S. Cl.
CPC ..... *A63B 21/025* (2013.01); *A61H 1/0274* (2013.01); *A63B 21/0058* (2013.01);
(Continued)

(58) Field of Classification Search
CPC .. A61H 1/0274; A61H 1/0285; A61H 1/0281; A61H 2201/1635; A63B 23/12; A63B 21/025; A63B 21/0442; G05G 9/047–9/04796; G05G 2009/04703; G05G 2009/04707; G05G 2009/04711; G05G 2009/04725; G05G 2009/04777; F16F 7/00; F16F 15/04; F16F 15/067
(Continued)

(56) References Cited

U.S. PATENT DOCUMENTS 4,936,299 A * 6/1990 Erlandson ..... A63B 69/0053 482/9
5,107,080 A * 4/1992 Rosen ..... B64C 13/04 200/6 A
(Continued)

FOREIGN PATENT DOCUMENTS

JP 4213270 Y1 7/1967
JP 2003-004551 8/2003
(Continued)

OTHER PUBLICATIONS

International preliminary report on patentability dated Sep. 6, 2013 issued in corresponding PCT application PCT/JP2011/054437 cites the foreign patent document listed above.
(Continued)

*Primary Examiner* — Justine Yu
*Assistant Examiner* — Christopher Miller
(74) *Attorney, Agent, or Firm* — DLA Piper LLP (US)

(57) ABSTRACT

In an upper limb training apparatus, a movable frame is supported by a fixed frame placed on a floor surface such that the movable frame can tilt in all directions. An operation rod including an operation rod main body and an attachment fixed portion is attached to the movable frame and can extend and contract. The attachment fixed portion, to which an attachment is fixed, is attached to the tip of the operation rod main body and includes an elastic member that absorbs forces in any directions other than the axial direction relative to the operation rod main body. The axial displacement detecting section can thereby grasp just the axial force applied to the operation rod by detecting the displacement of attachment fixed portion in the axial direction.

9 Claims, 35 Drawing Sheets

(51) Int. Cl.

| | |
|---|---|
| ***A61H 1/02*** | (2006.01) |
| ***A63B 23/035*** | (2006.01) |
| ***A63B 21/00*** | (2006.01) |
| ***A63B 21/005*** | (2006.01) |
| ***A63B 23/12*** | (2006.01) |
| *A63B 22/00* | (2006.01) |
| *A63B 71/06* | (2006.01) |

(52) U.S. Cl.
CPC .... *A63B 21/00178* (2013.01); *A63B 21/4035* (2015.10); *A63B 21/4047* (2015.10); *A63B 23/03508* (2013.01); *A63B 23/1209* (2013.01); *A61H 2201/1215* (2013.01); *A61H 2201/1463* (2013.01); *A61H 2201/1635* (2013.01); *A61H 2201/1676* (2013.01); *A61H 2201/1685* (2013.01); *A61H 2201/5061* (2013.01); *A61H 2201/5064* (2013.01); *A61H 2201/5092* (2013.01); *A61H 2201/5097* (2013.01); *A61H 2203/0431* (2013.01); *A63B 2022/0094* (2013.01); *A63B 2071/0658* (2013.01); *A63B 2071/0683* (2013.01); *A63B 2208/0233* (2013.01); *A63B 2220/20* (2013.01); *A63B 2220/51* (2013.01); *A63B 2220/805* (2013.01); *A63B 2225/20* (2013.01)

(58) Field of Classification Search
USPC ..... 74/523, 471 R, 471 XY; 267/136
See application file for complete search history.

(56) References Cited

U.S. PATENT DOCUMENTS

| | | | | |
|---|---|---|---|---|
| 5,454,774 | A * | 10/1995 | Davis | A63B 22/18 434/258 |
| 6,285,356 | B1 * | 9/2001 | Armstrong | G05G 9/047 345/167 |
| 6,362,810 | B1 * | 3/2002 | Matsuda | G05G 9/04796 345/161 |
| 6,400,352 | B1 * | 6/2002 | Bruneau | G05G 9/047 345/156 |
| 6,477,448 | B1 * | 11/2002 | Maruyama | B25J 13/02 318/568.11 |
| 6,613,000 | B1 * | 9/2003 | Reinkensmeyer | A61B 5/221 600/587 |
| 2006/0277074 | A1 * | 12/2006 | Einav | G06Q 50/24 705/3 |
| 2006/0293617 | A1 | 12/2006 | Einav et al. | 601/33 |
| 2007/0185418 | A1 * | 8/2007 | Mitsuishi | A61F 5/04 601/34 |
| 2007/0265146 | A1 | 11/2007 | Kowalczewski et al. | |
| 2007/0282228 | A1 * | 12/2007 | Einav | A61B 5/7475 601/33 |
| 2007/0299371 | A1 * | 12/2007 | Einav | A61B 5/7475 601/5 |
| 2008/0004550 | A1 | 1/2008 | Einav et al. | |
| 2008/0070752 | A1 * | 3/2008 | Einav | A61B 5/103 482/7 |
| 2008/0242521 | A1 | 10/2008 | Einav | |
| 2008/0278448 | A1 * | 11/2008 | Nilsagard | G05G 9/053 345/161 |
| 2009/0062698 | A1 | 3/2009 | Einav et al. | |
| 2009/0149855 | A1 * | 6/2009 | Iwaki | A61H 1/0237 606/57 |
| 2009/0306553 | A1 * | 12/2009 | Mulholland | A61H 1/0274 601/5 |
| 2011/0137464 | A1 | 6/2011 | Sabater Navarro et al. | |
| 2011/0264018 | A1 * | 10/2011 | Matjacic | A61H 1/0274 601/40 |
| 2014/0296750 | A1 | 10/2014 | Einav et al. | |

FOREIGN PATENT DOCUMENTS

| | | |
|---|---|---|
| JP | 5493110 B | 5/2014 |
| WO | WO 2005/074373 A2 | 8/2005 |

OTHER PUBLICATIONS

European Extended Search Report for corresponding application No. EP11859916.6 dated Mar. 16, 2015, cites the documents listed above.

* cited by examiner

UPPER LIMB TRAINING APPARATUS

CROSS REFERENCE TO RELATED APPLICATIONS

This application is a national stage of international application PCT/JP2011/054437, filed on Feb. 28, 2011, which is incorporated herein by reference.

TECHNICAL FIELD

The present invention relates to a training apparatus, particularly to an upper limb training apparatus for training upper limbs of the human.

BACKGROUND ART

An upper limb training apparatus has been conventionally known that provides rehabilitation to a patient whose motor function of the upper limb (particularly, arm) is damaged due to disabilities such as a cerebrovascular accident and a spinal damage (refer to Patent Document 1). The conventional upper limb training apparatus includes a frame, an operation rod, and an extension and contraction driving section. The frame includes a fixed frame that can be placed on the floor surface, and a movable frame that can tilt relative to the fixed frame. The movable frame is supported by the fixed frame such that the movable frame can tilt in all directions from the tilting center. The operation rod is connected to the movable frame such that the operation rod can tilt. The operation rod can extend and contract vertically. The movable frame can tilt with an electric driving. The operation rod is extended and contracted by the extension and contraction driving section disposed in the middle portion. The operation rod has an upper end portion to which an attachment corresponding to the types of the training is removably attached.

In the conventional upper limb training apparatus, a patient grabs the attachment attached to a top portion of the operation rod by the mobility-impaired arm or fixes the upper limb to the attachment, and moves or tries to move the operation rod, or the arm is moved by the operation rod for rehabilitation.

The doctor and the occupational therapist comprehensively determine the purpose of the training to be provided, height of the patient, height of the shoulders of the patient, movable range of the mobility-impaired upper limb and/or types of the attachments, and appropriately set the length and movable length of the operation rod. Although the rod length of the operation rod is set according to the patients, some of the patients perform a function recovery training by operating the operation rod in the extension and contraction direction.

Patent Citation 1: Laid-Open Japanese Patent Publication 2007-50249

Patent Citation 2: US Patent Publication 2006/0293617

Technical Problem

In a conventional upper limb training apparatus, an attachment fixed portion, to which an attachment is fixed, is attached to a top portion of the operation rod main body such that the attachment fixed portion can move in the axial direction. The attachment fixed portion can return to an initial state by a plate-like convolution spring. In addition, a travel amount in the axial direction when the attachment fixed portion is moved is measured by a linear measurement potentiometer. According to this conventional upper limb training apparatus, since the attachment fixed portion is supported only by one plate-like convolution spring, if the patient performs the training grabbing the attachment by hand, components of the forces applied to the attachment other than the axial force, e.g., components perpendicular to the axial force, function as a friction force between the attachment fixed portion and the operation rod main body, it is likely that just the axial force applied to the attachment is not precisely grasped by just measuring the axial displacement of the attachment.

It is an object of the present invention to, in an upper limb training apparatus, grasp just the axial force applied to the attachment by just measuring the axial displacement of the operation rod.

Technical Solution

Hereinafter, a plurality of aspects as means for solving problems will be explained. The aspects can be combined with each other as necessary.

According to one aspect of the present invention, an upper limb training apparatus for training upper limbs of a trainee comprises a fixed frame, a movable frame, an operation rod, and an axial force detecting section. The fixed frame is configured to be placed on a floor surface. The movable frame is supported by the fixed frame such that the movable frame can tilt in all directions. The operation rod is attached to the movable frame such that the operation rod can extend and contract. The operation rod is to be operated by the trainee by hand. The operation rod includes an operation rod main body, and an attachment fixed portion attached to a top end of the operation rod main body and to which an attachment is fixed. The attachment fixed portion includes an absorbing member configured to absorb forces in any directions other than the axial direction applied to the attachment fixed portion. The axial force detecting section is configured to detect an axial force applied to the attachment fixed portion.

In this upper limb training apparatus, when a trainee operates the operation rod by grabbing the attachment by hand, the force applied to the attachment is applied to the operation rod main body via the attachment fixed portion. At this time, forces in directions other than the axial direction indirectly applied to the operation rod main body via the attachment fixed portion are absorbed by the absorbing member of the attachment fixed portion. In this state, the axial force detecting section detects the axial force applied to the attachment fixed portion. As described above, in the upper limb training apparatus, since the absorbing member of the attachment fixed portion absorbs the forces in directions other than the axial direction applied to the operation rod main body in order to detect just the axial force to the attachment fixed portion, it is possible to precisely grasp just the axial force applied to operation rod.

Preferably, the axial force detecting section further includes an attachment member attached to the operation rod main body, an axial movement allowance member attached to the attachment member such that the axial movement allowance member can move in the axial direction, and an axial displacement detecting section. The axial displacement detecting section is configured to detect a position of the axial movement allowance member relative to the attachment member in the axial direction. As described above, since the axial displacement detecting section detects the position of the axial movement allowance member relative to the attachment member in the axial direction, it is possible to accurately grasp the force applied to the operation rod only in the axial direction.

Preferably, the attachment member includes a main body attached portion to be attached to the operation rod main body, and a shaft portion provided on the main body attached portion. The axial movement allowance member includes a cylindrical portion slidably attached to the shaft portion, and an exterior portion covering the cylindrical portion and fixed to the main body attached portion. The absorbing member includes a plurality of elastic members. The elastic members are arranged between the cylindrical portion and the exterior portion and define a predetermined gap between each other in an axial direction.

In this apparatus, since the elastic members (absorbing members) are disposed with a predetermined gap therebetween in the axial direction between the cylindrical portion of the axial movement allowance member and the exterior portion of the axial movement allowance member, it is possible to certainly absorb the force directly applied to the operation rod in directions other than the axial direction, and absorb the force in directions other than the axial direction when a moment is generated, for example.

Preferably, the elastic member may be a convolution spring. In this case, by attaching a central portion of the convolution spring to the cylindrical portion of the axial movement allowance member, and attaching a peripheral portion of the convolution spring to the exterior portion of the axial movement allowance member, the direction dependence of the convolution spring becomes smaller.

Preferably, the elastic member includes a flat plate-like convolution spring. In this case, since flat plate-like convolution springs can be formed by cutting out metallic thin plates, for example, it is easy to produce the peripheral portion and the central portion of the plate-like convolution springs, and it is possible to produce them precisely. Accordingly, the direction dependence of the convolution springs themselves can be reduced.

Preferably, the elastic members include two flat plate-like convolution springs. The two flat plate-like convolution springs are arranged between the cylindrical portion and the exterior portion, defining a predetermined gap between each other, and being reversed relative to each other.

In this apparatus, since the two sides of the two flat plate-like convolution springs are reversed relative to each other and the two flat plate-like convolution springs are disposed with the predetermined gap therebetween in the axial direction, it is possible to simultaneously reduce the direction dependences in the axial direction and in a direction perpendicular to the axial direction, too.

Preferably, the axial displacement detecting section is arranged inside the operation rod. In this case, since the axial displacement detecting section is arranged inside the operation rod, it is possible to arrange that unnecessary external force, e.g. an impulse, is not directly applied to the axial displacement detecting section. Accordingly, it is possible to more accurately measure just the displacement of the measuring object by the axial displacement detecting section.

Preferably, the axial displacement detecting section includes a linear potentiometer. In this case, by urging a sensor head of the linear potentiometer, for example, so as to be always in contact with the axial movement allowance member, it is possible to more accurately detect the position of the axial movement allowance member relative to the attachment member in the axial direction.

Preferably, a slide bearing is arranged between the shaft portion of the attachment member and the cylindrical portion of the axial movement allowance member. The slide bearing is configured to allow the cylindrical portion to slide relative to the shaft portion. In this case, since the slide bearing is disposed between the shaft portion of the attachment member and the cylindrical portion of the axial movement allowance member, the axial movement allowance member can smoothly move relative to the attachment member in the axial direction. Accordingly, it is possible to more accurately measure the displacement of the axial movement allowance member relative to the attachment member.

Preferably, the slide bearing is a bush made of resin. In this case, since the material of the slide bearing is resin, even if the shape of the slide bearing is a bush, it is possible to easily mold the slide bearing of a predetermined size.

Advantageous Effects

According to an upper limb training apparatus of the present invention, it is possible to precisely grasp just the axial force applied to the operation rod.

DESCRIPTION OF EMBODIMENTS (1) Overall Structure

Figure 1:
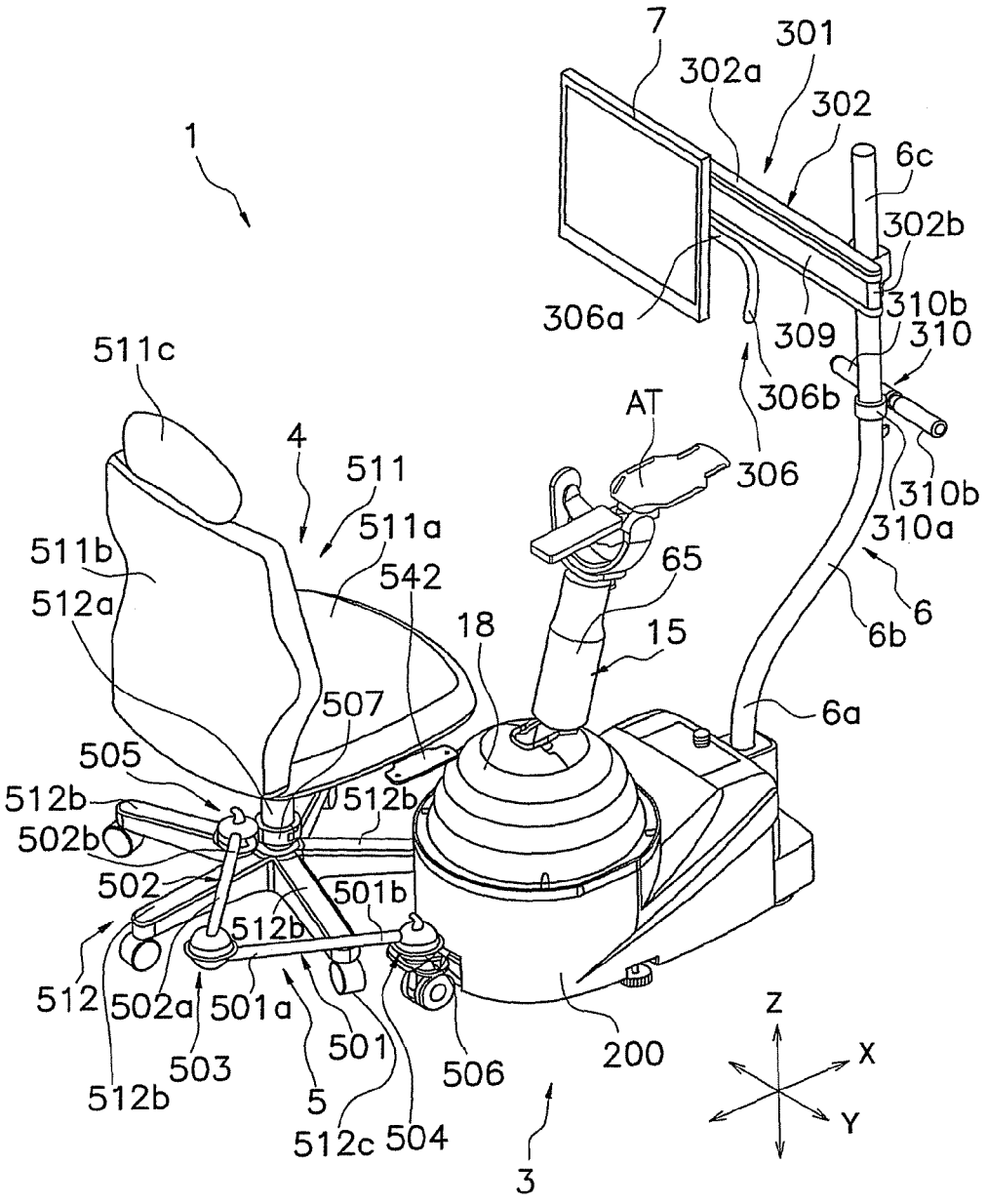
FIG. 1 is a perspective view of an upper limb training apparatus according to one embodiment of the present invention.
Figure 2:
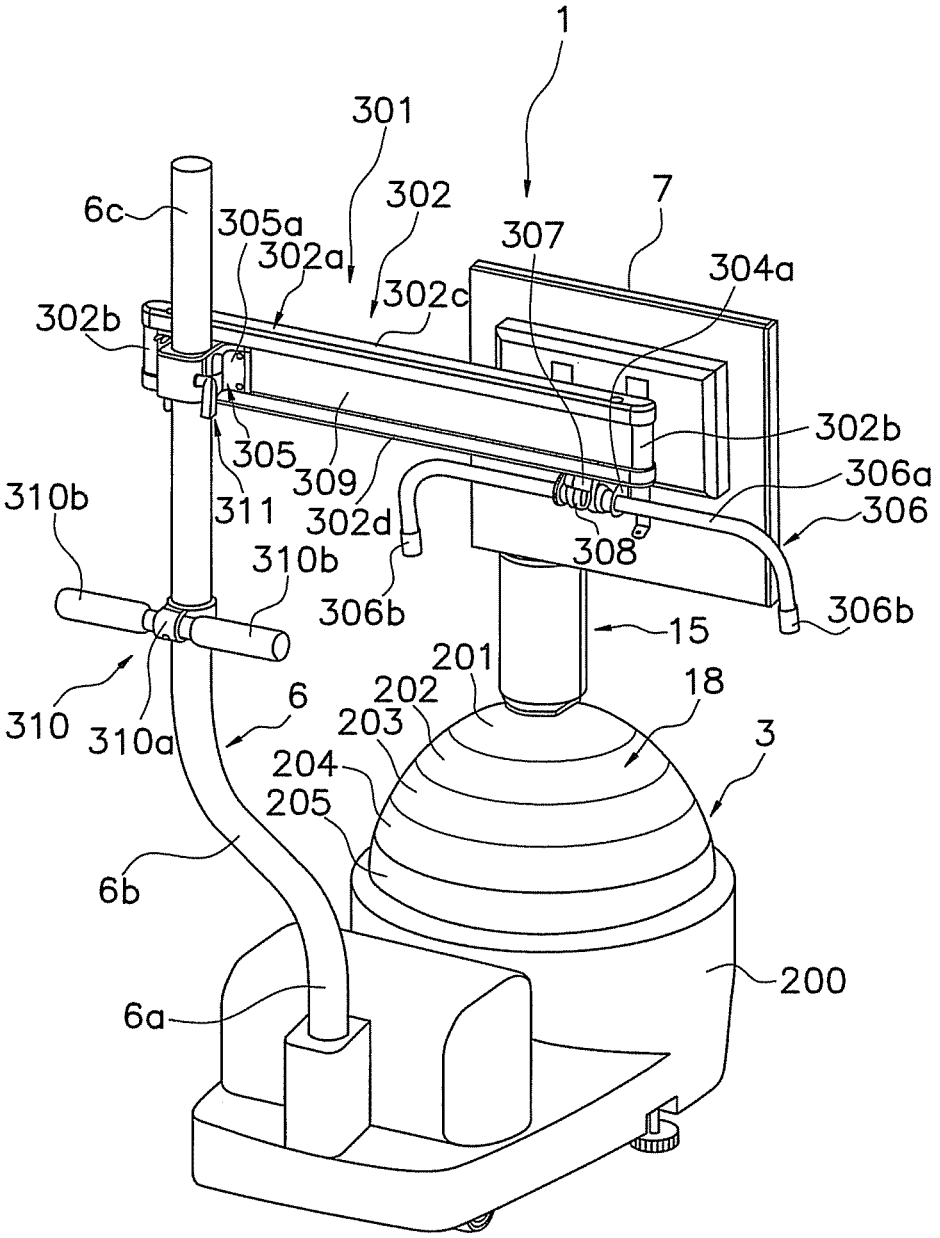
FIG. 2 is a perspective view of the upper limb training apparatus.

As shown in FIG. 1 and FIG. 2, an upper limb training apparatus 1 according to one embodiment of the present invention has a function of assisting the recovery of upper limb motor function for rehabilitation of the upper limb (particularly, arm) of a patient T whose motor function has been damaged due to disabilities such as the cerebrovascular accident and the spinal damage.

The upper limb training apparatus 1 includes a training apparatus main body 3, a chair 4, a connecting mechanism 5 for connecting the training apparatus main body 3 and the chair 4, and a monitor stand 6 fixed to the training apparatus main body 3 and to which a monitor 7 is fixed. It should be noted that, in the following explanation, the front-and-back direction is X direction shown in FIG. 1, and the right and left direction is Y direction shown in FIG. 1, and the vertical direction is Z direction shown in FIG. 1. In this specification, it should be noted that the front and back direction, and the right and left direction may be defined from a point of view of the patient T sitting on the chair 4, in which the front direction may be expressed as a back side of the apparatus, and the back direction may be expressed as a front side of the apparatus. However, as later described, since an operation rod 15 tilts, in this example, when the operation rod 15 is standing vertically relative to the floor surface, the direction of the operation rod 15 is defined as Z direction, and X direction and Y direction are defined within a plane perpendicular to Z direction.

(2) Training Apparatus Main Body

Figure 3:
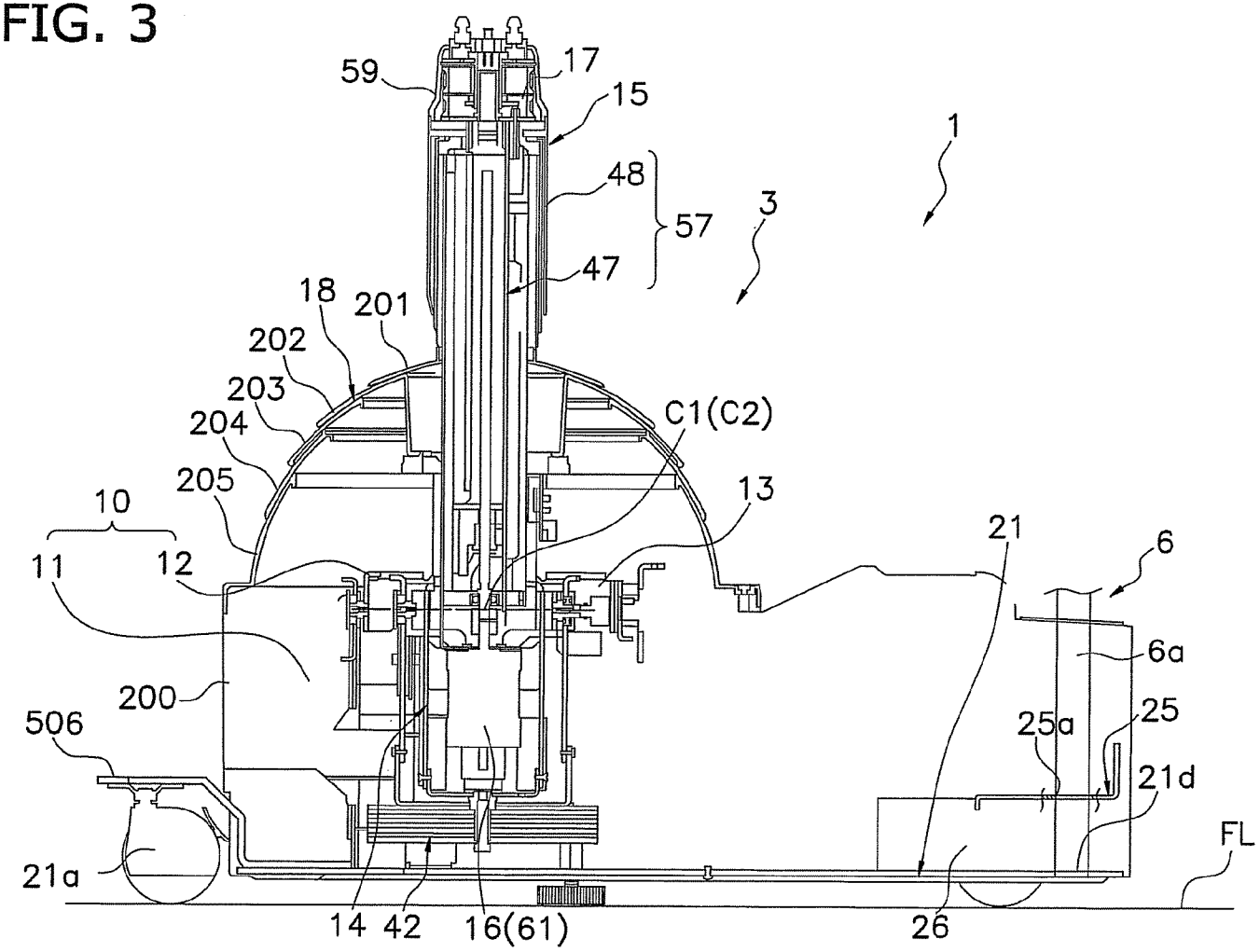
FIG. 3 is a schematic cross section of the training apparatus main body.
Figure 4:
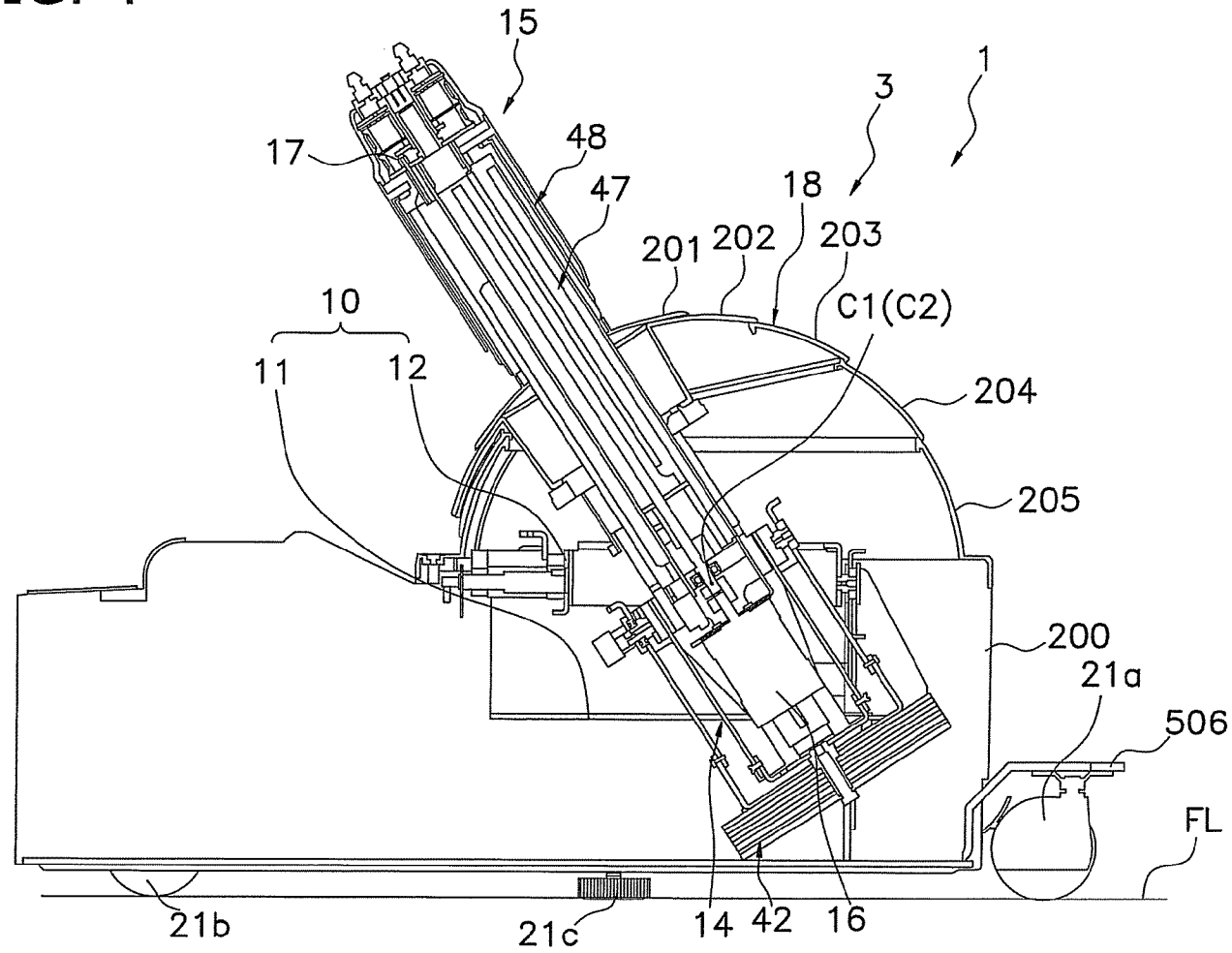
FIG. 4 is a schematic cross section of the training apparatus main body.

The training apparatus main body 3 includes, as shown in FIG. 3 and FIG. 4, a frame 10 having a fixed frame 11 and a movable frame 12, a tilting resistance applying mechanism 13, a tilting operation force detecting mechanism 14, the operation rod 15, an extension and contraction resistance applying mechanism 16, an extension and contraction operation force detecting mechanism 17, and an exterior cover 18. The fixed frame 11 can be placed on a floor surface FL. The movable frame 12 is supported by the fixed frame 11 such that the movable frame 12 can tilt in all directions including the front-and-back X direction and the right-and-left Y direction around the first tilting center C1.

The tilting resistance applying mechanism 13 is a mechanism that provides, as shown in FIG. 3 to FIG. 8, an appropriate resistance corresponding to the patient T when the patient T operates the operation rod 15 for tilting, or pivots the operation rod 15 from the first tilting center C1 toward front and back, and right and left in order to assist the patient T to operate the operation rod 15 for tilting or to guide the front and back, right and left actions of the upper limb of the patient T. The tilting operation force detecting mechanism 14 is a mechanism that detects an operation force applied to the operation rod 15 by the tilting operation of the patient T and detects the tilting operation vector indicating the direction of the operation force. The operation rod 15 is a rod which is operated by the patient T for the function recovery training for the upper limb. The operation rod 15 is mounted to the movable frame 12, and can extend and contract in the vertical Z direction. The tilting operation force detecting mechanism 14 is a mechanism that detects displacement amount of the operation rod 15 by the patient T relative to the movable frame 12. The extension and contraction resistance applying mechanism 16 is a mechanism that applies appropriate resistance corresponding to the patient T when the patient T operates the operation rod 15 for the extension and contraction operation, or assists the extension and contraction operation of the operation rod 15 by the patient T or guides the up and down movement of the upper limb of the patient T. The extension and contraction resistance applying mechanism 16 also functions as an extension and contraction driving section that drives the operation rod 15 for extension and contraction when the vertical position of the operation rod 15 is adjusted by the patient T. The extension and contraction operation force detecting mechanism 17 is a mechanism that detects an operation force in the vertical direction applied to the operation rod 15 by the up and down movement of the upper limb of the patient T. The exterior cover 18 is a cover that covers the circumference of the fixed frame 11 and the movable frame 12.

(2-1) Fixed Frame

Figure 5:
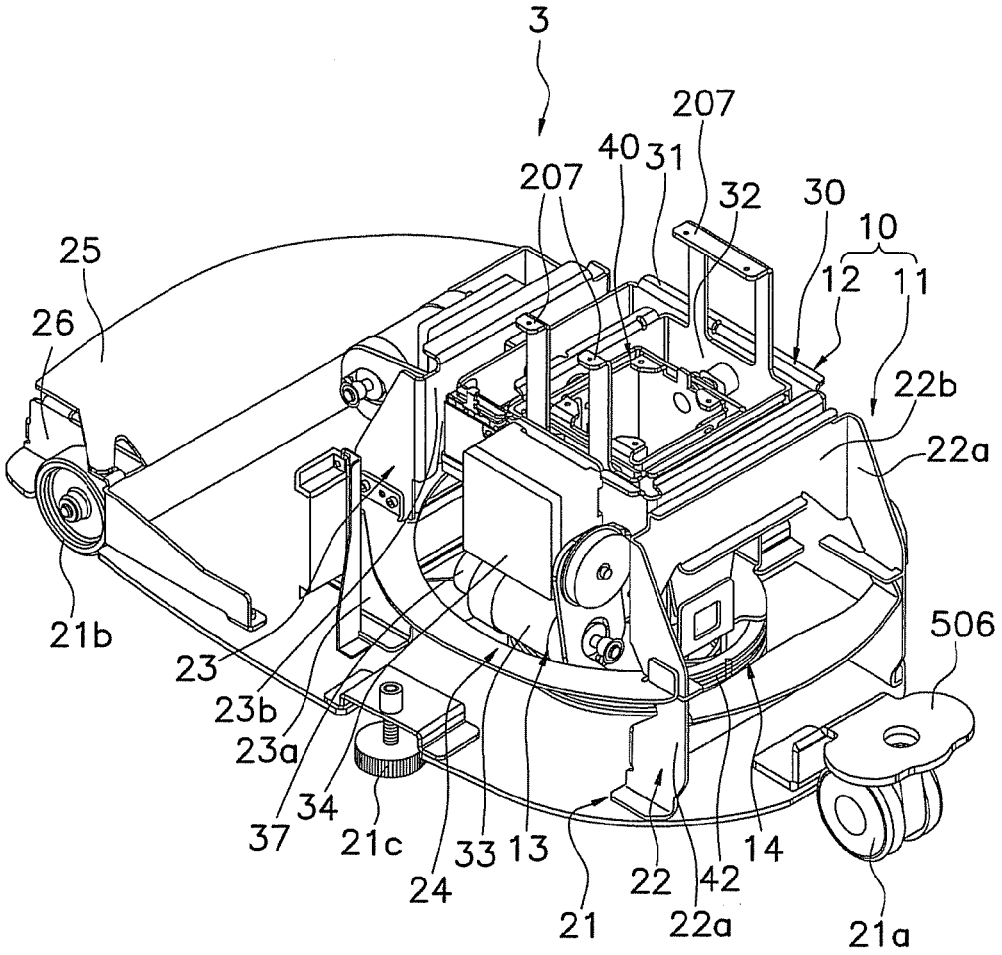
FIG. 5 is a perspective view of the interior of the training apparatus main body.

The fixed frame 11 includes, as shown in FIG. 3 and FIG. 5, a base frame 21 that can be moved on the floor surface FL or fixed onto the floor surface F, a first supporting bracket 22 and a second supporting bracket 23 each uprisingly fixed to the top surface of the base frame 21. The base frame 21 is a plate-like frame having a back portion (right lower end portion in FIG. 5) in a substantially semi-circle shape. The bottom surface of the back portion of the base frame 21 is provided with a free wheel 21*a* having a caster, and the bottom surface of the front portion is provided with a pair of fixed wheels 21*b* with a gap therebetween in the right and left direction. Provided on both sides of the central portion in the front-and-back direction of the base frame 21 is a pair of adjusters 21*c* for fixing the training apparatus main body 3 to the floor surface FL such that the training apparatus main body 3 cannot move. At the center of the front portion of the base frame 21, a stand fixing portion 21*d* is provided to which a lower end of the monitor stand 6 is fixed. Above the front portion of the base frame 21, a stand supporting plate 25 is provided and extends in parallel with the stand fixing portion 21*d* in the right and left direction. The stand supporting plate 25 has right and left ends fixed by a pair of fixed brackets 26 uprightly fixed to the base frame 21.

As shown in FIG. 3, the stand supporting plate 25 includes a stand supporting hole 25*a* in the central portion that unrotatably supports the base portion 6*a* of the monitor stand 6. A tip end of the base portion 6*a* of the monitor stand 6 is unrotatably supported by a hole (not shown) formed in the stand fixing portion 21*d* of the base frame 21. As described above, since the base portion 6*a* of the monitor stand 6 is supported by the base frame 21 and the stand supporting plate 25, i.e., unmovably supported at two positions in the vertical direction, the monitor stand is unlikely to be displaced in the radial direction as well as the tilting direction. Accordingly, even if an external force is applied to the monitor stand 6 and the monitor stand 6 is inclined relative to the base frame 21, the posture of the monitor stand 6 relative to the base frame 21 is rigidly maintained. In other words, mounting strength of the monitor stand 6 is improved, so that a problem that the monitor stand 6 wobbles relative to the mounted portion is unlikely to occur. It should be noted that, as later described, since the monitor stand 6 serves as a part of a carry handle, it is important to have the improved mounting strength as described above.

Figure 7:
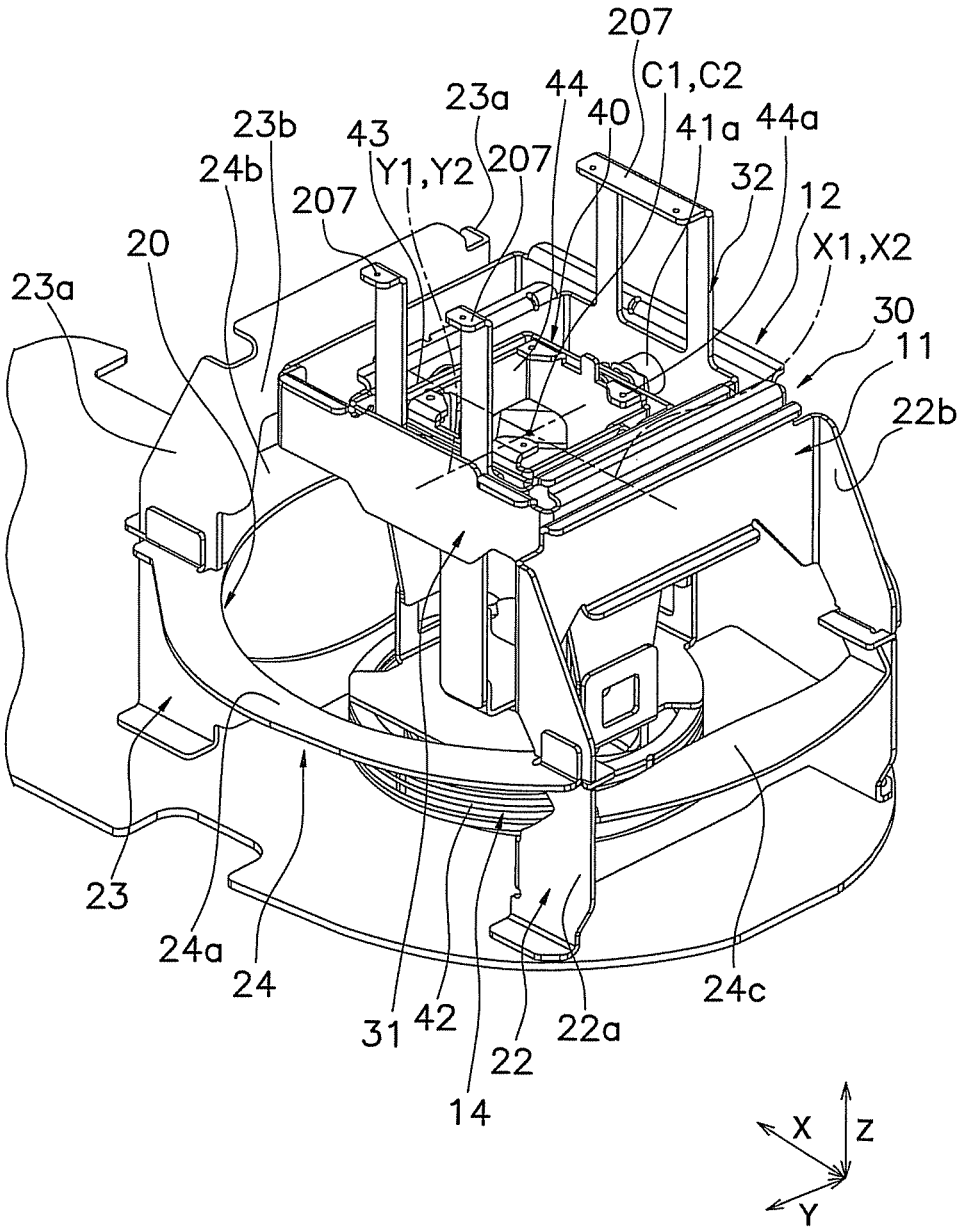
FIG. 7 is a perspective view of the interior of the training apparatus main body.

The first supporting bracket 22 and the second supporting bracket 23 are disposed, as shown in FIG. 7, with a gap therebetween in the front-and-back X direction. The first supporting bracket 22 and the second supporting bracket 23 are formed by bending a steel plate, for example, and support both ends of the movable frame 12 such that the movable frame 12 can tilt. The first supporting bracket 22 is fixed to a back portion (a front side of the apparatus) of the base frame 21. The first supporting bracket 22 includes a right and left pair of first fixed portions 22*a*, and a first supporting portion 22*b* connecting the pair of first fixed portions 22*a* at an upper portion. The first fixed portions 22*a* are formed by bending both ends of the first supporting portion 22*b*, and are fixed to the base frame 21. The second supporting bracket 23 is fixed to the base frame 21 at a position forward of and opposite to the first supporting bracket 22. The second supporting bracket 23 has a configuration substantially similar to the first supporting bracket 22, and includes a pair of second fixed portions 23*a* and a second supporting portion 23*b*.

Figure 6:
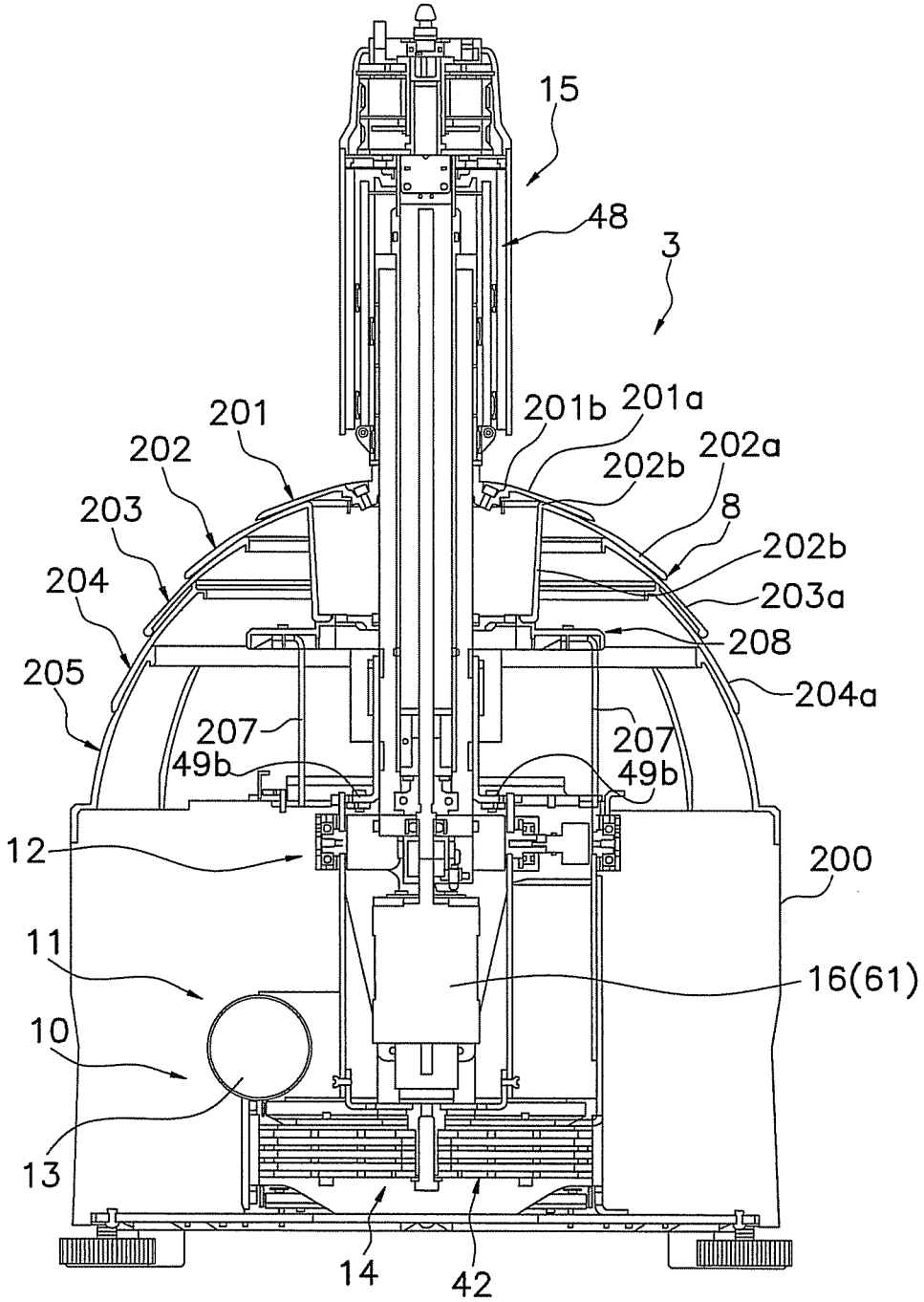
FIG. 6 is a schematic cross section of the training apparatus main body.

The first supporting bracket 22 and the second supporting bracket 23 are reinforced by a reinforcing member 24. The reinforcing member 24 is, as shown in FIG. 6 and FIG. 7, a plate-like member having a D-shape in a plane view. The reinforcing member 24 is a part of a tilting range restriction mechanism 20 that structurally restricts the tilting range of the operation rod 15. The tilting range restriction mechanism 20 will be described later.

The reinforcing member 24 includes a pair of first reinforcing portions 24*a* that connects outer surfaces of the first fixed portion 22*a* and the second fixed portion 23*a*, a second reinforcing portion 24*b* that connects inner surfaces of the second fixed portion 23*a*, and a third reinforcing portion 24*c* that connects inner surfaces of the first fixed portion 22*a* . The pair of first reinforcing portions 24*a* and the second reinforcing portion 24*b* are integrally formed and substantially arc-shaped in a plane view. The pair of first reinforcing portions 24*a* is a line symmetrical member. The pair of first reinforcing portions 24*a* and second reinforcing portion 24*b* are formed to have an inner circumferential end surface in an arc-shape. The third reinforcing portion 24*c* connects the inner surfaces of the first fixed portion 22*a* at position lower than the first reinforcing portions 24*a* and the second reinforcing portion 24*b*. The third reinforcing portion 24*c* has an inner circumferential end surface 24*d* smoothly and slightly extending toward the movable frame 12 in the central portion (refer to FIG. 8).

(2-2) Movable Frame

Figure 8:
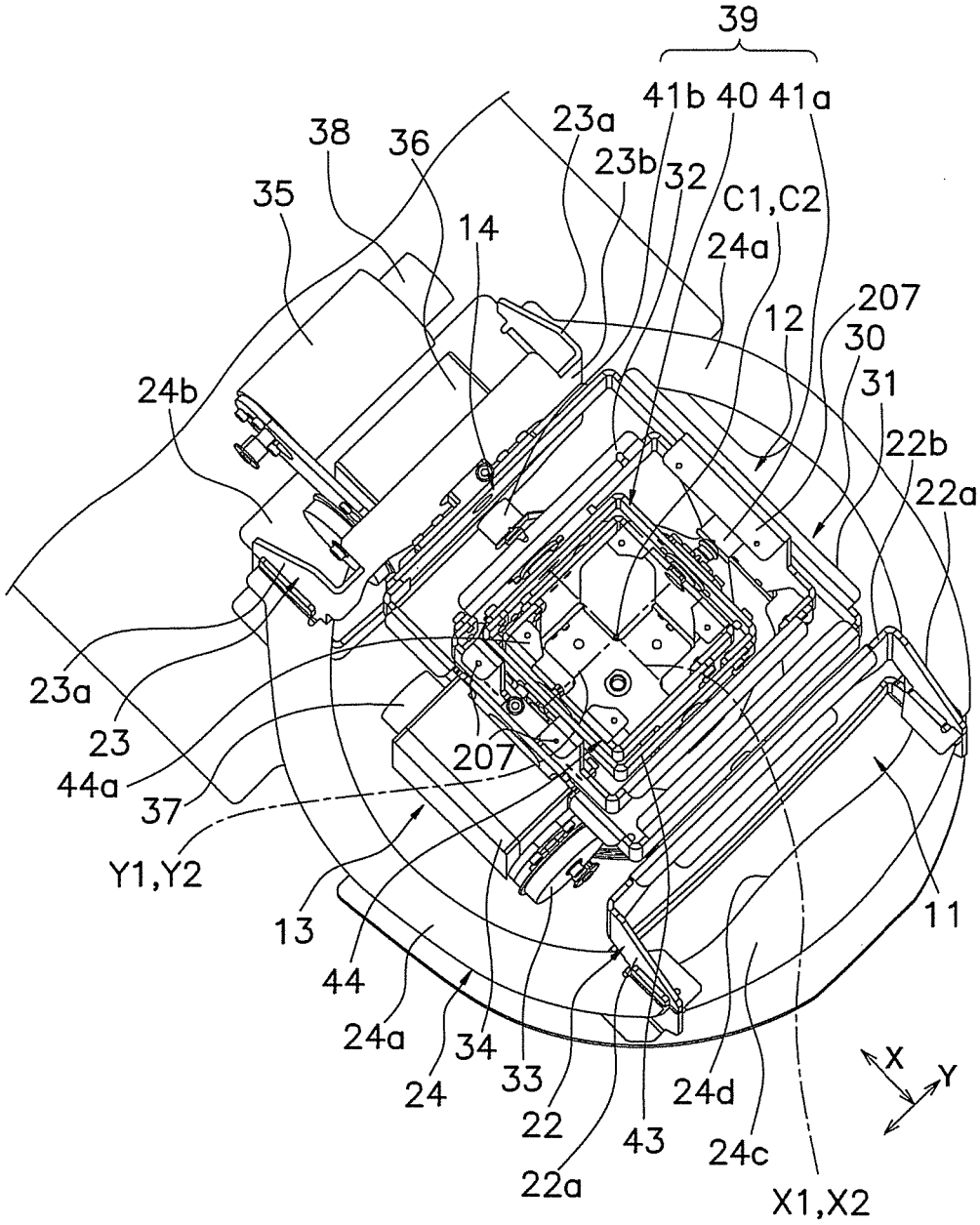
FIG. 8 is a perspective view of the interior of the training apparatus main body.
Figure 9:
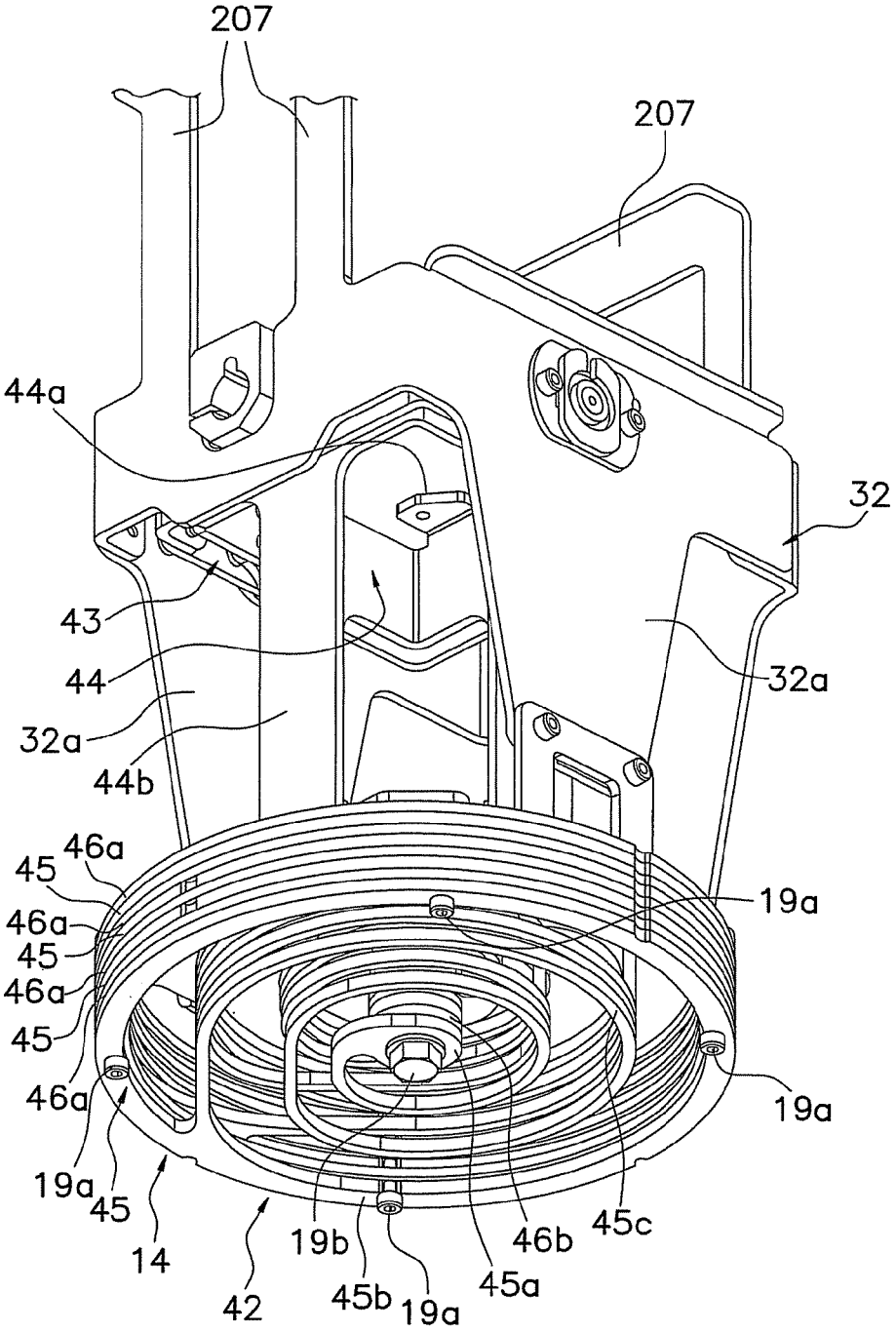
FIG. 9 is a perspective view of a tilting operation force detecting mechanism.

The movable frame 12 includes, as shown in FIG. 7, FIG. 8 and FIG. 9, a first gimbal mechanism 30. The first gimbal mechanism 30 includes a first moving portion 31 rotatably fixed to the fixed frame 11, and a second moving portion 32 rotatably fixed to the first moving portion 31.

The first moving portion 31 is a plate-like member formed to be a substantially rectangular frame by bending a steel plate at four portions. Two ends of the first moving portion 31 are supported by the first supporting bracket 22 and the second supporting bracket 23 so as to be able to turn around an axis extending in the front-and-back X direction. The second moving portion 32 is disposed inside of the first moving portion 31, and is a member made of steel plates formed into a rectangular frame smaller than the first moving portion 31. Two ends of the second moving portion 32 are supported by the first moving portion 31 so as to be able to turn around an axis extending in the right-and-left Y direction.

A position where the first moving portion 31 is rotatably supported and a position where the second moving portion 32 is rotatably supported are axially the same in the vertical Z direction. Accordingly, the turning center X1 of the first moving portion 31 and the turning center Y1 of the second moving portion 32 are positioned perpendicular to each other. An intersection point of the turning center X1 and the turning center Y1 is a first tilting center C1.

(2-3) Tilting Resistance Applying Mechanism

As shown in FIG. 5 and FIG. 8, the tilting resistance applying mechanism 13 includes an electric X axis motor 35 for driving the first moving portion 31 that is located outside, and an X axis reduction mechanism 36 for reducing the speed of the rotation of an output shaft of the X axis motor 35. The tilting resistance applying mechanism 13 further includes an electric Y axis motor 33 for driving the second moving portion 32 that is located inside, and a Y axis reduction mechanism 34 for reducing the speed of the rotation of an output shaft of the Y axis motor 33.

The X axis motor 35 and the X axis reduction mechanism 36 are fixed by the second supporting bracket 23, for example. The X axis reduction mechanism 36 is connected to the first moving portion 31, and reduces the rotation of the output shaft of the X axis motor 35 with a reduction ratio of around 1/60 and applies the rotation with the reduced speed to the first moving portion 31. The X axis motor 35 is positioned at a place which is closer to the floor surface FL in the vertical Z direction than the X axis reduction mechanism 36. The X axis motor 35 is connected to the X axis reduction mechanism 36 via a toothed belt (not shown).

The Y axis motor 33 and the Y axis reduction mechanism 34 are fixed to the first moving portion 31 located outside, for example. The Y axis reduction mechanism 34 is connected to the second moving portion 32, and reduces the speed of the rotation of the output shaft of the Y axis motor 33 with a reduction ratio of around 1/60, and applies the rotation with the reduced speed to the second moving portion 32. The Y axis motor 33 is positioned closer to the floor surface FL in the vertical Z direction than the Y axis reduction mechanism 34. The Y axis motor 33 is connected to the Y axis reduction mechanism 34 with a toothed belt (not shown).

An X axis rotary encoder 38 and a Y axis rotary encoder 37 are respectively connected to the X axis motor 35 and the Y axis motor 33. The X axis rotary encoder 38 detects tilting amount around the front-and-back X axis of the operation rod 15. The Y axis rotary encoder 37 detects tilting amount around the right-and-left Y axis. The tilting amount of the operation rod 15 includes at least one of an angle position and an angle displacement amount as well as rotation direction calculated based on the output of the X axis rotary encoder 38 and the Y axis rotary encoder 37.

The tilting resistance applying mechanism 13 applies the resistance to the operation rod 15 by driving and controlling at least one of the angle position and the angle displacement amount as well as the rotation direction of the Y axis motor 33 and the X axis motor 35 in accordance with the operation force of the patient T detected by the tilting operation force detecting mechanism 14. The Y axis motor 33 and the X axis motor 35 are positioned below the first tilting center C1.

(2-4) Tilting Operation Force Detecting Mechanism

The tilting operation force detecting mechanism 14 is arranged, as shown in FIG. 5 to FIG. 9, between the movable frame 12 of the frame 10 and the operation rod 15. The tilting operation force detecting mechanism 14 is, as described above, a mechanism that detects tilting operation vectors including tilting operation forces in all of the directions and the tilting direction from the first tilting center C1, including the front-and-back X direction and the right-and-left Y direction, which are applied to the operation rod 15 by the tilting operation by the patient T. In other words, the tilting operation force detecting mechanism 14 detects the amount and direction of the operation force by the patient T when the operation rod 15 is tilted. The tilting operation force detecting mechanism 14 includes a load member 42 and a vector detecting section 39. When the operation rod 15 is tilted, the load member 42 is displaced and generates a predetermined elastic resistance force corresponding to the tilting amount regardless of the tilting direction. The vector detecting section 39 detects the tilting operation force applied to the operation rod 15 due to the displacement of the load member 42 and the tilting direction of the operation rod 15. The vector detecting section 39 includes a second gimbal mechanism 40, and an X-axis potentiometer 41*b*, and a Y axis potentiometer 41*a*.

According to the upper limb training apparatus 1, if the patient T tilts the operation rod 15, the load member 42 is displaced according to the operation force and the tilting direction. During the tilting operation of the operation rod 15, the load member 42 is displaced, thereby generating a predetermined elastic resistance force corresponding to the tilting amount regardless of the tilting direction. The displacement is detected by the vector detecting section 39, so that the tilting operation vector including the tilting direction and the tilting operation force by the patient T is detected. In this example, since the load member 42 is displaced and generates the predetermined elastic resistance force corresponding to the tilting amount regardless of the tilting direction, the vector detecting section 39 can detect the tilting operation vector including the tilting operation force the and tilting direction while suppressing direction dependence of the load member. Accordingly, even if the operation rod 15 is tilted in any directions, it is possible to precisely detect the tilting operation vector by the patient T. Using the detected result, it is possible to provide an appropriate load to the patient T for training the upper limb of the patient T, for example.

The second gimbal mechanism 40 is supported by the movable frame 12 such that the second gimbal mechanism 40 can tilt in all directions around a second tilting center C2. The second gimbal mechanism 40 includes a third moving portion 43 mounted on the second moving portion 32 such that the third moving portion 43 can turn, and a fourth moving portion 44 mounted to the third moving portion 43 such that the fourth moving portion 44 can turn. The third moving portion 43 is connected to the second moving portion 32 such that the third moving portion 43 can turn around the front-and-back X direction axis. The third moving portion 43 is disposed inside of the second moving portion 32, and is a member made of steel plates bent into a rectangular frame smaller than the second moving portion 32. The fourth moving portion 44 is connected to the third moving portion 43 such that the fourth moving portion 44 can turn around the right-and-left Y direction axis. The fourth moving portion 44 is disposed inside of the third moving portion 43, and is a member made of steel plates bent into a rectangular frame smaller than the third moving portion 43. The fourth moving portion 44 is formed with four rod fixing portions 44*a* for fixing the operation rod 15 at an upper portion thereof, the four rod fixing portions 44*a* including two sets, each consisting of two pieces, opposing each other.

A position at which the third moving portion 43 is rotatably supported and a position at which the fourth moving portion 44 is rotatably supported are the same in the vertical Z direction. Accordingly, the turning axis X2 of the third moving portion 43 and the turning axis Y2 of the fourth moving portion 44 are disposed perpendicular to each other. In this embodiment, when the operation rod 15 is standing upright without tilting, in the first gimbal mechanism 30 and the second gimbal mechanism 40, the turning axis X1 and the turning axis X2 are arranged on the same line, and the turning axis Y1 and the turning axis Y2 are arranged on the same line. Accordingly, the supporting positions of the first gimbal mechanism 30 and the second gimbal mechanism 40 are at the same height position in the vertical Z axial direction. In other words, a position at which the movable frame 12 is pivotally supported relative to the fixed frame 11 and a position at which the operation rod 15 is pivotally supported relative to the movable frame 12 are arranged on the same plane. An intersection point of the turning axis X2 and the turning axis Y2 is the second tilting center C2 and is arranged at the same position as the first tilting center C1.

The X axis potentiometer 41*b* is fixed to the second moving portion 32, and detects the turning amount around the turning axis X2 of the third moving portion 43. The Y axis potentiometer 41*a* is fixed to the third moving portion 43, and detects the turning amount around the turning axis Y2 of the fourth moving portion 44.

The load member 42 is displaced thereby generating a predetermined elastic resistance force corresponding to the tilting amount of the operation rod 15 regardless of the tilting direction. In other words, the load member 42 is a member having small direction dependence. The load member 42 includes, as shown in FIG. 9, a plurality of (four, for example) plate springs 45 disposed between the second moving portion 32 of the first gimbal mechanism 30 and the fourth moving portion 44 of the second gimbal mechanism 40. The second moving portion 32 and the fourth moving portion 44 are respectively formed with a pair of fixed brackets 32*a* and a pair of fixed brackets 44*b* extending downward for fixing the plate springs 45.

Figure 10:
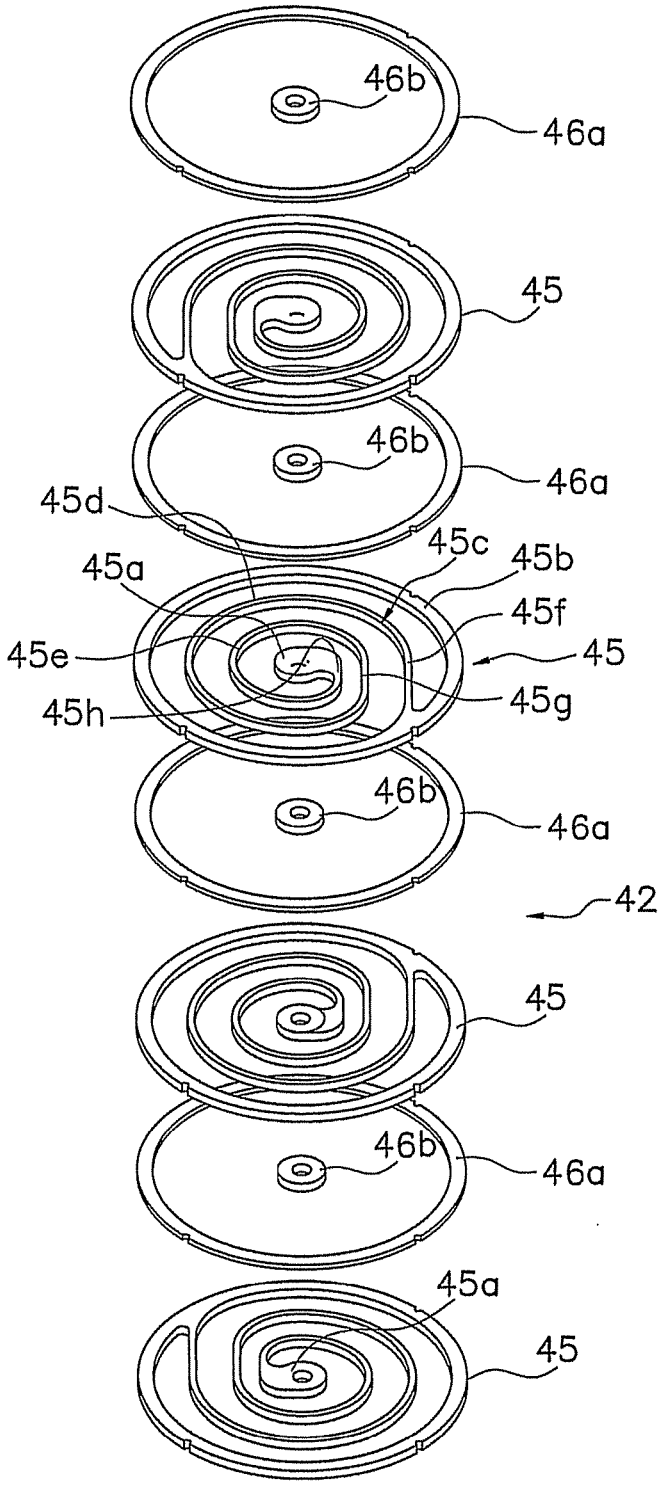
FIG. 10 is an exploded perspective view of a load member.

The four plate springs 45 are, as shown in FIG. 9 and FIG. 10, formed by cutting out the metallic thin plates, and having the same form. Between the four plate springs 45 and on the uppermost layer, spacers 46*a* made of metallic thin plates are disposed. Accordingly, it is possible to avoid the interference between the plate springs 45 when the load member 42 is displaced, and a central portion 45*a* of the plate spring 45 tends to be displaced more easily than a peripheral portion 45*b*. Accordingly, it is possible to precisely detect the tilting operation vector. Each of the plate springs 45 includes the central portion 45*a*, the peripheral portion 45*b* at the outside, and a convolution portion 45*c* having one end connected to the central portion 45*a* and the other end connected to the peripheral portion 45*b*. The lower end portion of the operation rod 15 is disposed in the central portion 45*a* of the plate springs 45, and the convolution portion 45*c* is displaced in accordance with the tilting operation force of the operation rod 15. Specifically, a tip of the fixed bracket 44*b* of the fourth moving portion 44 to which the operation rod 15 is attached to the central portion 45*a*. Since the convolution portion 45*c* is disposed between the peripheral portion 45*b* and the central portion 45*a*, the operation rod 15, connected to the central portion 45*a*, tends to be displaced more easily than the peripheral portion 45*b*. The width of the convolution portion 45*c* is substantially constant. Accordingly, regardless of the tilting direction, the convolution portion 45*c* tends to generate a predetermined elastic resistance force in accordance with the tilting amount.

The spacers 46*a* are ring-like members arranged over the peripheral portion 45*b*. Between the central portions 45*a*, washers 46*b*, having the same thickness as the spacers 46*a* are arranged.

It is easy to work the peripheral portion 45*b* and the central portion 45*a* of the plate springs 45 in the convolutional shape, and it is possible to precisely work them. Accordingly, it is possible to produce the load member having small direction dependence precisely and easily.

The peripheral portion 45*b* is a perfect circle, and has an outer circumferential surface having the same shape as that of the spacer 46*a*. Accordingly, when the four plate springs 45 and the four spacers are overlaid, the outer circumferential surface of the load member 42 becomes circular in shape. Accordingly, when the peripheral portions of the plate springs 45 and the spacers 46*a* are overlaid, it is possible to obtain a smooth appearance, and it becomes easy to use the load member 42 as a tilt restriction member (later described) for restricting the tilting direction of the operation rod 15.

The load member 42 also has a function of, as later described, a tilt restriction member for restricting the tilting range of the operation rod 15, in the tilting range restriction mechanism 20 for mechanically restricting the tilting range of the operation rod 15 (refer to FIG. 7). In other words, the load member 42, i.e., the tilt restriction member, gets into contact with the reinforcing member 24 to structurally restrict the tilting range of the operation rod 15. In this example, since the spacer 46*a* and the peripheral portion 45*b* of the plate spring 45 have the same perfect circle shape, even if the load member 42 is employed as a tilt restriction member, the load member 42 is allowed to make a point contact with the inner circumferential end surface of the reinforcing member 24 regardless of the tilting direction. Accordingly, regardless of the tilting direction, it is possible to restrict the operation rod 15 at substantially the same tilting angle.

The peripheral portion 45*b* is fixed to the fixed bracket 32*a* of the second moving portion 32 via four bolt members 19*a*, for example. As described above, the plurality of plate springs 45 are collectively attached to the movable frame 12. Accordingly, it is easy to attach and remove the load member 42. In addition, the central portion 45*a* is fixed to the bottom surface of the fixed bracket 44*b* of the fourth moving portion 44 via one bolt member 19*b*, for example. Accordingly, the lower end portion of the operation rod 15 is disposed in the central portion 45*a*.

The four plate springs 45 are arranged with their two sides reversed and 180 degree out of phase relative to each other. For example, in FIG. 10, the second plate spring 45 from the bottom is arranged 180 degree out of phase relative to the lowest plate spring 45. The second plate spring 45 from the top is arranged with both sides being reversed relative to the second plate spring 45 from the bottom. The top plate spring 45 is arranged 180 degree out of phase relative to the second plate spring 45 from the top. Accordingly, even if the tilting operation force applied to the operation rod 15 has any directions, the convolution portion 45*c* generates elastic resistance force having almost the same amount. As a result, the direction dependence of the load member 42 becomes smaller.

In order to further reduce the direction dependence, the convolution portion 45*c* includes a first arc-shaped portion 45*d* arranged coaxial with the peripheral portion 45*b*, and a second arc-shaped portion 45*e* having a diameter smaller than that of the first arc-shaped portion 45*d* and being arranged coaxial with the first arc-shaped portion 45*d*. Since the first arc-shaped portion 45*d* and the second arc-shaped portion 45*e* have smaller direction dependence, it is possible to reduce the direction dependence of the convolution portion 45*c*. The convolution portion 45*c* includes a first connecting portion 45*f* for connecting the peripheral portion 45*b* with the first arc-shaped portion 45*d*, a second connecting portion 45*g* for connecting the first arc-shaped portion 45*d* with the second arc-shaped portion 45*e*, and a third connecting portion 45*h* for connecting the second arc-shaped portion 45*e* with the central portion 45*a*. The first arc-shaped portion 45*d* and the second arc-shaped portion 45*e* occupy equal to or more than ¾ of the angle range of the convolution portion 45*c*. As described above, since the first arc-shaped portion 45*d* and the second arc-shaped portion 45*e*, having small direction dependence, occupy a lot of the area of the convolution portion 45*c*, the direction dependence of the convolution portion 45*c* is reduced.

The first connecting portion 45*f*, the second connecting portion 45*g*, and the third connecting portion 45*h* are unevenly arranged in the same angle range. In this embodiment, the first connecting portion 45*f*, the second connecting portion 45*g*, and the third connecting portion 45*h* are arranged at any angle ranged between a starting point and an ending point of the first arc-shaped portion 45*d* and the second arc-shaped portion 45*e*. As described above, since the first connecting portion 45*f*, the second connecting portion 45*g*, and the third connecting portion 45*h*, having large direction dependency, are unevenly arranged in the predetermined angle range, the direction dependence of the first connecting portion 45*f*, the second connecting portion 45*g*, and the third connecting portion 45*h* are canceled, by arranging the first connecting portion 45*f*, the second connecting portion 45*g*, and the third connecting portion 45*h* with changed phase and/or reversed two sides.

As described above, the load member 42 includes the four plate springs 45, and the two plate springs 45 and the other two plate springs 45 are alternately overlapped with each other with the two sides being reversed, and the two plate springs 45 having the same orientation are positioned with 180 degree out of phase. Accordingly, since the plate springs 45 of four types with different sides and phases from each other are overlapped with each other, it is possible to precisely detect the tilting operation vector by reducing the direction dependence of the load member 42.

As long as the load member includes an even number of plate springs, i.e. not necessarily four, half of the plate springs and the other half of the plate springs can be alternately overlapped with each other, with two sides being reversed relative to each other. In this case, the orientation of the plate springs becomes two types, i.e., a front side type and a back side type, and the front side type and the back side type plate springs are alternately overlapped with each other. Accordingly, it is possible to precisely detect the tilting operation vector by reducing the direction dependence of the load member. As long as the load member includes a plurality of plate springs (not necessarily an even number), the convolution portion of at least one of the plate springs can be out of phase in the rotation direction. Accordingly, since the elastic resistance forces corresponding to the tilting direction are different from each other between the plate spring out of phase and the plate spring not out of phase, it is possible to further reduce the direction dependence of the load member and to precisely detect the tilting operation vector.

(2-5) Operation Rod

The operation rod 15 is, as shown in FIG. 6, supported axially by the movable frame 12 such that the operation rod 15 can tilt in the front-and-back X direction and right-and-left Y direction by the tilting operation force detecting mechanism 14. As shown in FIG. 3, the operation rod 15 includes an operation rod main body 57, and an attachment fixed portion 59. The operation rod main body 57 includes an extension and contraction mechanism 47, and a rod cover 48 covering the circumference of the extension and contraction mechanism 47.

Figure 11:
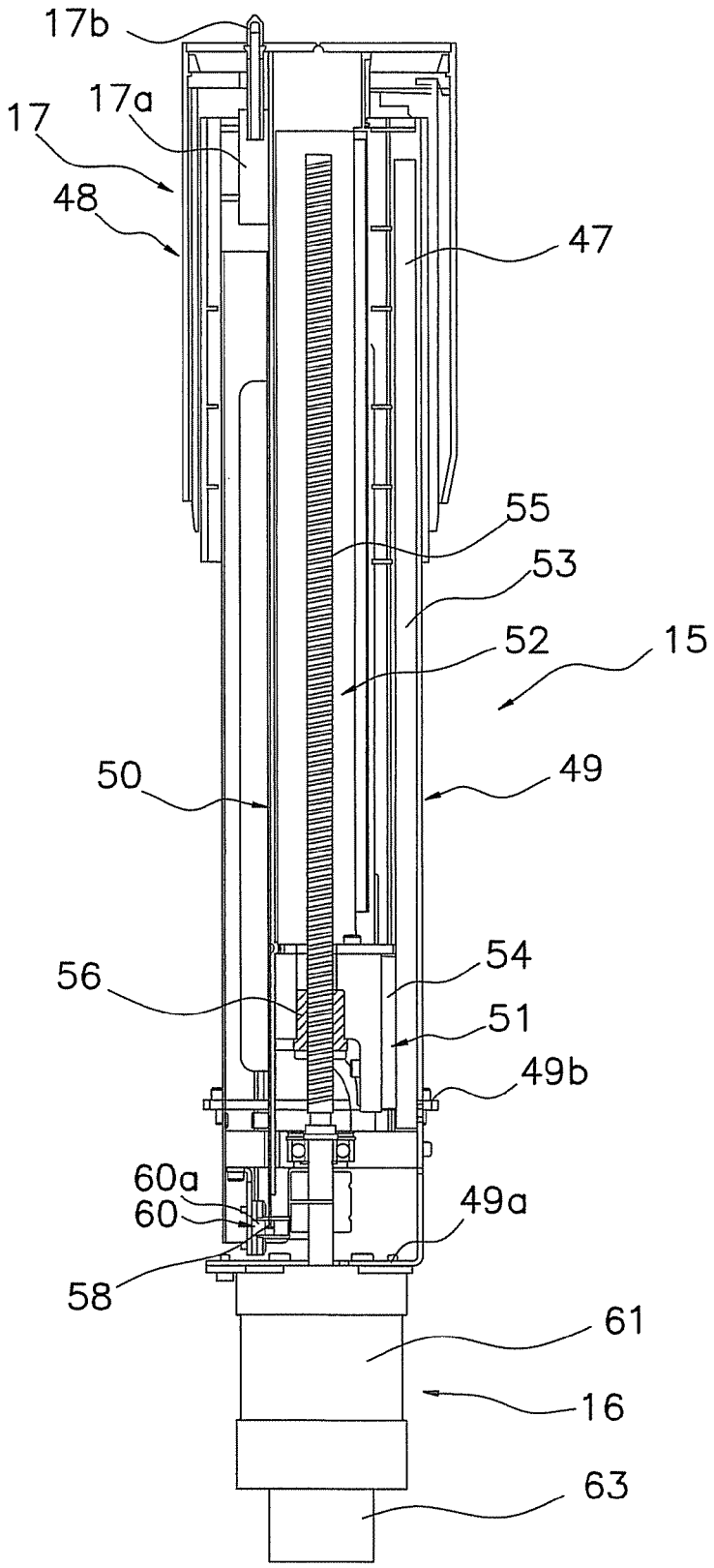
FIG. 11 is a cross sectional view of the operation rod.
Figure 12:
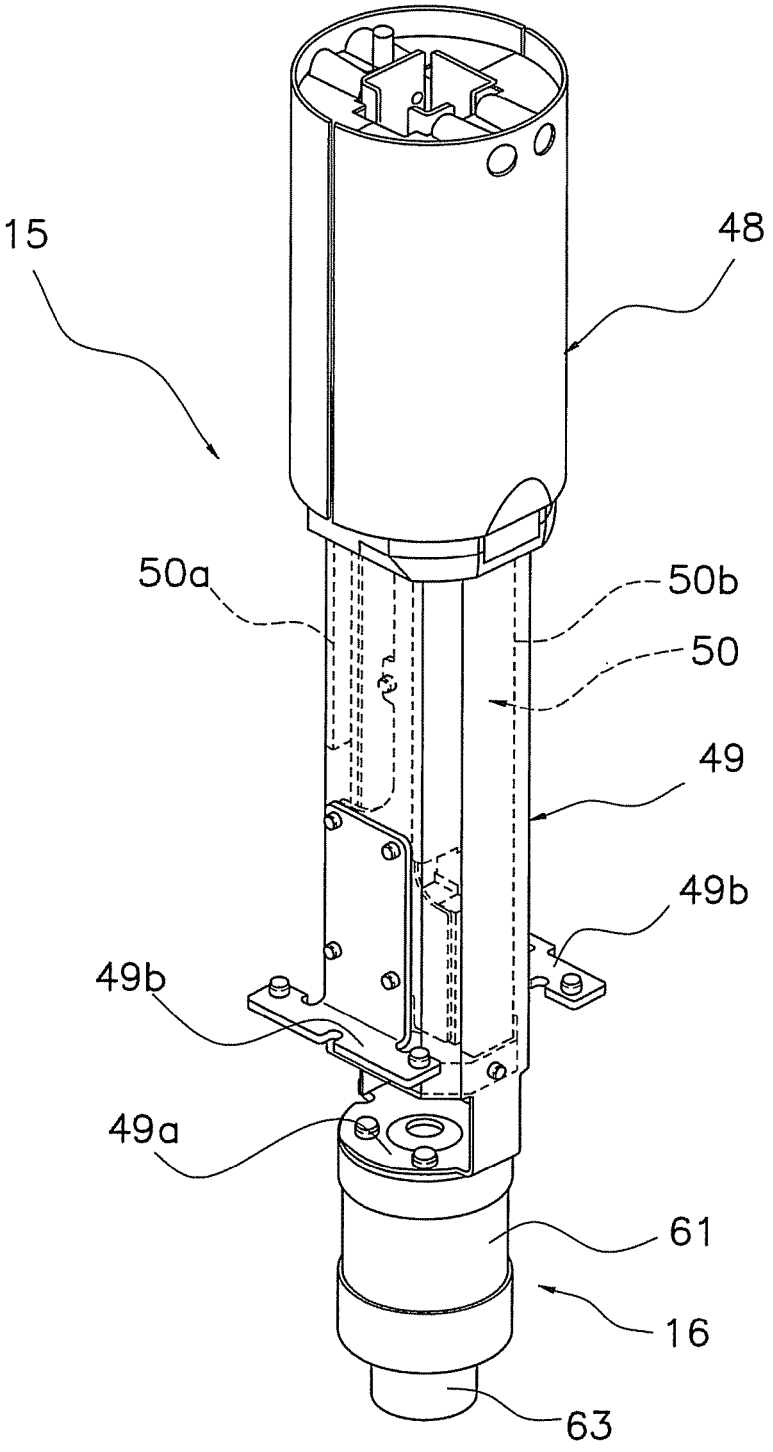
FIG. 12 is a perspective view of the operation rod.

As shown in FIG. 11 and FIG. 12, the extension and contraction mechanism 47 includes a fixed stay 49, a movable stay 50 moving vertically relative to the fixed stay 49, a linear guide 51 for guiding the movable stay 50 linearly, and a lift mechanism 52 for moving the movable stay 50 vertically.

The fixed stay 49 is attached to the movable frame 12, more specifically, is fixed from the upward to the rod fixed portion 44*a* of the fourth moving portion 44 of the tilting operation force detecting mechanism 14 with bolts, as shown in FIG. 6 and FIG. 7. Accordingly, while the exterior cover 18 is removed, it is possible to remove the fixed stay 49 from the second gimbal mechanism 40. As a result, it is possible to attach and remove the operation rod 15 to and from the movable frame 12, so that the operation rod 15 can be exchanged depending on the training contents and the training environment or when something is wrong with the operation rod 15.

The fixed stay 49 is, as shown in FIG. 12, a member formed by bending a steel plate so that the cross section becomes a channel steel form. An L-shaped fixed bracket 49*b* fixed to the rod fixed portion 44*a* of the fourth moving portion 44 is fixed to the right and left surfaces near the lower end of the fixed stay 49. The lower portion of the fixed stay 49 is formed with a motor supporting portion 49*a* bent at 90 degrees. A Z-axis motor 61 is fixed to the bottom surface of the motor supporting portion 49*a*. A guide rail 53 having a length in the vertical direction for constituting the linear guide 51 is fixed to the inside surface of the fixed stay 49 (refer to FIG. 11). A ball screw shaft 55 constituting the lift mechanism 52 extending between the upper end and the lower end of the fixed stay 49 is rotatably supported by the lower end of the fixed stay 49.

Figure 13:
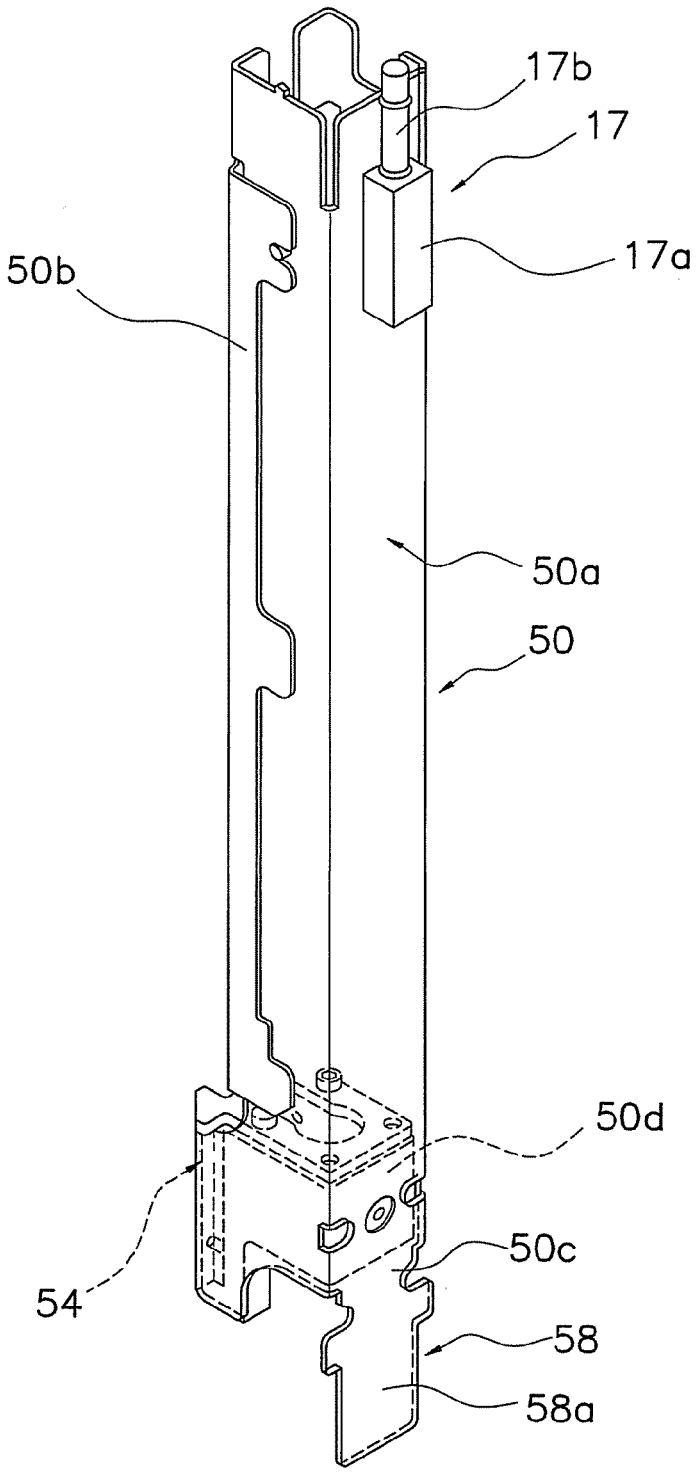
FIG. 13 is a perspective view of a movable stay.

As apparent from FIG. 13, the movable stay 50 is disposed inside the fixed stay 49, and is a lengthwise member in the vertical direction. The movable stay 50 includes an inner frame member 50*a* and an outer frame member 50*b*, which are formed by bending a steel plate to make a cross section of a double housing shape. The outer frame member 50*b* is positioned opposing to an outside surface of the inner frame member 50*a* such that the cross section of the movable stay 50 is rectangular.

Figure 14:
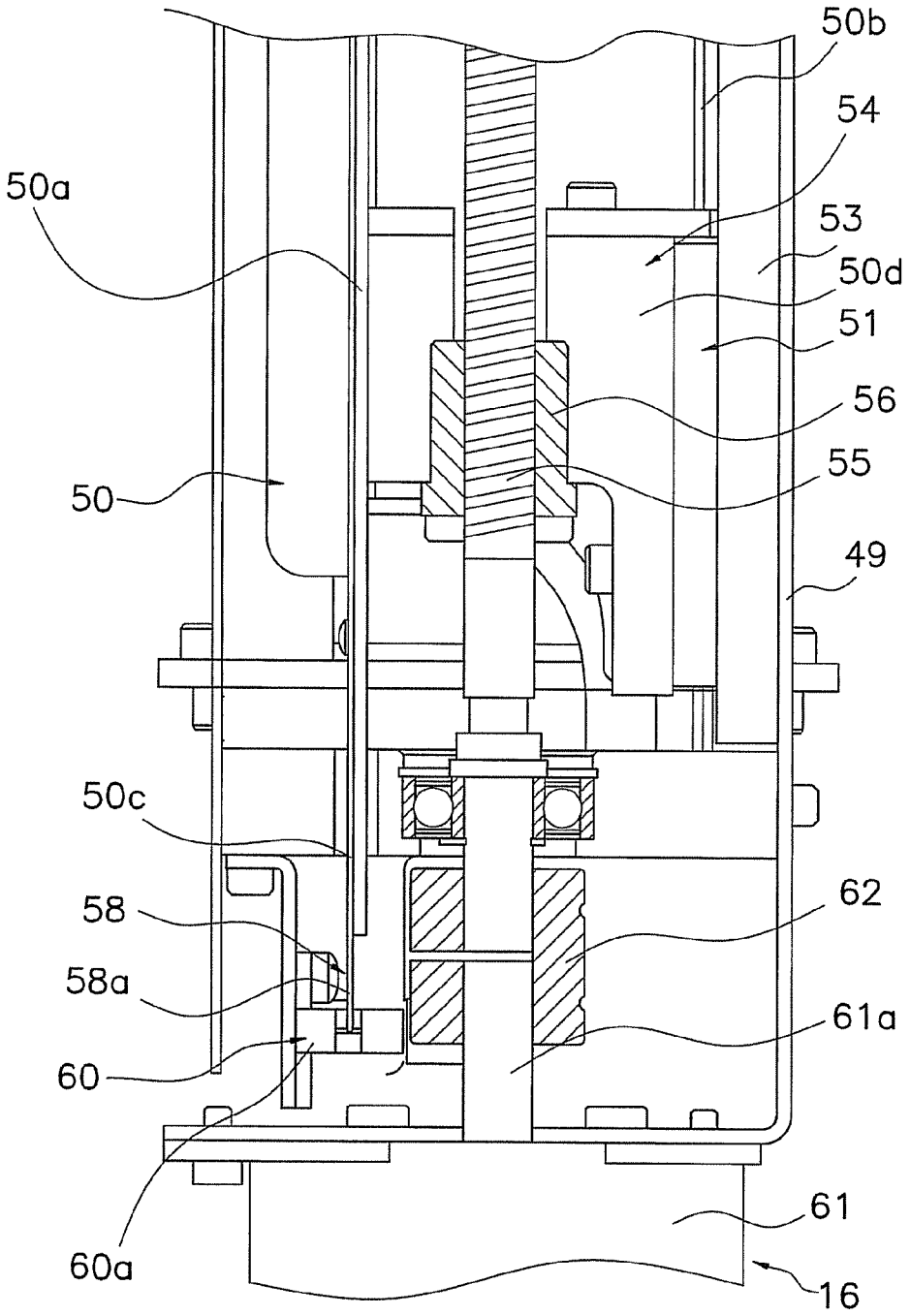
FIG. 14 is a lower portion cross-sectional view of the movable stay.

In the lower portion of the inner frame member 50*a*, a slide unit 54 guided by the guide rail 53 is fixed to a block 50*d*. The inner frame member 50*a* holds the slide unit 54 by pinching the block 50*d* and the slide unit 54 from both sides, as shown in FIG. 14. The linear guide 51 is constituted by the slide unit 54 and the guide rail 53. To the block 50*d*, which is a portion of the inner frame member 50*a* to which the slide unit 54 is fixed, a ball nut 56 constituting the lift mechanism 52 is fixed. The ball nut 56 is threaded with the ball screw shaft 55. Accordingly, the movable stay 50 can move linearly along the fixed stay 49 in the extension and contraction direction (vertical Z direction).

As described above, the ball nut 56 and the slide unit 54 are attached to the block 50*d* fixed to the movable stay 50, and the block 50*d* and the slide unit 54 are attached to the movable stay 50 such that both sides of them are pinched by the movable stay 50. To the fixed stay 49, the ball screw shaft 55 and the guide rail 53 are attached. Accordingly, it is unlikely that the slide unit 54 and the ball nut 56 are displaced relative to the movable stay 50 in the axial direction. The strength of the fixed stay 49 is improved too.

A lower end portion 50*c* of the inner frame member 50*a* is, as shown in FIG. 13 and FIG. 14, a detection portion 58 having a detection piece 58*a* hanging down. The detection portion 58 is provided to be detected by the lower end position detecting section 60, allowing the lower end position of the movable stay 50 to be detected. The lower end position detecting section 60 is, for example, a phototransmitting and photoreceiving type photolelectronic sensor (photointerrupter) 60*a* fixed to the fixed stay 49. The photolelectronic sensor 60*a* detects the lower end position of the movable stay 50 when the opened optical path is interrupted by the detection piece 58*a*. In this example, since the detection piece 58*a* hanging down from the lower end portion of the movable stay 50 is used to detect the lower end position, the lower end position of the movable stay 50 can be positioned as low as possible. Since the lower end position detecting section 60, which needs wirings through which the signals are sent, is fixed to the fixed stay 49, it is unlikely that wirings are cut off when the operation rod 15 extends or contracts.

The ball screw shaft 55 is rotatably supported only at a lower end portion thereof by the fixed stay 49 via a bearing. The lower end portion of the ball screw shaft 55 is integrally rotatably connected to an output shaft 61*a* of the electric Z-axis motor 61 via a coupling 62. The output shaft 61*a* and the ball screw shaft 55 are coaxial.

Figure 25:
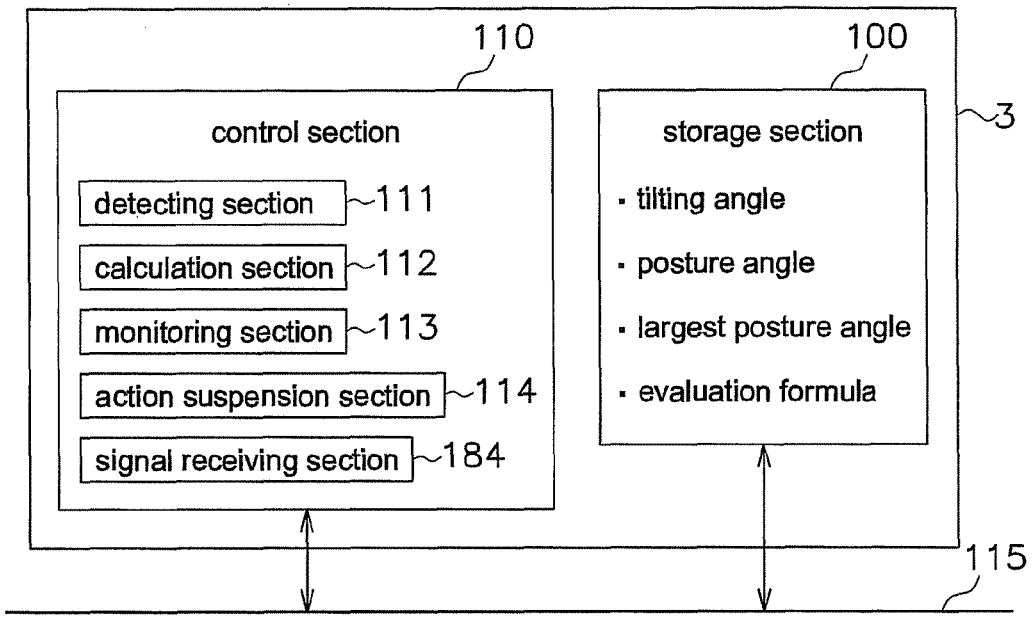
FIG. 25 is a block diagram of a control configuration.

The tilting range of the operation rod 15 is restricted by control based on the moving range restriction program, and by the tilting range restriction mechanism 20. First, a description will be made how the tilting range of the operation rod 15 is restricted by moving range restriction program software. The control based on the moving range restriction program will be performed, as shown in FIG. 25, by a storage section 100 and a control section 110 contained in the training apparatus main body 3. The storage section 100 stores various data. For example, the storage section 100 temporarily and/or in the long term stores various programs, various parameters, various data, and data in the process, for example. The storage section 100 includes ROM (Read Only Memory) and RAM (Random Access Memory), for example.

The control section 110 issues control signals to the various mechanisms in order to control the various mechanisms. The control section 110 performs various determination processes, and controls the various mechanisms based on the determination results. For example, the control section 110 reads out the programs related to control and calculation from the storage section 100, and performs various controls, various determination processes, and various calculations in order to control the various mechanisms. The control section 110 includes a CPU (Central Processing Unit), for example. The control section 110 is connected to the storage section 100 via a bus 115.

The moving range restriction program limits the moving range of the movable frame 12, and is stored in the storage section 100. In this example, the control section 110 controls action of the movable frame 12 based on the moving range restriction program. The moving range restriction program includes, as shown in FIG. 25, a detecting section 111 for detecting the action of the movable frame 12, a calculation section 112 for calculating posture angle h indicating tilting condition of the movable frame 12, a monitoring section 113 for monitoring whether or not the posture angle h of the movable frame 12 exceeds the predetermined angle, and an action suspension section 114 for suspending the action of the movable frame 12 if the posture angle h of the movable frame 12 exceeds the predetermined angle.

The posture angle h corresponds to an angle defined by the vertical direction axis (Z-Axis) relative to the floor surface and the axial center of the operation rod 15, with the first tilting center C1 as a standard. In other words, the posture angle h corresponds to an angle synthesized by tilting angle $\alpha x$ around the X-axis and tilting angle $\alpha y$ around Y-axis.

Figure 26:
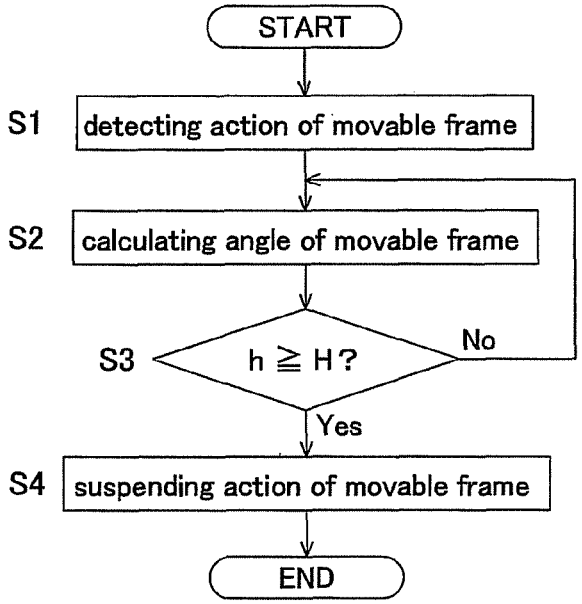
FIG. 26 is a tilting detecting control flowchart.

For example, as shown in FIG. 26, if the movable frame 12 starts the action, the detecting section 111 detects the action of the movable frame 12 (S1). More specifically, the detecting section 111 detects the outputs of the X-axis rotary encoder 38 and Y-axis rotary encoder 37. Then, the calculation section 112 calculates the posture angle h and the largest posture angle H of the movable frame 12 at predetermined time intervals, based on the outputs of the X-axis rotary encoder 38 and the Y-axis rotary encoder 37, e.g., the tilting angle $\alpha x$ around X-axis and the tilting angle $\alpha y$ around Y-axis (S2).

The largest posture angle H is the largest value of the posture angle h which is permitted under control based on the moving range restriction program. The largest posture angle H is determined to be an appropriate value by comprehensively considering the safety and effect of the training.

Next, the monitoring section 113 always monitors whether or not the posture angle h of the movable frame 12 exceeds the largest posture angle H (S3), and if the posture angle h of the movable frame 12 exceeds the largest posture angle H (Yes at step S3), the action suspension section 114 issues a drive stopping order to the tilting resistance applying mechanism 13. Then, the tilting resistance applying mechanism 13 suspends the action, so that the movable frame 12, i.e., the operation rod 15 can not move into a range beyond the largest posture angle H (S4).

If the posture angle h of the movable frame 12 is less than the largest posture angle H (No at S3), the process at step 2 (S2) and the process at step 3 (S3) are executed.

As described above, under the control of the moving range restriction program, a tilting range (second tilting range, later described) of the operation rod 15 is set such that the posture angle h of the movable frame 12 is restricted to be smaller than or equal to the largest posture angle H. Accordingly, even if the patient T operates the operation rod 15 in all of the directions, since the operation rod 15 can not move beyond the predetermined tilting range, it is unlikely that the patient T slips off from the chair 4, thereby ensuring the safety of the patient T.

Next, a case will be described in which the tilting range of the operation rod 15 is restricted by the tilting range restriction mechanism 20 structurally. The tilting range within which the operation rod 15 can act structurally (below, it will be called a first tilting range) is larger than a tilting range in which the operation rod 15 can act while the movable frame 12 is controlled in accordance with the moving range restriction program (below, it will be called a second tilting range). In this example, the first tilting range is set to be larger than the second tilting range by about three degrees, for example.

In other words, the second tilting range is smaller than the first tilting range, and the largest posture angle H is determined such that the second tilting range becomes smaller than the first tilting range. In this example, the largest posture angle H is decided such that the second tilting range is smaller than the first tilting range by about ten degrees, for example.

The tilting range restriction mechanism 20 is constituted by a stopper portion 24*d* for restricting the tilting range of the operation rod 15, and the load member 42 (tilt restriction member) for getting into contact with the stopper portion 24*d*. In detail , the stopper portion 24*d* is an inner circumferential end surface of the reinforcing portions 24*a* through 24*c*. In this case, when the operation rod 15 tilts, the load member 42 as the tilt restriction member gets into contact with the stopper portion 24*d*, thereby structurally restricting the tilting range of the operation rod 15. The shape and range of the inner circumferential end surface of the reinforcing portion 24*c* is formed such that the operation rod 15 does not interfere with the monitor 7.

For example, as shown in FIG. 7 and FIG. 8, the stopper portion 24*d*, i.e., the inner circumferential end surface of the reinforcing member 24, is D-shaped in a plane view. Accordingly, the largest moving range 320 of the load member 42 when the load member 42 moves along the inner circumferential end surface of the reinforcing member 24 becomes D-shaped in a plane view (refer to FIG. 27). As described above, since the first tilting range is larger than the second tilting range, the first largest moving range of the end portion of the operation rod 15 restricted by the stopper portion 24*d* is larger than the second largest moving range of the end portion of the operation rod 15 controlled by the moving range restriction program. The second largest moving range is determined corresponding to the movable range of the movable frame 12 controlled in accordance with the moving range restriction program.

Figure 27:
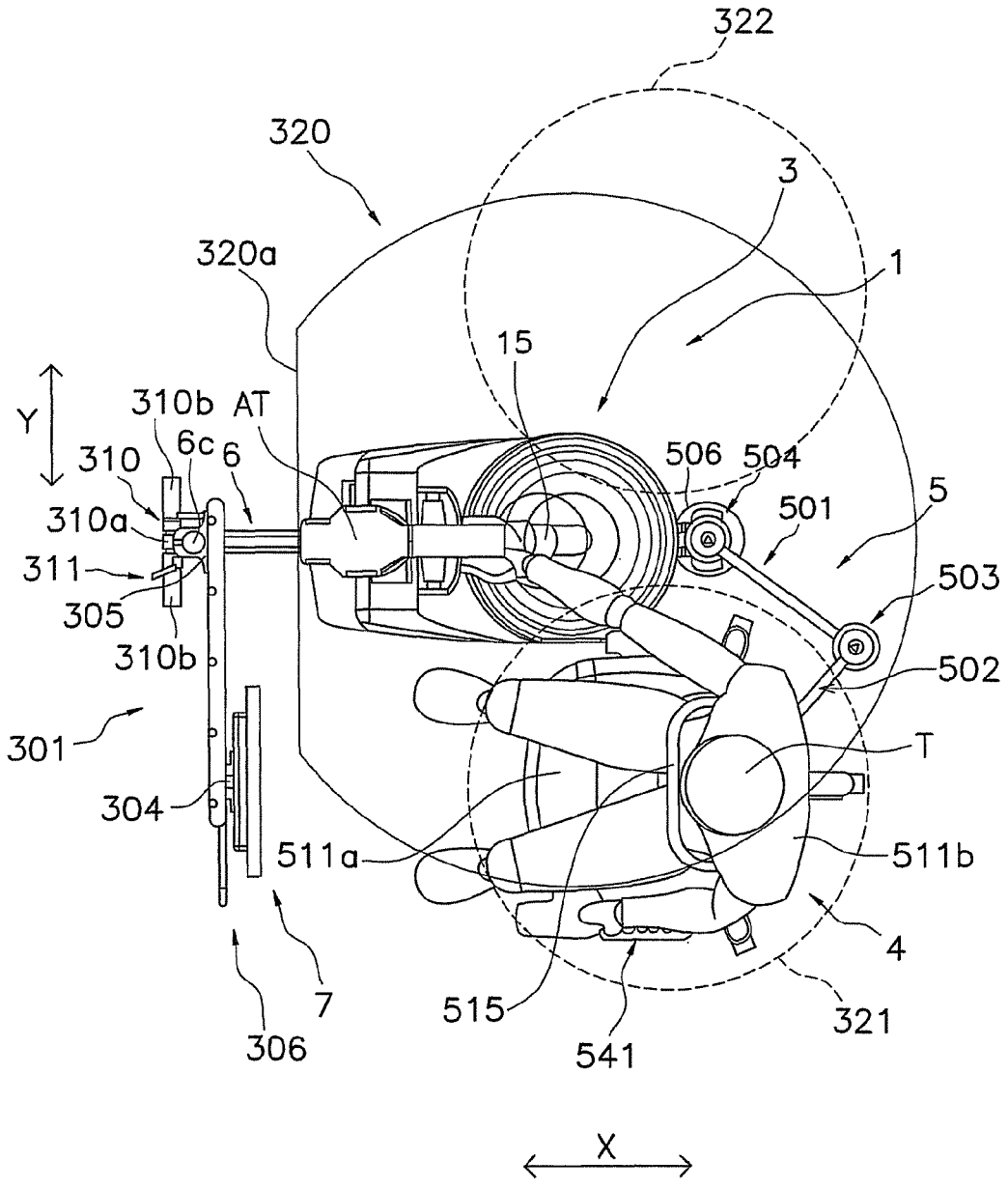
FIG. 27 is a schematic plane view of the upper limb training apparatus.

A part of the stopper portion 24*d*, e.g., the third reinforcing portion 24*c* of the reinforcing member 24 is a portion for determining the largest inclination of the operation rod 15 forward, as seen from the patient T (toward the back side of the apparatus, leftward in FIG. 27). In other words, the third reinforcing portion 24*c* restricts the movable range of the movable frame 12 when the operation rod 15 tilts forward. The third reinforcing portion 24*c* is positioned lower than the first reinforcing portion 24*a* and the second reinforcing portion 24*b* and the inner circumferential portion of the reinforcing portion 24*c* projects toward the first tilting center C1. Accordingly, the inclination angle of the operation rod 15 when the load member 42 gets into contact with the inner circumferential surface of the projecting portion of the third reinforcing portion 24*c* becomes smaller than the inclination angle of the operation rod 15 when the load member 42 gets into contact with the inner circumferential surface of the first reinforcing portion 24*a* or the inner circumferential surface of the second reinforcing portion 24*b*. In this example, the absolute value of the difference between both members in inclination angle is set to be about ten degrees, for example. As described above, since the tilting range forward of the operation rod 15 is smaller than the tilting range in other directions, even if the patient T operates the operation rod 15 forward (toward the back side of the apparatus) too much, the patient T does not tend to slip off from the chair 4, thereby ensuring the safety of the patient T.

According to the above-described upper limb training apparatus 1, if the patient T operates the operation rod 15, the movable frame 12 acts according to the tilting of the operation rod 15. Then, the posture angle h of the movable frame 12 is calculated. Then, if the posture angle h of the movable frame 12 exceeds the largest posture angle H, the tilting resistance applying mechanism 13 suspends the action, and the operation rod 15 can not move into the tilting range beyond the largest posture angle H. In this example, if the patient T rapidly operates the operation rod 15 and the control by the moving range restriction program can not follow the operation, the movement of the operation rod 15 is eventually restricted by the tilting range restriction mechanism 20. Specifically, the operation rod 15 comes into contact with the stopper portion 24*d*, so that the operation rod 15 can not move further.

As described above, according to the upper limb training apparatus 1, when the patient T is operating the operation rod 15 by hand, the control section 110 controls the tilting range of the operation rod 15 while restricting the movable range of the movable frame 12. Accordingly, even if the patient T operates the operation rod 15 more than necessary, the operation rod 15 can not act out of the range within which the patient T can safely operate the operation rod 15. As described above, according to the upper limb training apparatus 1, since the movable range of the movable frame 12 is restricted by the control section 110, the patient T can safely train himself.

According to the upper limb training apparatus 1, since the tilting range of the operation rod 15 is structurally restricted by the stopper portion 24*d*, even if the patient T operates the operation rod 15 more than necessary, the operation rod 15 can not act out of the range within which the patient T can safely operate the operation rod 15. As described above, since the tilting range of the operation rod 15 is restricted by the stopper portion 24*d*, the patient T can safely train himself.

Particularly, according to the upper limb training apparatus 1, the stopper portion 24*d* determines the largest inclination of the operation rod 15 forward, as seen from the patient T. Accordingly, even if the patient T operates the operation rod 15 forward more than necessary, the patient T does not fall forward and can train himself safely.

Furthermore, according to the upper limb training apparatus 1, the straight portion of the stopper portion 24*d* is disposed closer to the floor surface than other portions of the stopper portion 24*d*, so that the largest inclination of the operation rod 15 forward is set small. Accordingly, even if the patient T operates the operation rod 15 forward (toward the back side of the apparatus) more than necessary, the operation rod 15 can not move forward (toward the back side of the apparatus) beyond the largest inclination, so that the patient T can safely train himself.

According to the upper limb training apparatu0s 1, the largest moving range of the end portion of the operation rod 15 is D-shaped in a plane view. Accordingly, if the straight portion of the D-shape is set to be a portion for restricting the forward movement of the operation rod 15 (toward the back side of the apparatus), forward movements of the operation rod 15 are equally restricted at the same position. Furthermore, the right and left and backward (toward the front side of the apparatus) movements of the operation rod 15 are restricted along the curve of the stopper portion 24*d*. As described above, since the largest moving range of the end portion of the operation rod 15 is determined, the patient T can safely and smoothly operate the operation rod 15.

According to the upper limb training apparatus 1, the tilting range of the operation rod 15 is restricted by the moving range restriction program, and is further restricted by the tilting range restriction mechanism 20. In other words, when the patient T operates the operation rod 15, first, the tilting range of the operation rod 15 is restricted by software based on the moving range restriction program, next, the tilting range of the operation rod 15 is restricted by the tilting range restriction mechanism structurally. Accordingly, if the patient T rapidly operates the operation rod 15, and the control by the moving range restriction program can not follow the operation, the tilting range restriction mechanism 20 will certainly restrict the movement of the operation rod 15.

Furthermore, according to the upper limb training apparatus 1, the largest moving range of the movable frame 12 forward (toward the back side of the apparatus) is also set for the operation rod 15 not to interfere with the monitor. Accordingly, even if the patient T operates the operation rod 15 more than necessary, it is unlikely that the hand of the patient T bumps into the monitor.

Figure 23:
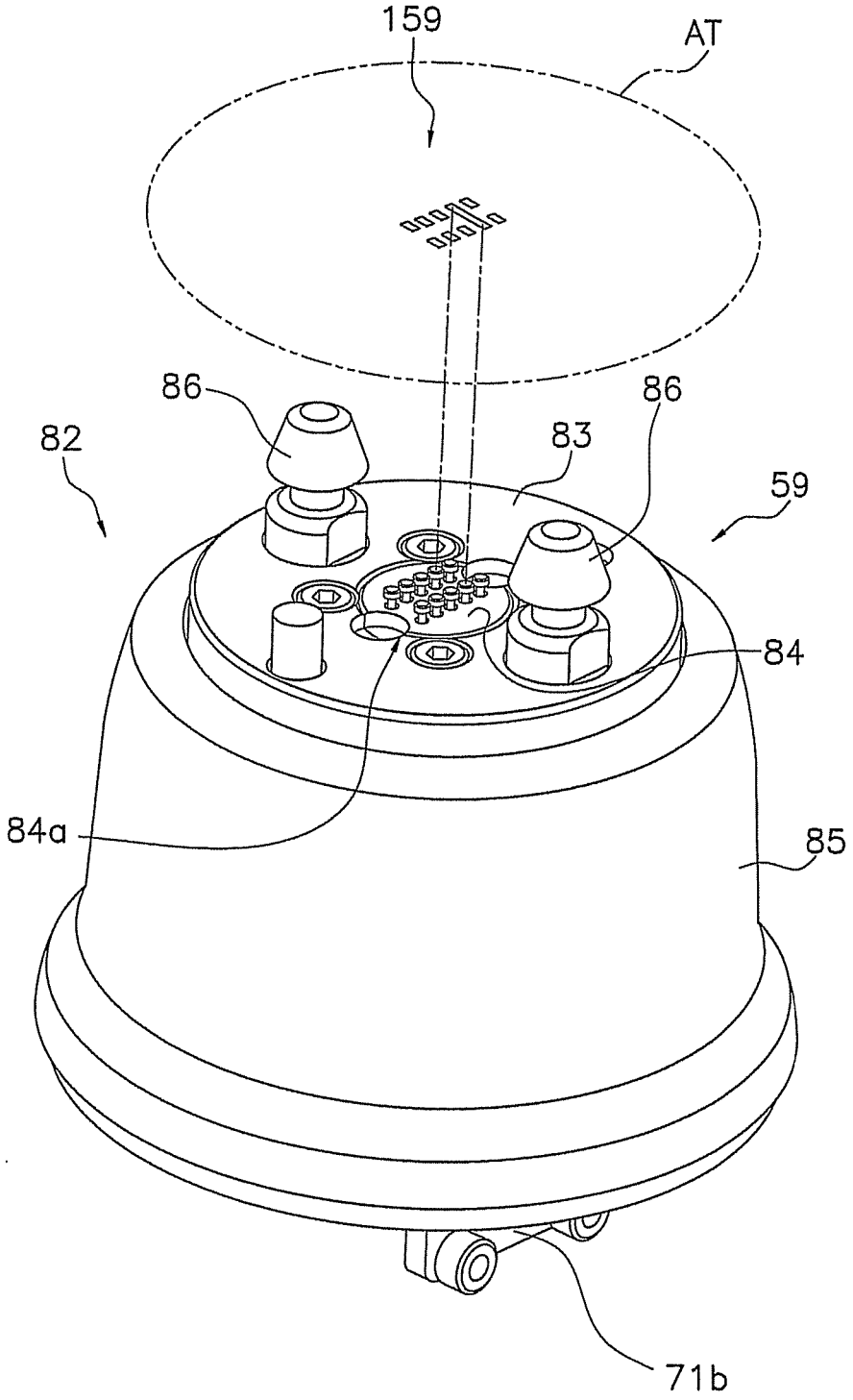
FIG. 23 is a perspective view of an attachment fixed portion.

In the upper limb training apparatus 1, various types of attachments AT are used, and each of the attachments AT has a plurality of contact terminals 159, as shown in FIG. 23. In FIG. 23, outline of the bottom surface of the attachment AT is illustrated by a chain double-dashed line, and a plurality of contact terminals 159 arranged on the bottom surface are illustrated by a solid line. The contact terminals 159 correspond to a plurality of pin terminals 84*a* (later described). In other words, the plurality of contact terminals 159 are provided in the attachment AT such that the contact terminals 159 and the pin terminals 84*a* corresponding to the contact terminals 159 can be in contact with each other.

In each of the plurality of attachments AT, certain two contact terminals 159 among the plurality of contact terminals 159 make a short circuit. The combination of the two contact terminals 159 making a short circuit in one attachment AT is different from that in another attachment AT among the plurality of attachments AT. In other words, among the plurality of attachments AT, the plurality of contact terminals 159 are provided in the attachments AT such that the patterns in which the two contact terminals 159 make a short circuit (short circuit pattern) are different.

As shown in FIG. 23, ten contact terminals 159 arranged in two lines, each line including a set of five contact terminals, are provided in the attachment AT. One contact terminal 159 in one line and one contact terminal 159 in the other line make a short circuit. The short circuit patterns are different from each other among the attachments AT. FIG. 23 shows a situation in which contact terminals 159 adjacent to the central contact terminals 159 in the respective lines make a short circuit.

The attachment fixed portion 59 is a portion to which the attachment AT is removably attached in accordance with the training program of the patient T, and is attached to the upper end portion of the movable stay 50. To the attachment fixed portion 59, the extension and contraction operation force detecting mechanism 17 is attached.

Figure 24:
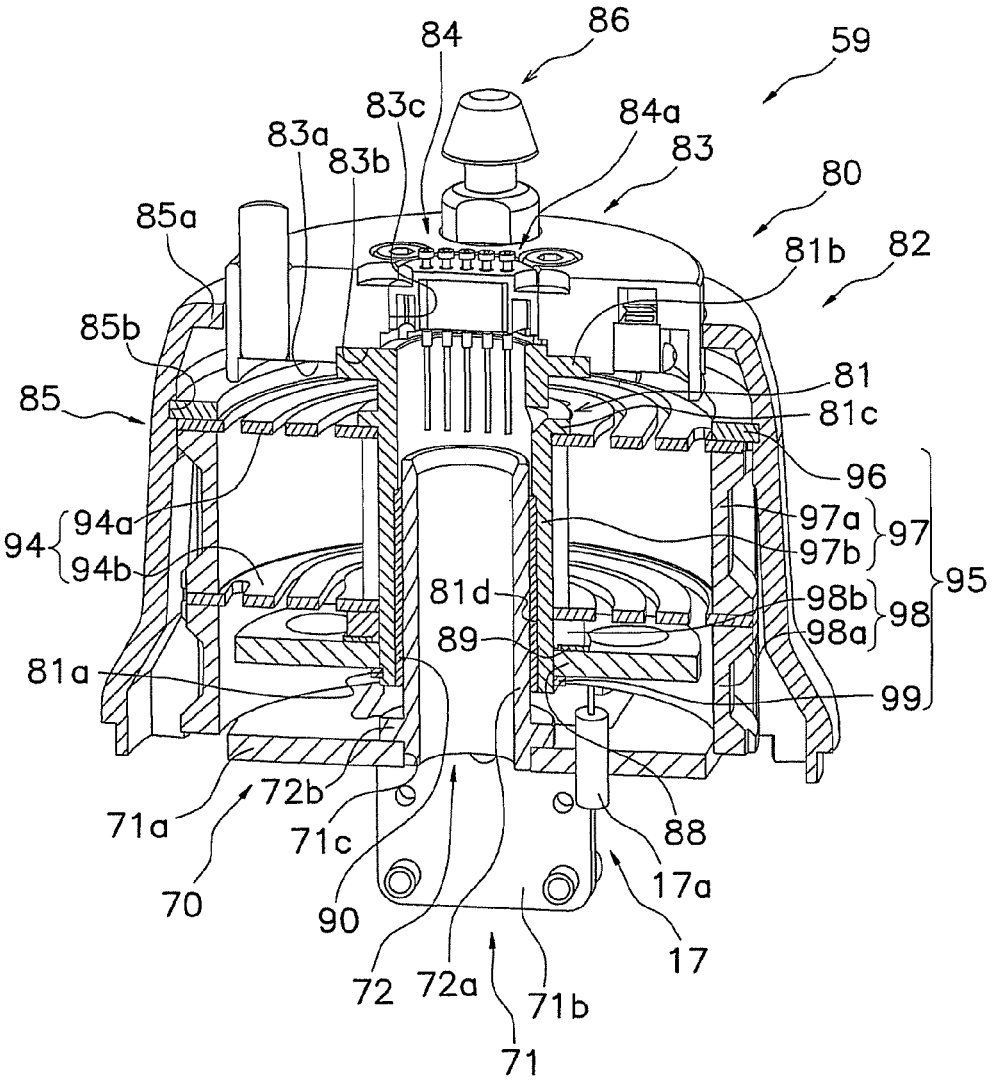
FIG. 24 is a cross sectional perspective view of the attachment fixed portion.

The attachment fixed portion 59 includes, as shown in FIG. 23 and FIG. 24, an attachment member 70 attached to the movable stay 50, an axial movement allowance member 80 attached to the attachment member 70 so as to be movable in the axial direction, a slide bearing 90 disposed between the attachment member 70 and the axial movement allowance member 80, an elastic member 94 (absorbing member) for absorbing force in directions other than the axial direction (off-axis force) against the movable stay 50, a plurality of positioning members 95 for positioning the elastic member 94, and a standard member 88 which serves as a standard when the extension and contraction operation force detecting mechanism 17 detects the operation force in the vertical Z direction applied to the operation rod 15.

The attachment member 70 includes a stay attached portion 71 attached to the movable stay 50, and a shaft portion 72 provided in the stay attached portion 71. The stay attached portion 71 includes a circular disc portion 71*a*, and a pair of rectangular plate portions 71*b* (only one of them is shown in FIG. 23 and FIG. 24) integrally formed so as to project downward out of the plane of the disc portion 71*a*. The disc portion 71*a* is formed with a through hole 71*c* in the central portion. The pair of rectangular plate portions 71*b* are opposite to each other. Each of the rectangular plate portions 71*b* is formed with a plurality of bolt holes, e.g., four bolt holes, and the movable stay 50 is also formed with bolt holes corresponding to the bolt holes of the rectangular plate portion 71*b*. The attachment member 70 is attached to the movable stay 50 by inserting the bolt members into bolt holes of the rectangular plate portions 71*b* and the bolt holes of the movable stay 50, and by threading the nut members with the bolt members.

The shaft portion 72 includes a cylindrical shaft main body 72*a*, and a flange portion 72*b* for the shaft portion integrally formed on the outer circumference on the lower end of the shaft main body 72*a*. A lower end of the shaft main body 72*a* is fitted into the through hole 71*c* of the stay attached portion 71, and the flange portion 72*b* for the shaft portion gets into contact with the disc portion 71*a* of the stay attached portion 71, so that the shaft portion 72 is attached in the attachment member 70.

The axial movement allowance member 80 includes a cylindrical portion 81 slidably attached to the shaft portion 72, and an exterior portion 82 covering the cylindrical portion 81. The cylindrical portion 81 includes an annular groove portion 81*a* formed near the lower end, a first flange portion 81*b* for the cylindrical portion formed near the upper end, a second flange portion 81*c* for the cylindrical portion formed near one end away from the first flange portion 81*b* for the cylindrical portion with a predetermined gap therebetween, and a step portion 81*d* formed on the inner circumferential surface.

The exterior portion 82 includes an exterior portion main body 83, a terminal attachment member 84 to which terminals 84*a* are attached for identifying types of the attachment AT, a cover member 85, and a plurality of pin members 86 for attaching the attachment AT. The exterior portion main body 83 is formed into a circle in a plane view. The exterior portion main body 83 includes a concave circular first step portion 83*a*, a concave second step portion 83*b* having a smaller diameter than that of the first step portion 83*a* at the center of the bottom of the first step portion 83*a*, and a through hole 83*c* formed at the center of the bottom of the second step portion 83*b*. The first flange portion 81*b* of the axial movement allowance member 80 is engaged with the second step portion 83*b*. More specifically, the outer circumferential surface of the first flange portion 81*b* of the axial movement allowance member 80 fits into a wall of the second step portion 83*b*, and a surface near the end portion of the first flange portion 81*b* of the axial movement allowance member 80 is in contact with the bottom of the second step portion 83*b*.

The terminal attachment member 84 is formed into a circle in a plane view. To the terminal attachment member 84, a plurality of pin terminals 84*a*, e.g., ten pin terminals are mounted with their contact portions exposed upward. In this example, cords extending from the plurality of pin terminals 84*a* pass through the inside of the terminal attachment member 84 and extend below the terminal attachment member 84. In FIG. 24, only parts of the cords are shown. The terminal attachment member 84 is attached into the through hole 83*c* of the exterior portion main body 83. More specifically, the terminal attachment member 84 fits into the through hole 83*c* of the exterior portion main body 83, such that a surface of the terminal attachment member 84 opposite of the surface on which the pin terminals 84*a* are exposed is opposed to an end portion of the axial movement allowance member 80 at which the first flange portion 81*b* is formed.

The cover member 85 is formed into a cylinder having a diameter larger than that of the exterior portion main body 83. On a portion near the opening of the upper portion of the cover member 85, an annular flange portion 85*a* is integrally formed. By fitting the inner circumferential surface of the annular flange portion 85*a* onto the outer circumferential surface of the exterior portion main body 83, the cover member 85 is attached to the exterior portion main body 83. On the inner circumferential surface of the cover member 85, an annular groove portion 85*b* is formed to which the positioning member 95 is attached. The plurality of pin members 86 are fitted into the attachment holes to dent in the bottom surface of the attachment AT. Accordingly, the attachment AT is attached to the exterior portion 82, i.e., the attachment fixed portion 59. The plurality of pin members 86, e.g., two pin members, are attached to the exterior portion main body 83.

The slide bearing 90 allows the axial movement allowance member 80 to slide relative to the attachment member 70. The slide bearing 90 is disposed between the shaft portion 72 of the attachment member 70 and the cylindrical portion 81 of the axial movement allowance member 80. More specifically, the slide bearing 90 is formed into a cylinder, and is fitted into the step portion 81*d* formed in the inner circumferential surface of the cylindrical portion 81 of the axial movement allowance member 80. In this state, the inner circumferential surface of the slide bearing 90 is slidably attached to the outer circumferential surface of the shaft portion 72 of the attachment member 70, so that the axial movement allowance member 80 can move in the axial direction (vertically) relative to the attachment member 70. The slide bearing 90 is a bush made of resin.

The plurality of positioning members 95 allow the elastic member 94 to be positioned. The plurality of positioning members 95 are composed of first through fourth positioning members 96, 97, 98, and 99. The first positioning member 96 is an annular plate member, and is fixed to the annular groove portion 85*b* of the cover member 85.

A pair of second positioning members 97 (97*a*, 97*b*) are disposed between the plurality of elastic members 94 (later described). For example, one of the second positioning members 97*a* is cylindrical. This second positioning member 97*a* is attached to the inner circumferential surface of the cover member 85. More specifically, a concave portion formed in the second positioning member 97*a* is fitted into a convex portion (not shown) defined in the inner circumferential surface of the cover: member 85, thereby attaching the second positioning member 97*a* to the inner circumferential surface of the cover member 85. The other second positioning member 97*b* is cylindrical. The cylinder diameter of the other second positioning member 97*b* is smaller than the cylinder diameter of the second positioning member 97*a*. The second positioning member 97*b* is attached to the outer circumferential surface of the cylindrical portion 81 of the axial movement allowance member 80.

Hereinafter, the second positioning member 97*a* disposed near the cover member 85 is called a radially outer second positioning member, and the second positioning member 97*b* disposed near the cylindrical portion 81 of the axial movement allowance member 80 is called a radially inner second positioning member.

A pair of third positioning members 98 (98*a*, 98*b*) are arranged near the lower end of the cylindrical portion 81, e.g., between the elastic member 94 (94*b*) near the annular groove portion 81*a* of the cylindrical portion 81 and the stay attached portion 71 of the attachment member 70. For example, one of the third positioning members 98*a* is cylindrical. This third positioning member 98*a* is attached to the inner circumferential surface of the cover member 85. More specifically, by engaging a concave portion formed in the one of the third positioning members 98*a* with a convex portion (not shown) formed in the inner circumferential surface of the cover member 85, the one of the third positioning members 98*a* is mounted to the inner circumferential surface of the cover member 85.

The other of the third positioning members 98*b* is formed into an annular shape. The annular diameter of the other of the third positioning members 98*b* is smaller than the cylinder diameter of the one of the third positioning members 98*a*. The other of the third positioning members 98*b* is attached to the outer circumferential surface of the cylindrical portion 81 of the axial movement allowance member 80. Specifically, the other of the third positioning members 98*b* is attached to the outer circumferential surface of the cylindrical portion 81 of the axial movement allowance member 80, between the elastic member 94 (94*b*) located near the annular groove portion 81*a* (near the lower end) of the cylindrical portion 81 and the standard member 88.

Hereinafter, the third positioning member 98*a* disposed near the cover member 85 is called a radially outer third positioning member, and the third positioning member 98*b*disposed near the cylindrical portion 81 of the axial movement allowance member 80 is called a radially inner third positioning member.

The fourth positioning member 99 is mounted to a lower end of the cylindrical portion 81. For example, the fourth positioning member 99 is annular, and is mounted to an outer circumferential surface of the cylindrical portion 81. More specifically, the fourth positioning member 99 is, for example, a C-type retaining ring, and is fitted into the annular groove portion 81*a* of the cylindrical portion 81.

The standard member 88 is used as a standard when the extension and contraction operation force detecting mechanism 17 detects the operation force in the vertical Z direction applied to the operation rod 15. An axial displacement detecting section 17*a* (later described) of the extension and contraction operation force detecting mechanism 17 is in contact with the standard member 88. The standard member 88 is annular. Between the radially inner third positioning member 98*b* and the fourth positioning member 99, by inserting the cylindrical portion 81 of the axial movement allowance member 80 into a through hole formed in the central portion of the standard member 88, the standard member 88 is mounted to the outer circumferential surface of the cylindrical portion 81 of the axial movement allowance member 80. Between the standard member 88 and the radially inner third positioning member 98*b*, an adjustment member 89 is mounted. The adjustment member 89 prevents the standard member 88 from rattling.

The elastic member 94 absorbs forces in directions other than the axial direction (off-axis force) against the movable stay 50. The elastic member 94 is composed of a plurality of elastic members, and the plurality of elastic members 94 are disposed between the cylindrical portion 81 and the exterior portion 82, having a predetermined gap between each other in the axial direction. The elastic member 94 is a convolution spring, e.g., a plate-like convolution spring. The plurality of elastic members 94 are composed of two plate-like convolution springs 94*a*, 94*b*. In this example, since the two plate-like convolution springs 94*a*, 94*b* are disposed with a gap therebetween in the axial direction, the plate-like convolution springs 94*a*, 94*b* can certainly absorb the force applied in a direction crossing the axial direction or the force when the moment is generated, for example.

The two plate-like convolution springs 94*a*, 94*b* have an identical shape, with the two sides being reversed, and are disposed between the cylindrical portion 81 and the exterior portion 82 with a predetermined gap therebetween in the axial direction. The two plate-like convolution springs 94*a*, 94*b* are disposed between the cylindrical portion 81 and the exterior portion 82 via the positioning members 95.

More specifically, one of the plate-like convolution springs 94*a* (upper one) has its outer circumferential edge pinched between the radially outer second positioning member 97*a* and the first positioning member 96. This plate-like convolution spring 94*a* has its inner circumferential edge pinched between the radially inner second positioning member 97*b* and the second flange portion 81*c* of the axial movement allowance member 80. The other plate-like convolution spring 94*b* (lower one) has its outer circumferential edge pinched between the radially outer second positioning member 97*a* and the radially outer third positioning member 98*a*. The other plate-like convolution spring 94*b* has its inner circumferential edge pinched between the radially inner second positioning member 97*b* and the radially inner third positioning member 98*b*.

As described above, the outer circumferential portions of the two plate-like convolution springs 94*a*, 94*b* are positioned by the radially outer second positioning member 97*a* and the radially outer third positioning member 98*a*. The inner circumferential portion of the two plate-like convolution springs 94*a*, 94*b* are positioned by the radially inner second positioning member 97*b* and the radially inner third positioning member 98*b*. The inner circumferential portions of the two plate-like convolution springs 94*a*, 94*b* are restricted from moving in the axial direction by the fourth positioning member 99 via the adjustment member 89 and the standard member 88.

The control section 110 includes a signal receiving section 184 that identifies intrinsic signals to the attachment AT, while the attachment AT is mounted to the attachment fixed portion 59. The signal receiving section 184 identifies, for example, a conducting pattern (later described).

As described above, the attachment fixed portion 59 further includes a plurality of pin terminals 84*a*, and the pin terminals 84*a* correspond to the above-described plurality of contact terminals 159. In other words, the plurality of pin terminals 84*a* are provided in the attachment fixed portion 59 such that the pin terminals 84*a* and the contact terminals 159 corresponding to the pin terminals 84*a* can get into contact with each other. Specifically, the plurality of pin terminals 84*a*, e.g., ten pin terminals are mounted to the terminal attachment member 84 such that they project from the top surface of the terminal attachment member 84 outward. In this example, as shown in FIG. 23 and FIG. 24, two lines, each including five pin terminals 84*a*, i.e. ten pin terminals 84*a*, are provided in the terminal attachment member 84. In this case, when the attachment AT is mounted to the attachment fixed portion 59, the ten pin terminals 84*a* get into contact with the above-described ten contact terminals 159.

As described above, when the attachment AT is attached to the attachment fixed portion 59, the certain two contact terminals 159 make a short circuit in the attachment AT. Therefore, two pin terminals 84*a* getting into contact with these two contact terminals 159 are electrically connected. As shown in FIG. 23, the two contact terminals 159 making a short circuit and the pin terminals 84*a* contacting the two contact terminals 159 are connected with chain lines. In this case, the signal intrinsic to the attachment AT which corresponds to the conductive pattern is identified by the signal receiving section 184. Then, the control section 110 determines the type of the attachment AT based on the signal. Then, the control section 110, in accordance with the type of the attachment AT determined based on the signal , starts the upper limb training program, and controls the upper limb training apparatus in accordance with the upper limb training program.

As described above, according to the upper limb training apparatus 1, when the attachment AT is mounted to the attachment fixed portion 59, the intrinsic signal of the attachment AT is identified by the signal receiving section 184 of the attachment fixed portion 59. This signal makes it possible to identify the attachment AT attached to the attachment fixed portion 59. As long as it is possible to identify the attachment AT attached to the attachment fixed portion 59, the control section 110 can automatically select an upper limb training program corresponding to the attachment AT. As described above, according to the upper limb training apparatus 1, it is possible to automatically select the upper limb training program corresponding to the attachment AT. Accordingly, as long as a doctor and an occupational therapist attach the attachment AT to the attachment fixed portion 59, the upper limb training apparatus 1 can automatically perform the training program corresponding to the attachment AT. Accordingly, the patient can perform an appropriate upper limb training using the attachment AT selected by the doctor and the occupational therapist.

Furthermore, according to the upper limb training apparatus 1, the control section 110 extracts several upper limb training programs for user's selection corresponding to the type of the attachment AT, or automatically starts one upper limb twining program, in order to control the upper limb training apparatus 1. Accordingly, the doctor or occupational therapist can perform the training program corresponding to the attachment AT without errors just by attaching the attachment AT to the attachment fixed portion 59. Accordingly, the patient can perform the appropriate upper limb twining employing the attachment AT selected by the doctor and the occupational therapist.

Figure 15:
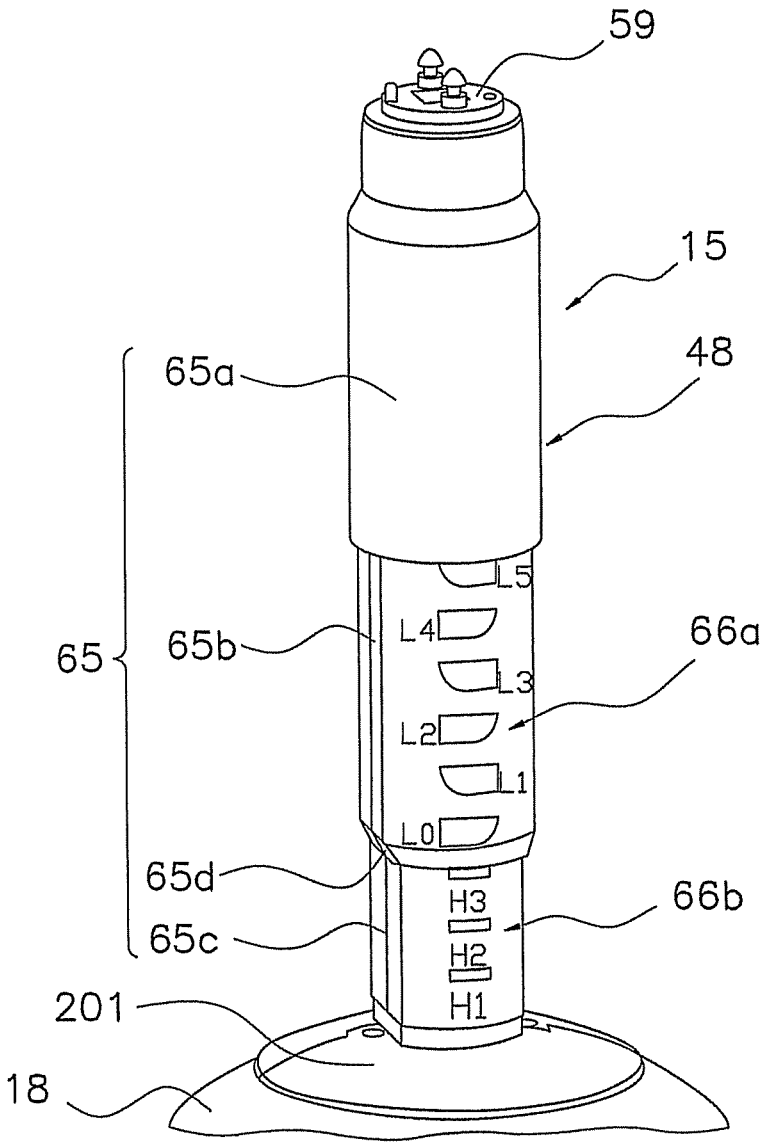
FIG. 15 is a perspective view of the extended operation rod with a rod cover.
Figure 16:
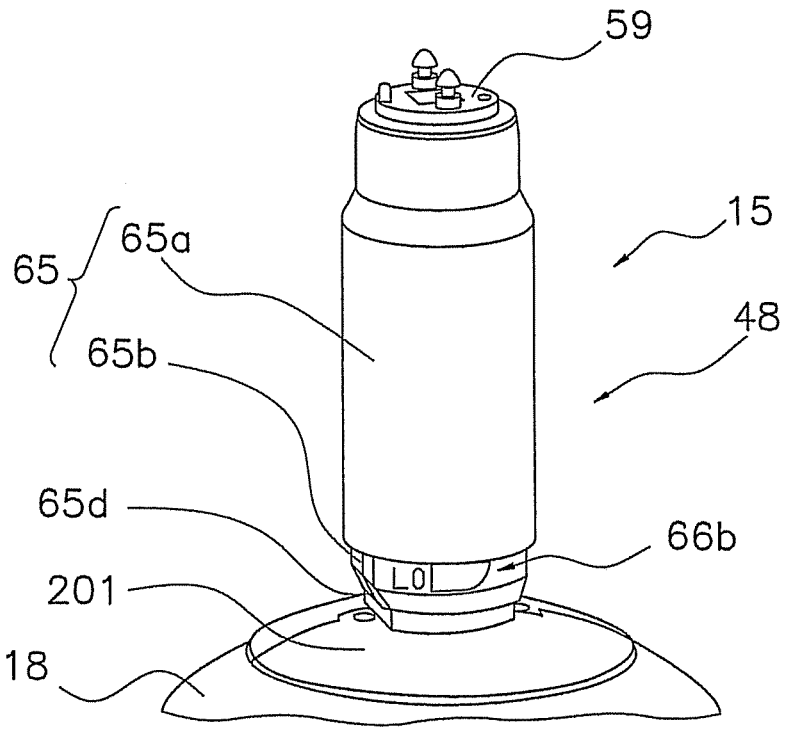
FIG. 16 is a perspective view the contracted operation rod with a rod cover.
Figure 17:
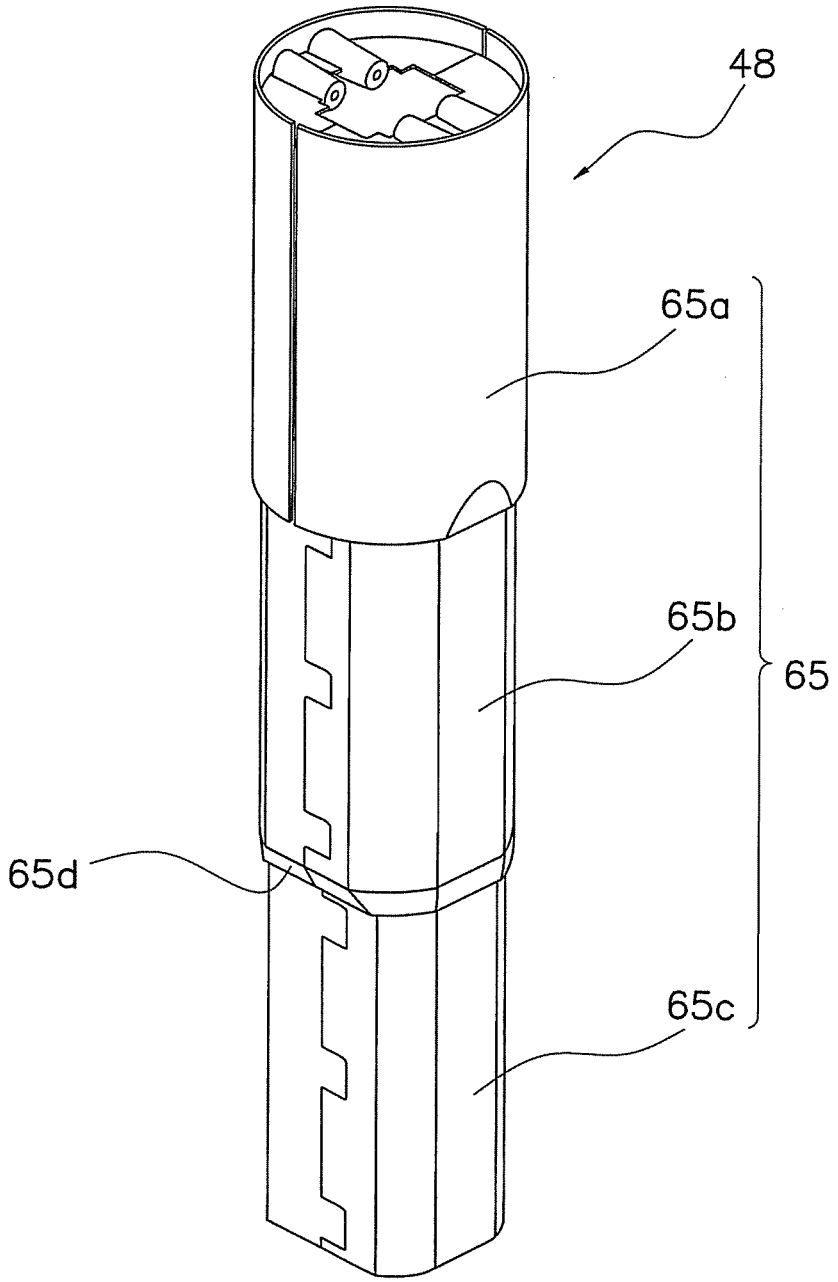
FIG. 17 is a perspective view of the extended rod cover.

The rod cover 48 includes, as shown in FIG. 15, FIG. 16 and FIG. 17, a cover structure 65 composed of a plurality of (three, for example) cover elements which cover the extension and contraction mechanism 47 and are fitted into each other in a nesting structure that extends and contracts together with the extension and contraction mechanism 47. Specifically, in this embodiment, the cover elements include an upper cover element 65*a*, a middle cover element 65*b* fitted into the inner side of the upper cover element 65*a*, and a lower cover element 65*c* fitted into the inner surface of the middle cover element 65*b*.

The upper cover element 65*a* is a cover element having the largest diameter fixed to an upper end of the movable stay 50. The middle cover element 65*b* is a cover element having a middle diameter that extends and contracts together with the upper cover element 65*a*. The lower cover element 65*c* is a cover element having the smallest diameter that fits in the inside of the middle cover element 65*b*. On an outer circumferential surface of the middle cover element 65*b*, which is fitted with the lower cover element 65*c*, a taper surface 65*d* is formed having a thickness increasing from the lower end edge upward. Accordingly, even if the operation rod 15 is disposed at the lower end position, and, as shown in FIG. 16, the upper cover element 65*a*, the middle cover element 65*b* and the lower cover element 65*c* are overlapped with each other, it is unlikely that fingers of the patient T are pinched between the lower end of the middle cover element 65*b* and a first moving cover 201 of the exterior cover 18. The lower cover element 65*c* is fixed to the fixed stay 49.

The upper cover element 65*a*, the middle cover element 65*b*, and the lower cover element 65*c* have a structure, as shown in FIG. 17, FIG. 18, FIG. 19, and FIG. 20, which can be dual-partitioned vertically. The dual-partitioned upper cover element 65*a* is connected to the movable stay 50 by screws. The dual-partitioned middle cover element 65*b* is elastically connected to the upper cover element 65*a* in a hanging state. The dual-partitioned lower cover element 65*c* is elastically connected to the fixed stay 49. An outer circumferential surface of the upper end of the middle cover element 65*b* is engaged with an inner circumferential surface of the lower end of the upper cover element 65*a*. Accordingly, when the operation rod 15 extends, the lower end of the upper cover element 65*a* ascends to a vicinity of the upper end of the middle cover element 65*b*, and the middle cover element 65*b* ascends together with the upper cover element 65*a*. When the operation rod 15 contracts, if the middle cover element 65*b* reaches a descending end, only the upper cover element 65*a* descends.

As shown in FIG. 15 and FIG. 16, on the outer circumferential surfaces of the lower cover element 65*c* and the middle cover element 65*b*, a first scale 66*a* and a second scale 66*b* are labeled for indicating the extension length of the operation rod 15. For example, on the lower cover element 65*c*, the first scale 66*a* "H1, H2, H3 . . . " is written, and on the middle cover element 65*b*, the second scale 66*b* "L0, L1, L2, L3 . . . " is written. By using the first scale 66*a* and the second scale 66*b*, it becomes easy to grasp the extension and contraction amount of the operation rod 15, and it becomes easy to set the training height of the upper limb according to the frame, the training condition, and etc. of the patient T.

Figure 18:
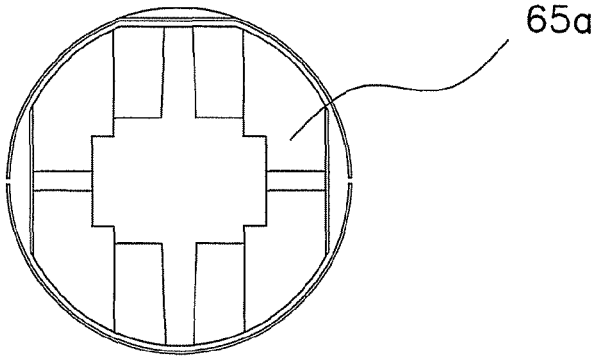
FIG. 18 is a plane view of an upper cover element.
Figure 19:
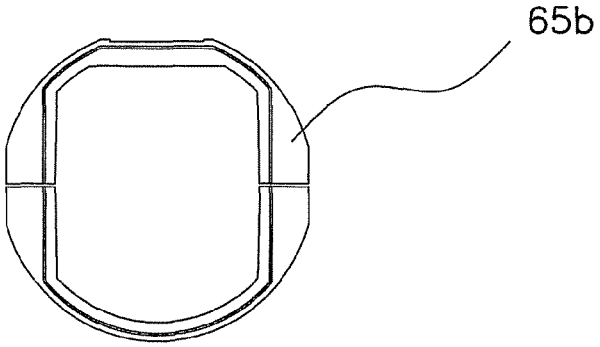
FIG. 19 is a plane view of a middle cover element.
Figure 20:
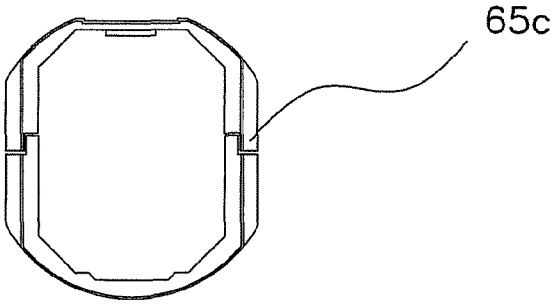
FIG. 20 is a plane view of a lower cover element.

As shown in FIG. 18, the upper cover element 65*a* is circular in cross section. However, the middle cover element 65*b* shown in FIG. 19 and the lower cover element 65*c* shown in FIG. 20 are non-circular (oval) in cross section, being shaped like a circle whose upper side, right side, and left side are cut off linearly. Particularly, the lower cover element 65*c* has a shape in which the right side and the left side are cut off to a larger extent than the middle cover element 65*b*. Accordingly, it becomes easy to realize whirl stopping and retaining between the middle cover element 65*b* and the lower cover element 65*c*.

(2-6) Extension and Contraction Resistance Applying Mechanism

As shown in FIG. 14, the extension and contraction resistance applying mechanism 16 includes the Z-axis motor 61 (described before). The extension and contraction resistance applying mechanism 16 applies resistance to the extension and contraction operation of the operation rod 15, or assists or forces the extension and contraction operation of the operation rod 15, by driving the Z-axis motor 61 based on the extension and contraction operation force detected by the extension and contraction operation force detecting mechanism 17. The extension and contraction resistance applying mechanism 16 also serves as an extension and contraction driving section that extends and contracts the operation rod 15 in order to adjust the training height. The Z-axis motor 61 of the extension and contraction resistance applying mechanism 16 is arranged below the axially supporting position of the movable frame 12, i.e., below a plane containing the turning axis X1 and the turning axis Y1 of the first gimbal mechanism 30 (at a position close to the floor surface FL). In other words, since the turning axis X2 and the turning axis Y2 of the second gimbal mechanism 40 are at the same position in the vertical Z direction in the extension and contraction driving section, the Z-axis motor 61 is positioned closer to the floor surface FL than the tilting fulcrum position of the operation rod 15. As shown in FIG. 11, a Z-axis rotary encoder 63 is provided in the Z-axis motor 61 for detecting positions in the Z-axis direction.

According to the upper limb training apparatus 1, the patient T uses the upper limb to tilt the operation rod 15, for example, via the attachment AT. Accordingly, the operation rod 15 is tilted while the tilting resistance applying mechanism 13 applies the resistance or assists or forcibly moves the operation rod 15. Accordingly, the upper limb of the patient T can be trained. Since the Z axis motor 61, which drives the operation rod 15 for extension and contraction and has a relatively heavy mass, is positioned closer to the floor surface FL than the first tilting center C1 around which the movable frame 12 tilts, i.e., below the first tilting center C1, the center of gravity of the upper limb training apparatus 1 becomes lower. Accordingly, even if the footprint of the training apparatus main body 3 is small, it is unlikely that the upper limb training apparatus 1 topples over. Since the center of moment generated by the tilting of the operation rod 15 can be closer to the first tilting center C1, it is possible to reduce the mechanical load.

The operation rod 15 is supported by the movable frame 12 such that the operation rod 15 can tilt in all directions from the second tilting center C2, and the extension and contraction resistance applying mechanism 16 is positioned closer to the floor surface FL than the second tilting center C2. Accordingly, it is more unlikely that the upper limb training apparatus 1 topples over.

In addition, since the first tilting center C1 and the second tilting center C2 are positioned at the same position, the height of the upper limb training apparatus 1 can be reduced in the vertical direction.

In addition, the output shaft 61*a* of the Z axis motor 61 extends along the extension and contraction direction of the operation rod 15, and the ball screw shaft 55 of the operation rod 15 is coaxially connected to the output shaft 61*a* via the coupling 62, so that the ball screw shaft 55 can rotate integrally with the output shaft 61*a*. Accordingly, the heavy load containing the Z axis motor 61 can be disposed only directly below the operation rod 15, so that planar dimension of the upper limb training apparatus 1 can be reduced.

(2-7) Extension and Contraction Operation Force Detecting Mechanism

As shown in FIG. 11, the extension and contraction operation force detecting mechanism 17 includes an axial displacement detecting section 17*a*. The axial displacement detecting section 17*a* detects position of the axial movement allowance member 80 in the axial direction relative to the attachment member 70. The axial displacement detecting section 17*a* is positioned inside the operation rod 15, and is in contact with the standard member 88 of the attachment member 70.

The axial displacement detecting section 17*a* includes a linear potentiometer. In this example, a sensor head 17*b* of the linear potentiometer is urged by a spring, and is always in contact with a bottom surface of the standard member 88 fixed to the axial movement allowance member 80. More specifically, the sensor head 17*b* of the linear potentiometer 17*a* is set on the bottom surface of the standard member 88, while contracted by a certain amount against the spring force of the coil spring disposed around the outer circumference of the sensor head 17*b*. The position of the sensor head 17*b* in this state is set to be at an initial position of the sensor head 17*b*.

Using the initial position as the standard, if the axial movement allowance member 80 moves in the axial direction relative to the attachment member 70, the sensor head 17*b* extends and contracts in the axial direction following this movement in the axial direction. Then, the linear potentiometer 17*a* outputs a voltage value in accordance with the travel distance of the sensor head 17*b* in response to an inputted standard voltage value. Based on the voltage value, a process section (not shown), e.g. a CPU, calculates the travel distance of the sensor head 17*b* relative to the initial position. As a result, the axial displacement detecting section 17*a* detects the displacement of the operation rod 15 in the axial direction. The displacement of the operation rod 15 in the axial direction is a positive value or negative value with the initial position being the standard.

Next, based on the displacement in the axial direction of the axial movement allowance member 80, the operation force in the axial direction applied to the operation rod 15 is calculated. For example, a process section (not shown), e.g. a CPU, calculates the operation force in the axial direction applied to the operation rod 15 based on a corresponding table that includes the axial displacements of the axial movement allowance member 80 and the axial forces corresponding to the axial displacements. The corresponding table is set based on rigidity of the plurality of elastic members 94, e.g., the rigidity in the out-of-plane direction of the two plate-like convolution springs 94*a*, 94*b*.

According to the above-described upper limb training apparatus 1, the patient T puts his hand or arm on the attachment AT or grabs the attachment AT, then he operates the operation rod 15 in the axial direction. Then, the attachment fixed portion 59 to which the attachment AT is attached moves in the operation direction (vertical direction). In detail , when the patient T operates the operation rod 15 in the axial direction, components of the force in directions other than the axial direction occur in the operation rod 15, and these components are absorbed by the elastic member 94. Then, the axial force occurred in the operation rod 15 allows the axial movement allowance member 80 to move in the axial direction relative to the attachment member 70 via the slide bearing 90. At this time, the standard member 88, which is fixed to the axial movement allowance member 80, moves in the axial direction simultaneously, and the sensor head abutting against the standard member 88 extends or contracts. Then, in the extension and contraction operation force detecting mechanism 17, an axial force corresponding to the extension and contraction amount of the sensor head, i.e., the operation force in the axial direction applied to the operation rod 15 is detected.

As described above, according to the upper limb training apparatus 1, the two plate-like convolution springs 94*a*, 94*b* absorb the forces in directions other than the axial direction applied to the operation rod 15. In this state, the axial displacement detecting section 17*a* detects the displacement in the axial direction corresponding to the axial force applied to the operation rod 15. As described above, according to the upper limb training apparatus 1, the axial displacement detecting section 17*a* can detect the displacement in the axial direction while the two plate-like convolution springs 94*a*, 94*b* absorb the forces in directions other than the axial direction applied to the operation rod 15. Accordingly, it is possible to accurately acquire the force applied to the operation rod 15 only in the axial direction.

Since the axial displacement detecting section 17*a* is arranged inside the operation rod 15, unnecessary external force, e.g. an impulse, is not directly applied to the axial displacement detecting section 17*a*. Accordingly, it is possible to more accurately measure just the displacement (displacement in the axial direction) of the measuring object by the axial displacement detecting section 17*a*.

Since the axial displacement detecting section 17*a* is, for example, a linear potentiometer, it is possible to more accurately detect a position of the axial movement allowance member 80 in the axial direction relative to the attachment member 70, by abutting the sensor head 17*b* of the linear potentiometer 17*a* against the axial movement allowance member 80.

In addition, according to the upper limb training apparatus 1, since the two plate-like convolution springs 94*a*, 94*b* are disposed with a predetermined gap therebetween in the axial direction between the cylindrical portion 81 of the axial movement allowance member 80 and the exterior portion 82 of the axial movement allowance member 80, it is possible to certainly absorb the force directly applied to the operation rod 15 in directions other than the axial direction, and absorb the force in directions other than the axial direction when the moment is generated, for example.

Furthermore, according to the upper limb training apparatus 1, since the elastic member 94 for absorbing the forces in directions other than the axial direction applied to the operation rod 15 is the convolution springs 94*a*, 94*b*, it is possible to reduce the direction dependence when absorbing the forces. Particularly, in this example, as the convolution springs 94*a*, 94*b*, for example, the plate-like convolution springs are employed. Since the plate-like convolution springs 94*a*, 94*b*can be formed by cutting out metallic thin plates, it is easy to produce the peripheral portion and the central portion of the plate-like convolution springs, and it is possible to produce them precisely. Accordingly, the direction dependence of the convolution springs 94*a*, 94*b* themselves can be reduced.

Furthermore, according to the upper limb training apparatus 1, since the two sides of the two plate-like convolution springs 94*a*, 94*b* are reversed relative to each other and the two plate-like convolution springs 94*a*, 94*b* are disposed with the predetermined gap therebetween in the axial direction, it is possible to reduce the direction dependence in the axial direction too.

Furthermore, according to the upper limb training apparatus 1, since the slide bearing 90 is disposed between the shaft portion 72 of the attachment member 70 and the cylindrical portion 81 of the axial movement allowance member 80, the axial movement allowance member 80 can smoothly move in the axial direction relative to the attachment member 70. Accordingly, it is possible to more precisely measure the displacement of the axial movement allowance member 80 relative to the attachment member 70. Since the material of the slide bearing is resin, even if the shape of the slide bearing 90 is a bush, it is possible to easily mold the slide bearing 90 of a predetermined size.

(2-8) Exterior Cover

The exterior cover 18 is a cover structure that covers from the above the interior mechanism such as the first gimbal mechanism 30 and the second gimbal mechanism 40 in order not to expose them outside. The exterior cover 18 is, as shown in FIG. 1 to FIG. 4, mounted to an upper portion of a main body cover 200 covering the circumference of the lower portion of the training apparatus main body 3, and covers the interior of training apparatus main body 3 together with the main body cover 200. As described above, since the exterior cover 18 covers the f irst gimbal mechanism 30 and the second gimbal mechanism 40, dust or foreign substances are prevented from adhering to the first gimbal mechanism 30 and the second gimbal mechanism 40. A person is prevented from erroneously touching the first gimbal mechanism 30 and the second gimbal mechanism 40.

The exterior cover 18 includes a first moving cover 201, a second moving cover 202, a first driven cover 203, a second driven cover 204, and a fixed cover 205. These covers are dome-like members made of synthetic resin, and are disposed to be overlapped with each other in the above-described order. The dome-like shape is a shape of a part of a sphere, wherein an opening edge having a small diameter is positioned at an upper position, an opening edge having a large diameter is positioned at a lower position, and a wall is smoothly curved from the opening edge having a small diameter toward the opening edge having a large diameter. Each of the covers can move relative to each other in a direction along the dome-like shape of the covers. Considering the covers disposed adjacent with each other, the outer diameter of the upper cover is larger than the inner diameter of the lower cover. Accordingly, the opening edge portion having a large diameter of the upper cover is overlapped over the opening edge portion having a small diameter of the lower cover.

Figure 21:
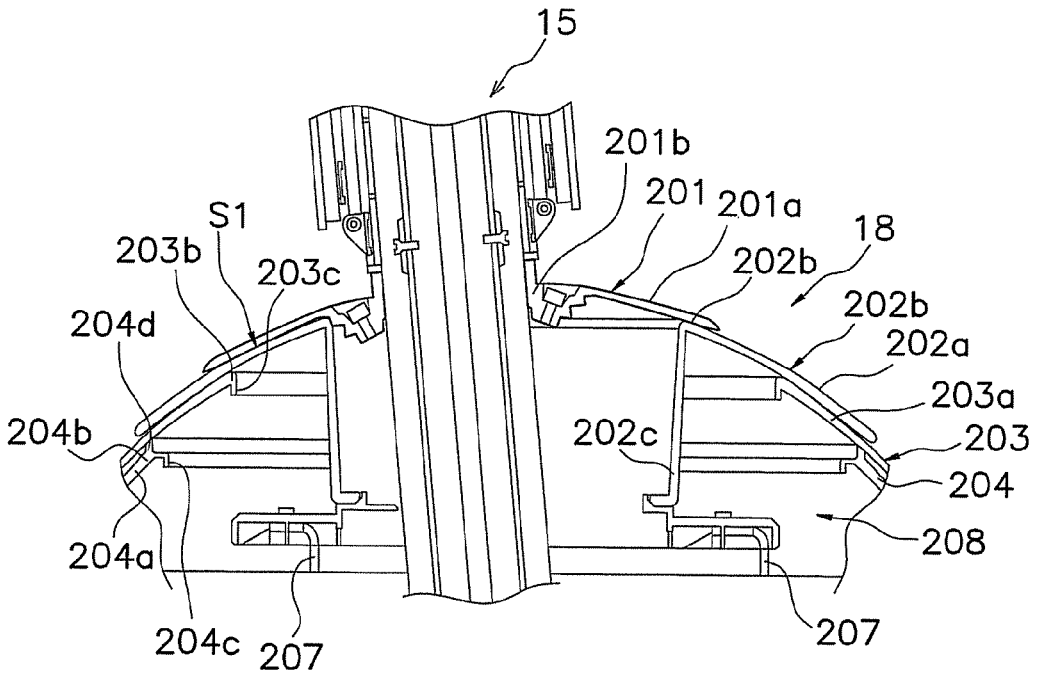
FIG. 21 is a partial cross section of an exterior frame.

The first moving cover 201 is mainly composed of a dome-like portion 201*a*. The first moving cover 201 is fixed to the operation rod 15 such that the first moving cover 201 moves together with the operation rod 15. Specifically, in the first moving cover 201, as shown in FIG. 21, the opening edge 201*b* having a small diameter is fixed to the outer circumferential surface of the operation rod 15. The first moving cover 201 is composed of two half-split members.

The second moving cover 202 is mainly composed of a dome-like portion 202*a*. The second moving cover 202 is fixed to the movable frame 12 such that the second moving cover 202 moves together with the movable frame 12, and can relatively move between the first moving cover 201 and the fixed cover 205.

The second moving cover 202 is fixed to the second moving portion 32 of the movable frame 12. More specifically, as shown in FIG. 5 to FIG. 9, the second moving portion 32 is formed with a connecting frame 207 extending upward, and the second moving cover 202 is connected to an upper end of the connecting frame 207. Specifically, as shown in FIG. 21, a cylindrical portion 202*c* extends downward from the opening edge 202*b* having a small diameter of the second moving cover 202, and the cylindrical portion

Figure 22:
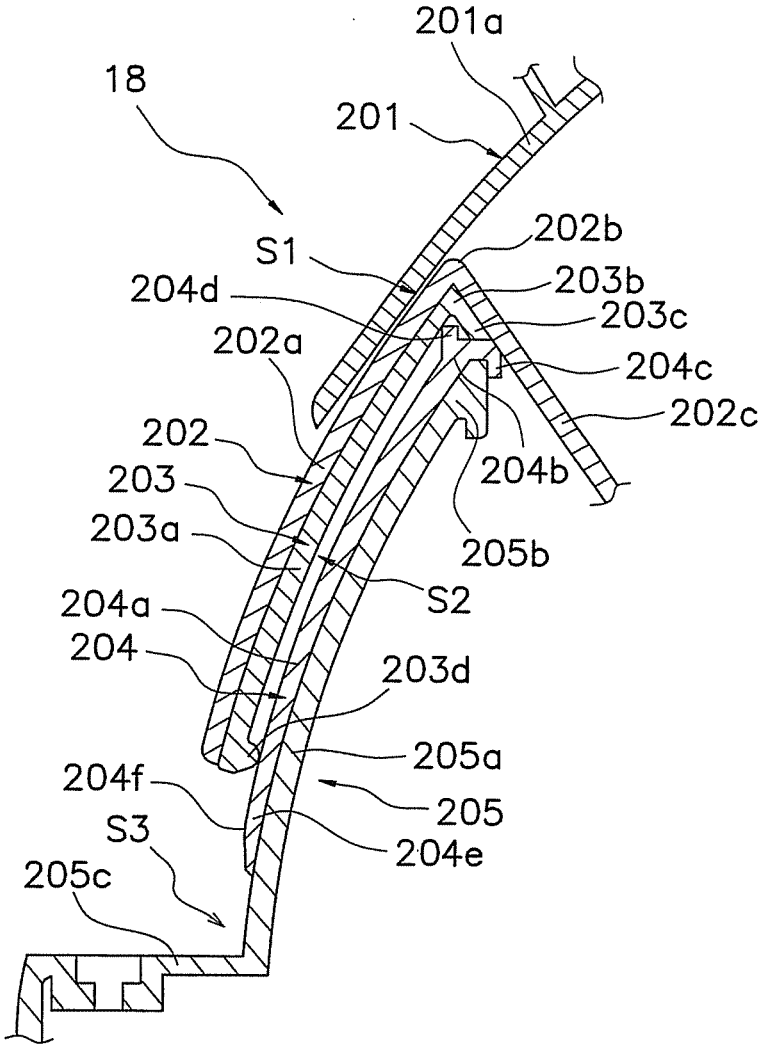
FIG. 22 is a partial cross section of the exterior frame.

202*c* is connected to the connecting frame 207. In a case that the patient T tilts the operation rod 15 and the operation rod 15 moves relative to the movable frame 12, the second moving cover 202 can move relative to the first moving cover 201, and the first moving cover 201 receives little or almost no resistance from the second moving cover 202. Accordingly, even if the operation force for operating the operation rod 15 is small , it is possible to substantially precisely detect the operation force. Particularly, as shown in FIG. 22, a gap 51 is preferably defined between the bottom surface of the dome-like portion 201*a* of the first moving cover 201 and the top surface of the dome-like portion 202*a* of the second moving cover 202. Accordingly, since the first moving cover 201 and the second moving cover 202 are not in contact with each other, when the first moving cover 201 and the second moving cover 202 move relative to each other, no friction resistance occurs between them. Accordingly, the tilting operation force detecting mechanism 14 can precisely detect the tilting operation vector indicating the operation force applied to the operation rod 15 by the tilting operation by the patient T and the direction of the operation force, even if the operation force is very small.

Since the second moving cover 202 is fixed to the movable frame 12, the strength of the cover structure is improved.

The first driven cover 203 and the second driven cover 204 include a dome-like portion 203*a* and a dome-like portion 204*a*, respectively. The first driven cover 203 and the second driven cover 204 are disposed between the second moving cover 202 and the fixed cover 205. The first driven cover 203 and the second driven cover 204 are neither fixed to any of the fixed frame 11, the movable frame 12, nor the operation rod 15. The second moving cover 202 and the first driven cover 203 are in contact with each other, and the first driven cover 203 and the second driven cover 204 are in contact with each other. Accordingly, when the second moving cover 202 moves relative to the fixed cover 205, the first driven cover 203 and the second driven cover 204 follow the movement.

The first driven cover 203 has an upper end formed with an opening edge 203*b* having a small diameter, and has a lower end formed with an opening edge having a large diameter. Through the opening edge 203*b* having a small diameter and the opening edge having a large diameter, the operation rod 15 is inserted. An annular downward projecting portion 203*c* is formed extending downward from the opening edge 203*b* having a small diameter. The first driven cover 203 further includes an annular projection 203*d* extending downward from the opening having a large diameter. The projection 203*d* is in contact with the top surface of the second driven cover 204. This structure makes it possible to define a gap S2 between the bottom surface of the dome-like portion 203*a* of the first driven cover 203 and the top surface of the dome-like portion 204*a* of the second driven cover 204.

The second driven cover 204 has an upper end formed with an opening edge 204*b* having a small diameter, and has a lower end formed with an opening edge having a large diameter. Through the opening edge 204*b* having a small diameter and the opening edge 204*e* having a large diameter, the operation rod 15 is inserted. The second driven cover 204 includes an annular downward projecting portion 204*c* extending downward from the opening edge 204*b* having a small diameter, and an annular upward projecting portion 204*d* extending upward from the opening edge 204*b* having a small diameter. The top surface of the opening edge 204*e* having a large diameter of the lower end of the second driven cover 204 is formed with a taper surface 204*f* having a thickness, which becomes thinner downward.

The fixed cover 205 is mainly composed of a dome-like portion 205*a*. The fixed cover 205 has an upper end formed with an opening edge 205*b*. Furthermore, the fixed cover 205 has a peripheral flange 205*c* extending radially outward from the opening edge having a large diameter of the dome-like portion 205*a*.

The first driven cover 203 is restricted from moving if the inclination relative to the second driven cover 204 is increased, as shown in FIG. 22, because the downward projecting portion 203*c* is engaged with the upward projecting portion 204*d* of the second driven cover 204. On the opposite side of the tilting side, the projection 203*d* of the first driven cover 203 is engaged with the upward projecting portion 204*d* of the second driven cover 204 (refer to FIG. 4). The second driven cover 204 is restricted from moving if the inclination relative to the fixed cover 205 increases, because the downward projecting portion 204*c* is engaged with the opening edge 205*b* having a small diameter of the fixed cover 205. As described above, since the tilting of the first driven cover 203 and the second driven cover 204 is limited relative to the fixed cover 205, it is possible to prevent a gap from being defined between the covers if seen from the outside (refer to FIG. 4). Accordingly, the exterior cover 18 covers the interior mechanism, such as the first gimbal mechanism 30 and the second gimbal mechanism 40, from upward such that the mechanism is not exposed to outside, regardless of the tilting degree of the operation rod 15.

The first driven cover 203 and the second driven cover 204 follow the movement of the second moving cover 202, as described above. In this example, even if the first driven cover 203 and the second driven cover 204 frictionally slide against each other or collide with each other, the phenomenon will give no effect on the tilting operation force detecting mechanism 14. The reason is that the second moving cover 202 is fixed to the movable frame 12.

Next, radial direction lengths (length from an opening edge having a small diameter to an opening edge having a large diameter) along the dome shape of the covers will be described. A circumferential length of the dome-like portion 202*a* of the second moving cover 202 is almost equal to a circumferential length of the dome-like portion 203*a* of the first driven cover 203. Furthermore, a circumferential length of the dome-like portion 204*a* of the second driven cover 204 is longer than the circumferential length of the dome-like portion 202*a* of the second moving cover 202 and the dome-like portion 203*a* of the first driven cover 203, and is shorter than a circumferential length of the dome-like portion 205*a* of the fixed cover 205.

Based on the above-described length relationship between the covers, a situation will be described in which the covers have moved in one direction and engaged with each other as shown in FIG. 22. In FIG. 22, the second driven cover 204 is engaged with the fixed cover 205, the first driven cover 203 is engaged with the second driven cover 204, and the second moving cover 202 is engaged with the first driven cover 203. In this situation, the opening edge 204*e* having a large diameter of the lower end of the second driven cover 204 extends downward further than the opening edges having a large diameter of the lower end of the second moving cover 202 and the first driven cover 203. A gap S3 is defined between the opening edge 204*e* having a large diameter of the lower end of the second driven cover 204 and the peripheral flange 205*c* of the fixed cover 205. In other words, the opening edge 204*e* having a large diameter of the second driven cover 204 does not fall to the lowest position, so that a finger of a person is unlikely to be pinched between the second driven cover 204 and the peripheral flange 205*c* of the fixed cover 205.

In this case, since the opening edge 204*e* having a large diameter of the lower end of the second driven cover 204 is formed with the taper surface 204*f* having a thickness becoming thinner downward, even if the second driven cover 204 is inclined and a part of the opening edge 204*e* having a large diameter of the lower end moves to the lowest position, the finger of a person is unlikely to be pinched in the gap S3 between the opening edge 204*e* having a large diameter of the lower end of the second driven cover 204 and the flat peripheral flange 205*c* of the fixed cover 205.

The tiltable amount of possible tilt of the operation rod 15 relative to the movable frame 12 is set to be smaller than the amount of possible tilt of the movable frame 12 relative to the fixed frame 11. Accordingly, the driven cover is disposed, not between the first moving cover 201 and the second moving cover 202, but between the second moving cover 202 and the fixed cover 205. In contrast, if the driven cover is disposed between the first moving cover 201 and the second moving cover 202, when the operation rod is operated, the operation rod has to move the driven cover, thereby generating some, unfavorable resistance force against the operation force of the patient.

(3) Chair

Figure 28:
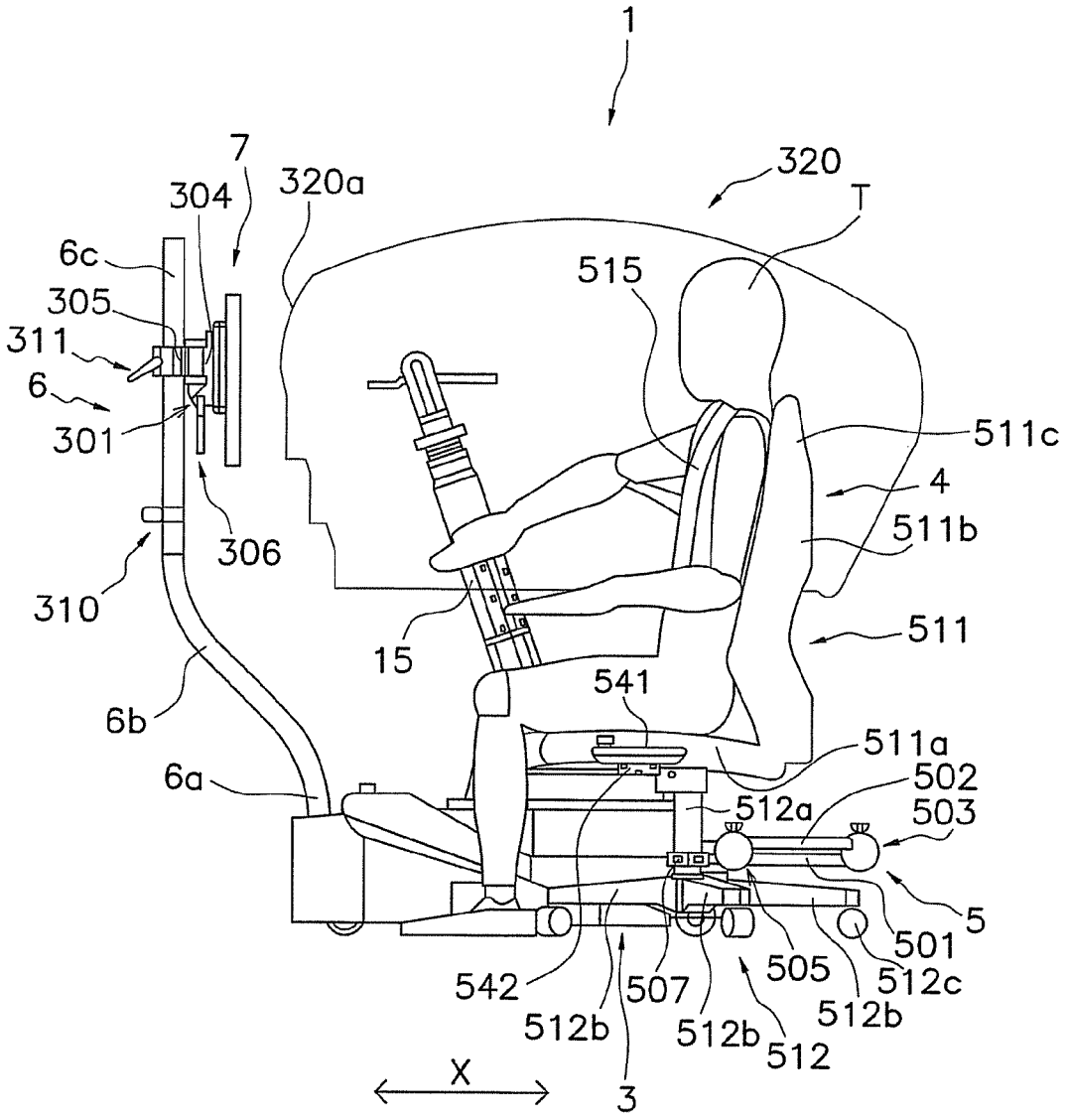
FIG. 28 is a schematic lateral view of the upper limb training apparatus.
Figure 29:
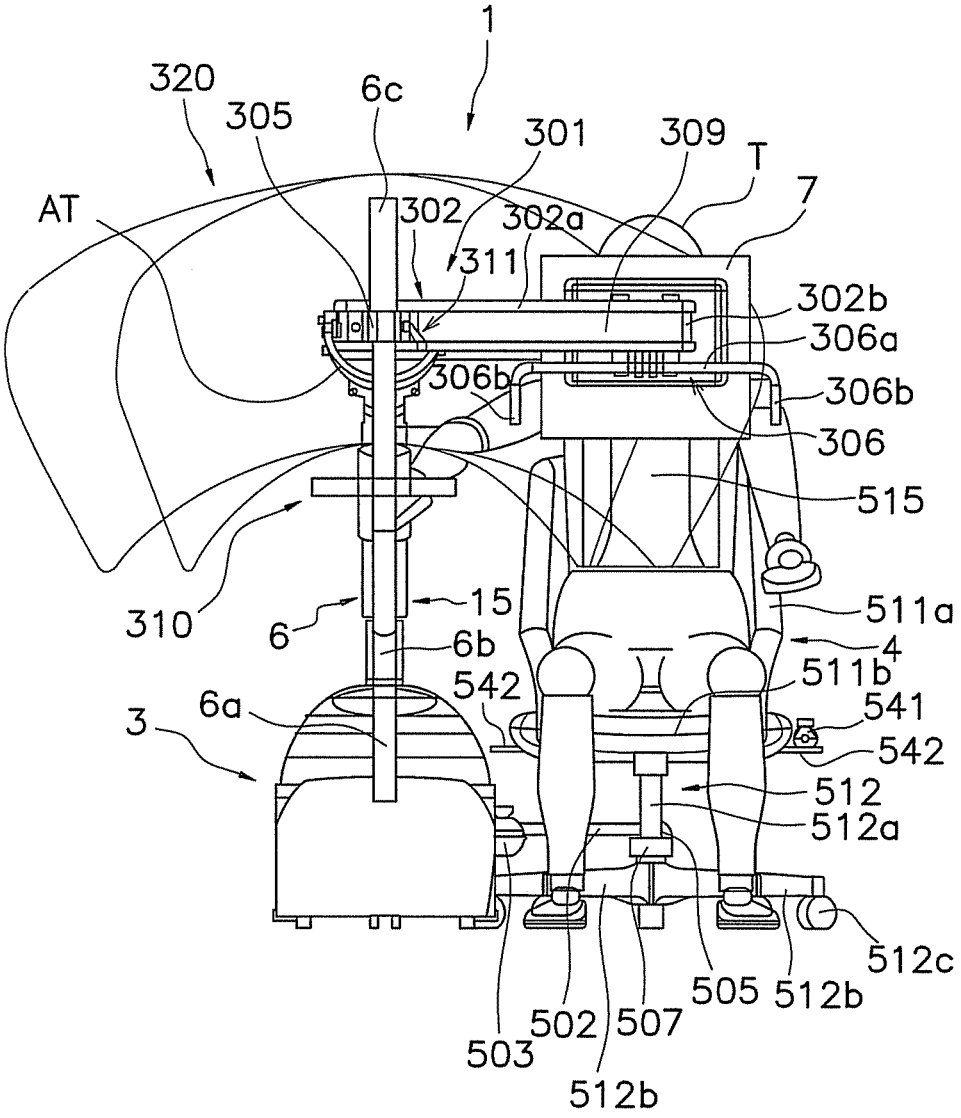
FIG. 29 is a schematic rear view of the upper limb training apparatus.
Figure 30:
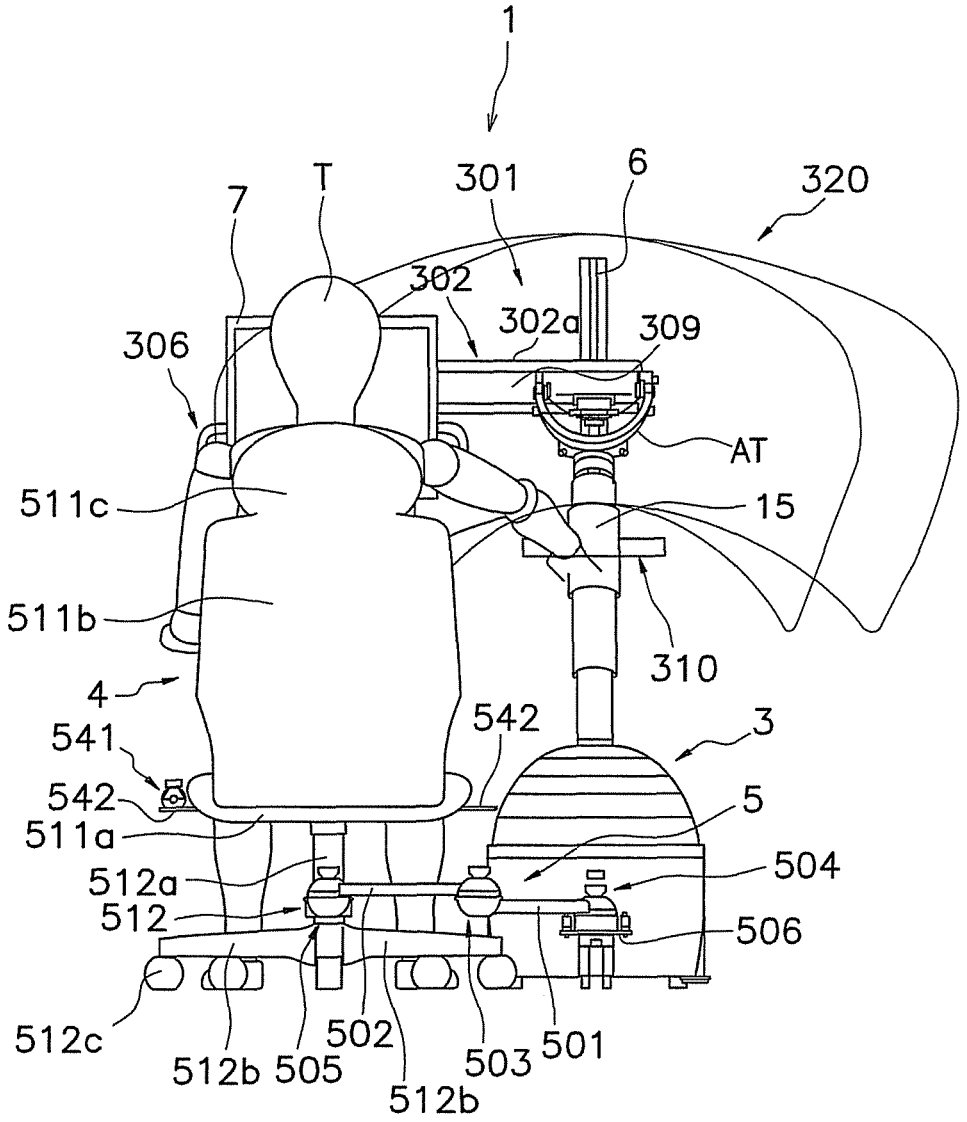
FIG. 30 is a schematic front view of the upper limb training apparatus.

As shown in FIG. 27 and FIG. 28, the chair 4 includes a chair main body 511 and a leg portion 512. The chair main body 511 includes a seat 511*a*, a backrest 511*b*, and a shoulder rest 511*c*. The leg portion 512 includes a column member 512*a* extending downward from the chair main body 511, a plurality of legs 512*b* extending radially from the lower end of the column member 512*a*, casters 512*c* attached to the tip ends of the legs 512*b*. The column member 512*a* is a hexagonal column for example, and has both upper and lower ends unrotatably connected to other members. The caster 512*c* is provided with a whirl stop mechanism (not shown).

The chair 4 is further provided with a restraining device 515 for restraining the patient T to the chair main body 511. The restraining device 515 is a belt member like a seat belt. The patient T will operate the operation rod 15, while sitting on the chair main body 511 and being restrained by the restraining device 515 to the chair main body 511. Since the patient T is restrained to the chair main body 511 so that the position and orientation of the patient T does not change, it is possible to precisely train the upper limb.

(4) Connecting Mechanism (4-1) Basic Function of the Connecting Mechanism

The connecting mechanism 5 integrally connects the chair 4 and the training apparatus main body 3. The connecting mechanism 5 allows the chair 4 to move between a right arm training position and a left arm training position, while the chair 4 is being connected to the training apparatus main body 3 via the connecting mechanism 5. The position of the chair 4 is adjusted and the chair 4 is fixed at a right arm training position 321 or a left arm training position 322 (refer to FIG. 27). In this case, "fixed" means that the chair 4 can not change its position relative to the training apparatus main body 3, and can not change its orientation. Accordingly, it is possible to easily fix the chair 4 to an appropriate position according to the training condition of the upper limb. Since the chair 4 is fixed to the training apparatus main body 3 and its fixed state is maintained by the connecting mechanism 5, it is unlikely that the chair 4 would start to move while the patient T is operating the operation rod 15 of the training apparatus main body 3. Accordingly, it is possible to correctly train the upper limb of the patient T.

(4-2) Specific Structure of the Connecting Mechanism

Figure 36:
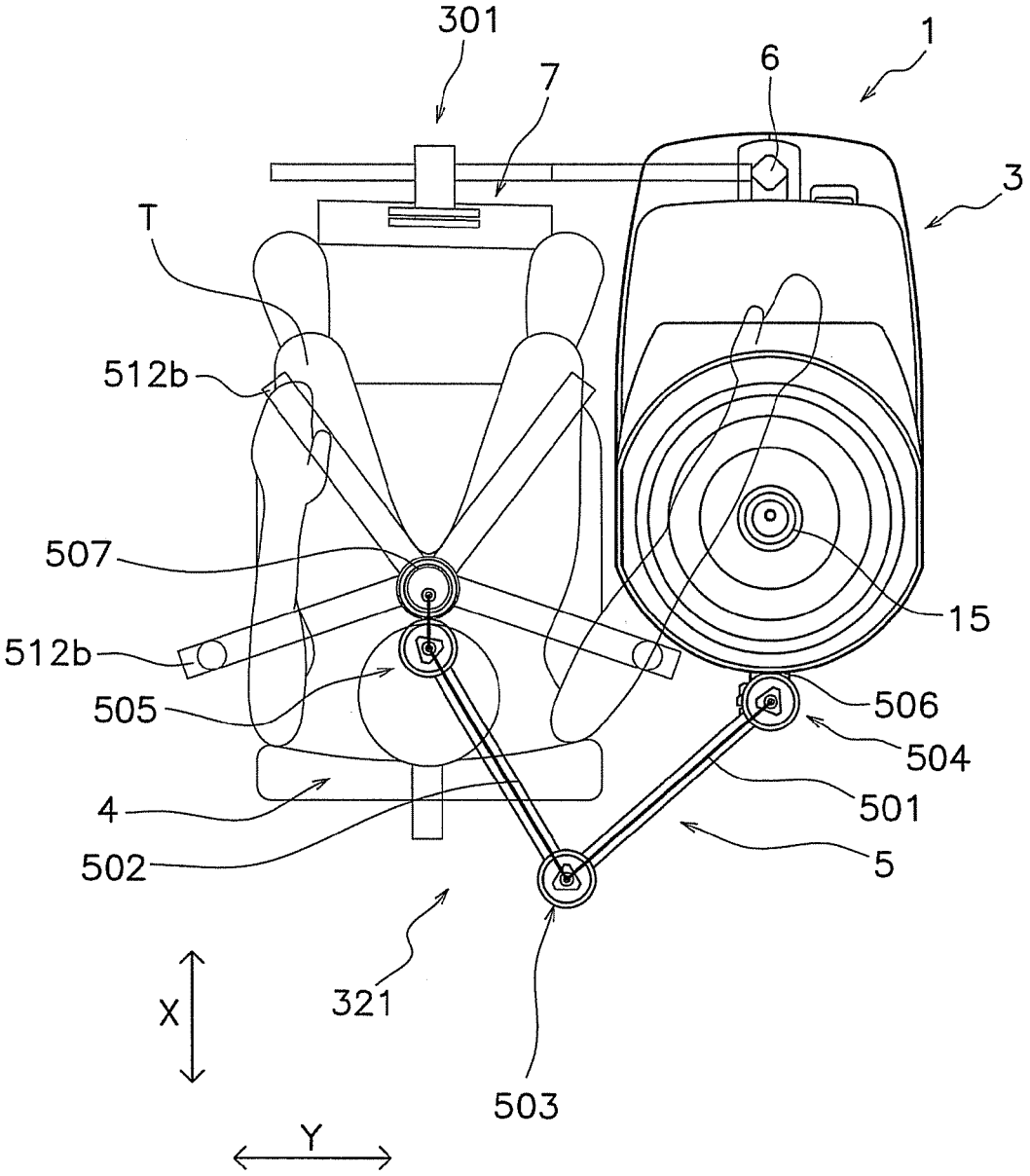
FIG. 36 is a plane view of the upper limb training apparatus.
Figure 37:
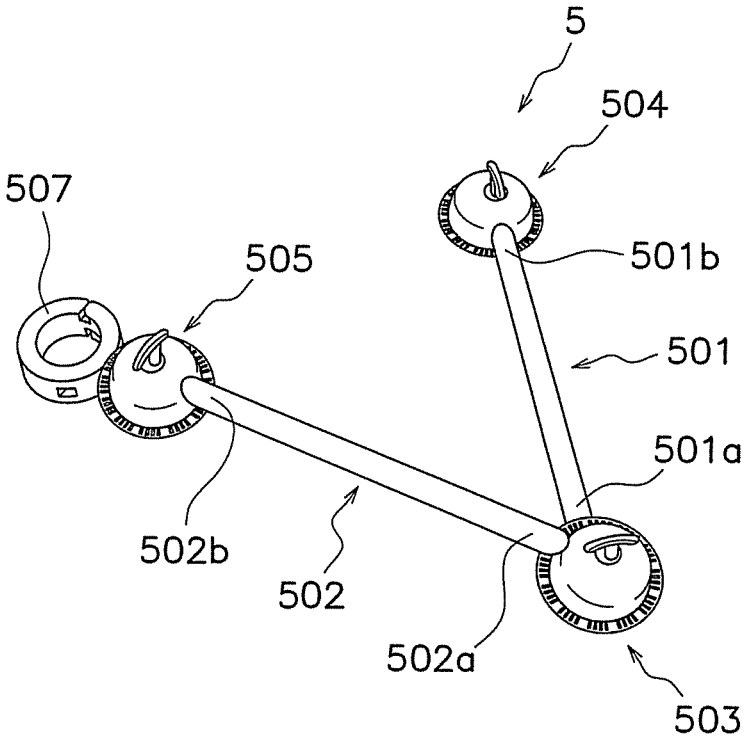
FIG. 37 is a perspective view of a connecting mechanism.

As shown in FIG. 36 and FIG. 37, the connecting mechanism 5 includes a first arm 501 and a second arm 502. A first end portion 501*a* of the first arm 501 and a first end portion 502*a* of the second arm 502 are rotatably connected with each other via a first connecting portion 503.

A second end portion 501*b* of the first arm 501 and the training apparatus main body 3 are rotatably connected with each other via a second connecting portion 504. The second connecting portion 504 is fixed to a fixed portion 506 provided on the back side (on a front side of the apparatus) in the front-and-back X direction of the training apparatus main body 3.

A second end portion 502*b* of the second arm 502 and the chair 4 are rotatably connected with each other via a third connecting portion 505. A ring-like fixing member 507 is fixed to the third connecting portion 505. The fixing member 507 is unrotatably fixed to the column member 512*a* of the chair 4.

In this apparatus, the first end portion 501*a* of the first arm 501 and the first end portion 502*a* of the second arm 502, the second end portion 501*b* of the first arm 501 and the training apparatus main body 3, the second end portion 502*b* of the second arm 502 and the chair 4, are respectively connected with each other via the first through the third connecting portions 503, 504 and 505 such that they can turn relative to each other or be fixed to each other. Accordingly, by turning the above-described three points to adjust the angle positions, position and orientation of the chair 4 are determined relative to the training apparatus main body 3. In other words, if the relationship between the turning amount or relative angle positions of the above-described three points and the position and orientation of the chair 4 relative to the training apparatus main body 3 is known in advance, a doctor or an occupational therapist can instruct the specific position and orientation of the chair 4 by instructing the turning amount or the relative angle positions of these three points. Then, the operator follows the instruction and can precisely position the chair 4.

The connecting mechanism 5 connects the chair 4 and the training apparatus main body 3 such that the chair 4 will move between the right arm training position and the left arm training position, passing through backward (in front of the apparatus) of the training apparatus main body 3. In this case, the operation of moving the chair 4 becomes easier, and the space within which the chair 4 is moved becomes smaller.

Since the first arm 501, the second arm 502, and the first connecting portion 503 are positioned higher than the leg 512*b* of the chair 4, the chair 4 does not interfere with them.

As shown in FIG. 36 through FIG. 39, the structure and function of the connecting mechanism 5 will be described further in detail.

FIG. 36 shows a positional relationship between the chair 4 and the training apparatus main body 3 when the chair 4 is positioned at the right arm training position 321. In this figure, a coordinate is illustrated in which the chair 4 should be fixed in the right arm training position 321, wherein the position of the operation rod 15 of the training apparatus main body 3 serves as a standard.

Figure 38:
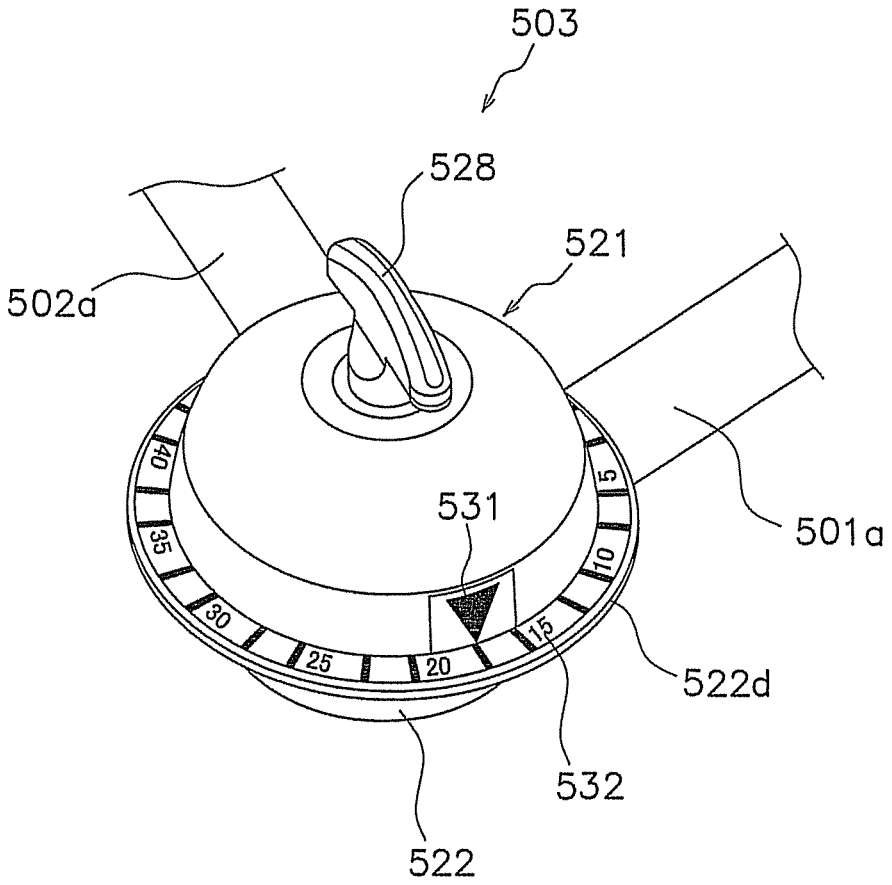
FIG. 38 is a perspective view of a connecting portion.
Figure 39:
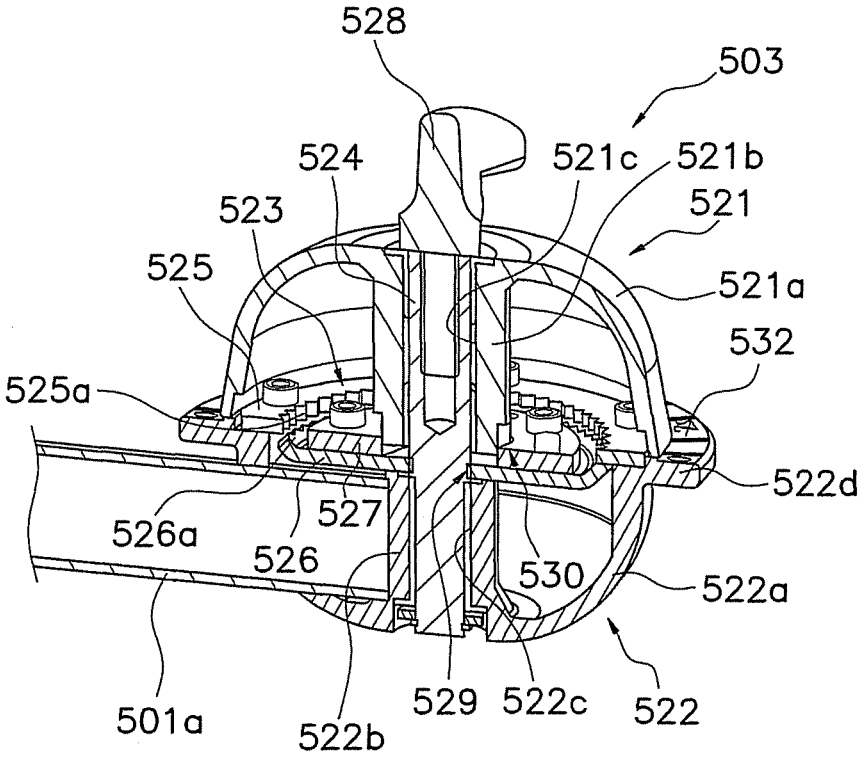
FIG. 39 is a cross section of the connecting portion.

The first connecting portion 503, the second connecting portion 504, and the third connecting portion 505 are members for rotatably connecting two members with each other, and have a common basic structure. Below, as shown in FIG. 38 and FIG. 39, the structure of the first connecting portion 503 will be described.

The first connecting portion 503 mainly includes an upper first member 521, a lower second member 522, and a lock mechanism 523.

To the first member 521, a first end portion 502*a* of the second arm 502 is fixed. The first member 521 is a cup-like member, and is positioned with its convex-side surface facing upward. The first member 521 includes a curved portion 521*a*, and a cylindrical first shaft 521*b* extending in the center in the vertical direction. The first shaft 521*b* is formed with a central hole 521*c* extending in the axial direction. The first end portion 502*a* of the second arm 502 penetrates through the curved portion 521*a*, and is fixed to the first shaft 521*b*.

To the second member 522, the first end portion 501*a* of the first arm 501 is fixed. The second member 522 is a cup-like member positioned with its convex-side surface facing downward. The second member 522 includes a curved portion 522*a*, and a cylindrical second shaft 522*b* extending in the vertical direction in the center. The second shaft 522*b* of the second member 522 is formed with a central hole 522*c* extending in the axial direction. The first end portion 501*a* of the first arm 501 penetrates through the curved portion 522*a*, and is fixed to the second shaft 522*b*. The second member 522 further includes an annular flange 522*d* extending radially outward at it upper end.

The first member 521 is disposed to be placed on the second member 522, and can turn relative to the second member 522. As shown in FIG. 38, the curved portion 521*a* of the first member 521 is provided with a triangle-like mark 531 becoming thinner downward, and the top surface of the flange 522*d* of the second member 522 is formed with calibrations 532 at predetermined angles. In other words, depending on which number of the calibrations 532 the mark 531 points at, displacement angle defined by the first member 521 and the second member 522, i.e., an angle defined by the first arm 501 and the second arm 502 will be understood.

The lock mechanism 523 is a mechanism for unrotatably connecting and disconnecting the first member 521 and the second member 522. The lock mechanism 523 is located within a space defined by the first member 521 and the second member 522. The lock mechanism 523 includes a rotary shaft 524, a first lock member 525, a second lock member 526, a whirl stop member 527, and a knob 528.

The rotary shaft 524 extends thorough the central hole 521*c* of the first shaft 521*b* and the central hole 522*c* of the second shaft 522*b*. The rotary shaft 524 is supported rotatably relative to the first member 521 and the second member 522, and is supported in the axial direction such that the rotary shaft 524 does not fall off. A screw portion of the knob 528 is inserted into the end portion of the rotary shaft 524 near the first member 521.

The first lock member 525 is an annular or ring-like plate-like member fixed to an upper end portion of the second member 522. The first lock member 525 is formed with a plurality of first teeth 525*a* around an inner circumferential edge thereof.

The second lock member 526 is an annular plate-like member disposed below the first lock member 525. The second lock member 526 is formed with a plurality of second teeth 526*a* around an outer circumferential edge thereof. The second teeth 526*a* extend obliquely upward, and can be engaged with the first teeth 525*a* of the first lock member 525. The inner circumferential edge of the second lock member 526 is engaged with the outer circumferential surface of the rotary shaft 524 via a screw engaged portion 529.

The whirl stop member 527 is a member for connecting the second lock member 526 to the first member 521 such that the second lock member 526 can move in the axial direction but not in the rotational direction. The whirl stop member 527 is an annular plate-like member disposed on the top surface of the second lock member 526. The whirl stop member 527 has an outer diameter smaller than an inner diameter of the first lock member 525. Accordingly, the whirl stop member 527 and the first lock member 525 do not interfere with each other. The whirl stop member 527 is fixed to the second lock member 526. An inner circumferential edge of the whirl stop member 527 is engaged with an outer circumferential surface of the rotary shaft 524 via the whirl stop portion 530.

According to the above-described structure, by operating the knob 528 to rotate in the rotary shaft 524, the second lock member 526 and the whirl stop member 527 move in the vertical direction. Accordingly, the second lock member 526 can move between a lock position in which it is engaged with the first lock member 525 and a lock released position in which it is released from the first lock member 525. As shown in FIG. 39, the second lock member 526 is disposed at the lock released position below and away from the first lock member 525. If the second lock member 526 is moved upward from this position, the second teeth 526*a* of the second lock member 526 engage with the first teeth 525*a* of the first lock member 525, thereby realizing a lock condition.

The first teeth 525*a* and the second teeth 526*a* are formed with a constant pitch. In other words, at the first connecting portion 503, the first member 521 and the second member 522 can be fixed to each other at any positions to which they are turned with the constant pitch.

In the second connecting portion 504, a first member is fixed to the first arm 501, and a second member is fixed to the fixed portion 506 of the training apparatus main body 3. In the third connecting portion 505, a first member is fixed to the second arm 502, and a second member is fixed to the fixing member 507.

(4-3) Effects

As described above, since the connecting mechanism 5 includes the first connecting portion 503, the second connecting portion 504, and the third connecting portion 505, it is possible to freely position the chair 4 within a predetermined range of the training place. In addition, by matching the mark 531 with a target calibration 532, a once set fixed position can be easily reproduced. For example, if the doctor tells the patient T, in advance, a set of numbers that the mark 531 should point at in the connecting portions, the patient T can adjust the connecting portions to reproduce the numbers. Although the above description is related to the position adjustment under a situation in which the chair 4 is connected to the training apparatus main body 3, it can be applied to the case in which the chair 4 is released from the training apparatus main body 3 and then the two components are transported to a different place and assembled.

Furthermore, when all of the connecting portions 503 through 505 are loosened, the chair 4 can be moved between the right arm training position 321 and the left arm training position 322, while maintaining the connection of the chair 4 to the training apparatus main body 3 by the connecting mechanism 5. At that time, the chair 4 can move in the right-and-left Y direction by passing through backward (in front of the apparatus) of the training apparatus main body 3 in the front-and-back X direction.

In addition, if all of the connecting portions 503 through 505 are tightened, the chair 4 is connected to the training apparatus main body 3 with enough strength. As a result, the chair 4 will not move relative to the training apparatus main body 3 during the training. The connecting mechanism 5 prevents the chair 4 or the training apparatus main body 3 from easily toppling over.

(4-4) Remote Controller

The upper limb training apparatus 1 includes, as shown in FIG. 28, a remote controller 541, and a remote controller attached seat 542. The remote controller 541 is a device with which the patient T operates the training apparatus main body 3 with his normal upper limb, for example. The remote controller 541 is connected with the training apparatus main body 3 by wire or wireless. The remote controller attached seat 542 can be attached to both the right and left sides of the chair 4. Although the remote controller attached portion 542 may be attached to both the right and left sides of the chair 4, the remote controller attached seat 542 may preferably be actually attached to the opposite side of the upper limb to be trained for the patient T. As a result, the patient T can operate the remote controller 541 with the normal upper limb, which does not have to be trained.

A surface fastener (not shown) is attached to the top surface of the remote controller attached seat 542 and the bottom surface of the remote controller 541, the surface fastener fixes them to each other. Accordingly, the remote controller 541 is unlikely to fall from the remote controller attached seat 542.

Figure 40:
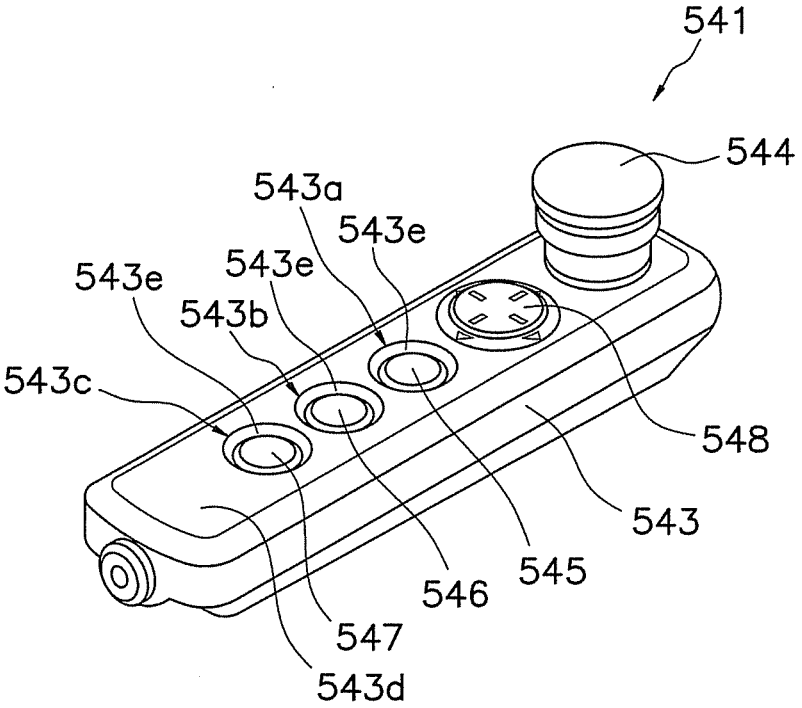
FIG. 40 is a perspective view of a remote controller.
Figure 41:
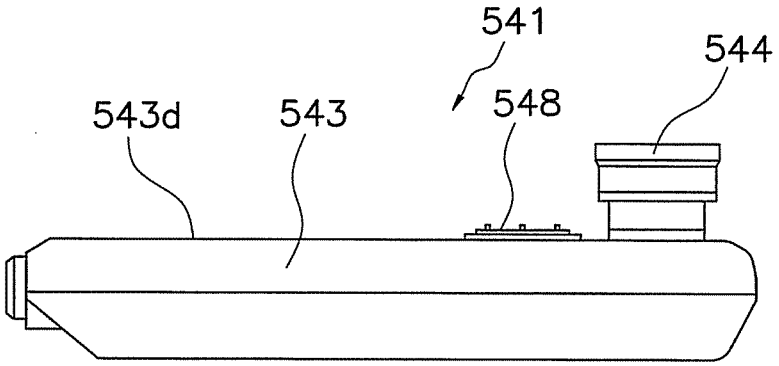
FIG. 41 is a lateral view of the remote controller.

The remote controller 541 includes, as shown in FIG. 40 and FIG. 41, a cabinet 543, an emergency stop button 544, and operation buttons 545,546 and 547 respectively disposed at concave portions 543*a*, 543*b* and 543*c* of the cabinet 543. The emergency stop button 544 is provided in the cabinet 543, and is a member for instructing an emergency stop to the training apparatus main body 3. For example, if an abnormal condition occurs in the training apparatus main body 3, the patient T can urgently stop the training apparatus main body 3 by operating the remote controller 541 while sitting on the chair 4 during the training. Accordingly, the safety of the upper limb training apparatus 1 is improved. To the operation buttons 545 through 547, actions such as enter, cancel , and etc. are allocated by the training software.

The pressing surfaces of the operation buttons 545, 546, and 547 are positioned inwards relative to the top surface 543*d* of the cabinet 543 when they are not pressed. Accordingly, as shown in FIG. 41, when seeing the remote controller 541 laterally, neither the operation buttons 545, 546, nor 547 can be seen. Accordingly, even if the patient T accidentally lets the remote controller 541 drop to the floor surface FL , it is unlikely that the operation buttons 545, 546, or 547 would be accidentally pressed. In other words, it is unlikely that malfunction happens in the training apparatus main body 3, thereby improving the safety of the upper limb training apparatus 1.

The concave portions 543*a* through 543*c* of the cabinet 543 include an annular taper surface 543*e* inclined toward the center from the top surface 543*d* of the cabinet 543. When the patient T operates the operation buttons 545 through 547, he can push the operation buttons 545 through 547 by slipping his fingers along the taper surface 543*e*. Accordingly, the operability is improved when the patient T operates the operation buttons 545 through 547.

Provided between the operation buttons 545 through 547 and the emergency stop button 544 is a cursor key 548. As shown in FIG. 41, although an operation surface of the cursor key 548 projects from the top surface 543*d* of the cabinet 543, it does not particularly cause a safety problem because the cursor key 548 is only used for setting the operation and is not used for executing important actions of the training apparatus main body 3.

(5) Monitor Stand and Monitor Arm

A configuration for moving the monitor 7 to a position where the patient T can easily see the monitor 7 will be described. In this description, the chair 4 is arranged in the right arm training position 321 or the left arm training position 322 relative to the training apparatus main body 3 (refer to FIG. 27). This configuration mainly includes a monitor arm 301 attached to the monitor stand 6 and supporting the monitor 7. The monitor 7 is a thin display such as a liquid crystal display.

The monitor stand 6, the monitor 7, and the monitor arm 301 are integrally formed with the training apparatus main body 3 (in other words, they are not independent devices). Accordingly, their handling such as transportation is easy, and the positioning of the devices with each other is easy and precise.

As shown in FIG. 28, the monitor stand 6 is a bar-like member extending upward from the base frame 21. The monitor stand 6 is made of aluminum frame, for example. The monitor stand 6 is cranked, and includes a base portion 6*a* fixed to the base frame 21 forward relative to the operation rod 15 in the front-and-back X direction, a curved portion 6*b* curved forward from the base portion 6*a* in the front-and-back X direction, and an upper end portion 6*c* positioned forward relative to the base portion 6*a* in the front-and-back X direction and on which the monitor 7 is arranged. The upper end portion 6*c* extends linearly in the vertical Z direction. As described above, since the monitor stand 6 extends upward from the base portion 6*a*, and the upper end portion 6*c* is positioned forward and away from the operation rod 15 in the front-and-back X direction, it is possible to place the monitor 7 sufficiently on the front side in the front-and-back X direction while footprint of the training apparatus main body 3 is sufficiently small. As a result, it is possible to realize a large range of acceptable tilted angle when the operation rod 15 is tilted forward. The reason is that even if the operation rod 15 falls forward in the front-and-back X direction, it is unlikely that the operation rod 15 or the attachment AT collides against the monitor 7. In this example, as shown in FIG. 27 through FIG. 30, the largest moving range 320 of the attachment AT when the operation rod 15 tilts is D-shaped having a front-side limitation 320*a* in the front-and-back X direction that is a straight line extending in the right-and-left Y direction in a plane view. The front-side limitation 320*a* substantially coincides with the front end of the training apparatus main body 3 in the front-and-back X direction, but the monitor 7 is positioned forward from the front-side limitation 320*a* in the front-and-back X direction.

As shown in FIG. 31 through FIG. 35, the monitor arm 301 is provided at the monitor stand 6, and supports the monitor 7 such that the position of the monitor 7 can be adjusted in the right-and-left Y direction, or more specifically, sliding horizontally. Specifically, the monitor arm 301 includes a supporting member 302, a slide rail 303, a first supporting bracket 304, and a second supporting bracket 305. The supporting member 302 supports the slide rail 303 while accommodating the whole of the slide rail 303, and can be moved together with the slide rail 303 as later described. Specifically, the supporting member 302 includes a frame member 302*a*, and a pair of rotary rollers 302*b* (later described) provided at both ends in the right-and-left Y direction of the frame member 302*a*. The frame member 302*a* includes an upper frame 302*c*, and a lower frame 302*d* disposed below and away from the upper frame 302*c*. The upper frame 302*c* and the lower frame 302*d* are connected with each other at two ends in the right-and-left Y direction by portions supporting the rotary rollers 302*b*.

The slide rail 303 extends in the right-and-left Y direction, and is supported by the monitor stand 6 such that the slide rail 303 can slide in the horizontal direction. Specifically, the slide rail 303 is a slide rail of a both-surface type, and has a back surface in the front-and-back X direction to which the first supporting bracket 304 is slidably mounted in the horizontal direction, and has a front surface in the front-and-back X direction to which the second supporting bracket 305 is slidably mounted in the horizontal direction. To the first supporting bracket 304, the rear surface of the monitor 7 is fixed. The second supporting bracket 305 is fixed to the upper end portion 6*c* of the monitor stand 6.

Figure 31:
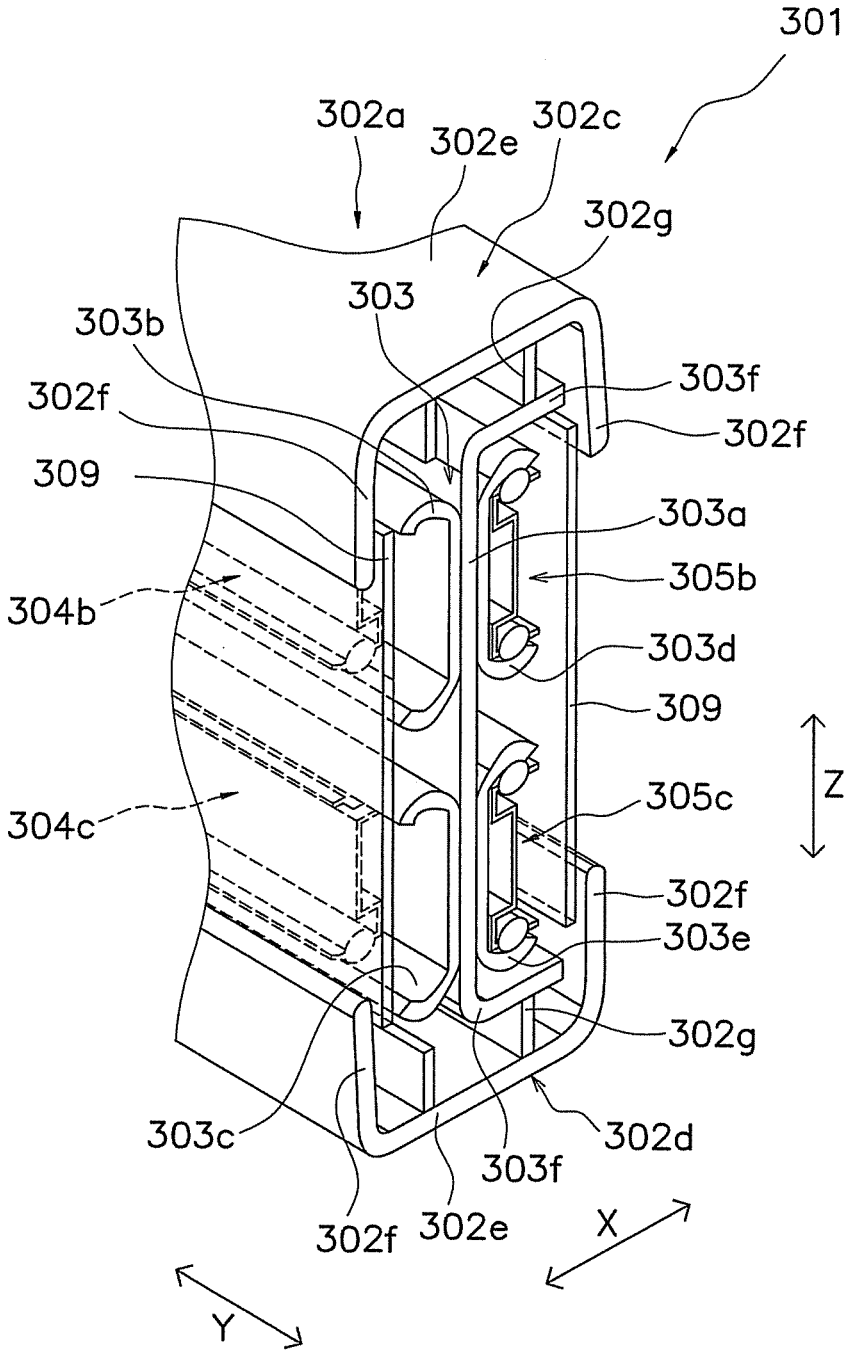
FIG. 31 is a perspective view containing a partial cross section of a monitor arm.

More specifically, as shown in FIG. 31, the slide rail 303 includes a frame 303*a*, and rails 303*b* through 303*e*. The frame 303*a* is a plate-like member extending in the right-and-left Y direction, with a predetermined width in the vertical Z direction. At the upper end and the lower end of the main body of the frame 303*a*, a second plate-like portion 303*f* extending forward in the front-and-back X direction is provided. To the back side of the frame 303*a* in the front-and-back X direction, a first rail 303*b* and a second rail 303*c* are fixed and arranged side by side in the vertical Z direction. To the front side of the frame 303*a* in the front-and-back X direction, a third rail 303*d* and a fourth rail 303*e* are fixed and arranged side by side in the vertical Z direction. The rails 303*b* through 303*e* extend along the whole length of the frame 303*a* in the right-and-left Y direction.

On both sides of the frame 303*a* in the vertical Z direction, the upper frame 302*c* and the lower frame 302*d* of the frame member 302*a* are arranged, respectively. The upper frame 302*c* (and lower frame 302*d*) includes a first plate 302*e* extending in the right-and-left Y direction and having a predetermined width in the front-and-back X direction, and a pair of second plates 302*f* extending in the vertical Z direction from both ends of the first plate 302*e* in the front-and-back X direction. On the first plate 302*e*, a projection 302*g* is provided extending in the right-and-left Y direction with a predetermined width in the vertical Z direction. The projection 302*g* is in contact with the second plate-like portion 303*f* of the frame 303*a* in the vertical Z direction. As described above, the slide rail 303 is supported by the supporting member 302 in the vertical direction.

The first supporting bracket 304 includes a first bracket main body 304*a*, a first bearing mechanism 304*b* and a second bearing mechanism 304*c* both of which are fixed to the first bracket main body 304*a*. As shown in FIG. 31, the first bearing mechanism 304*b* and the second bearing mechanism 304*c* are provided so as to slide along the first rail 303*b* and the second rail 303*c*, respectively. The second supporting bracket 305 includes a second bracket main body 305*a*, and a third bearing mechanism 305*b* and a fourth bearing mechanism 305*c* both of which are fixed to the second bracket main body 305*a*. As shown in FIG. 31, the third bearing mechanism 305*b* and the fourth bearing mechanism 305*c* are provided so as to slide along the third rail 303*d* and the fourth rail 303*e*, respectively.

Figure 32:
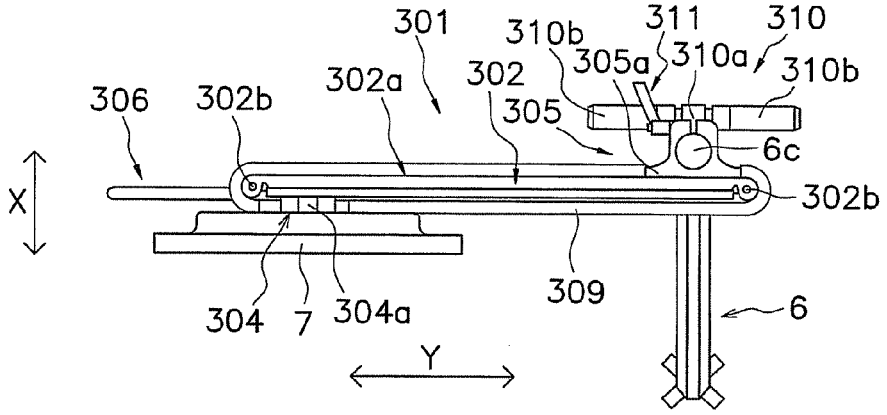
FIG. 32 is a schematic plane view for explaining about a positional relationship between a monitor, a monitor arm, and a monitor rod.
Figure 34:
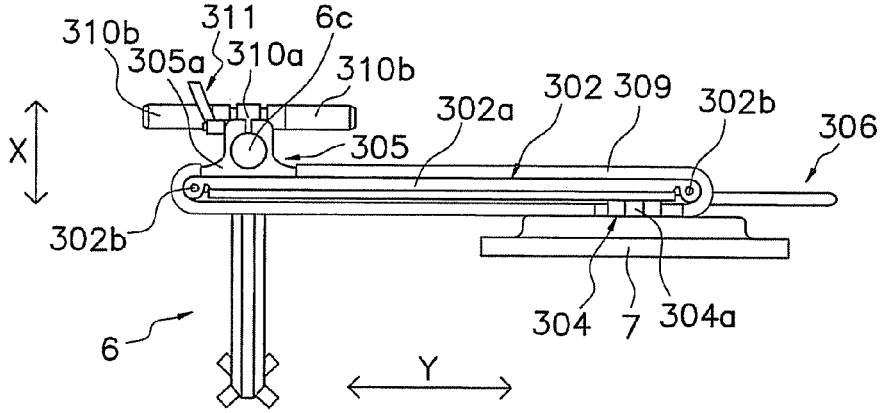
FIG. 34 is a schematic plane view for explaining about a positional relationship between a monitor, a monitor arm and a monitor rod.

According to the above-described configuration, since the slide rail 303 slides relative to the monitor stand 6 in the horizontal direction, and the monitor 7 slides relative to the slide rail 303 in the horizontal direction, it is possible to ensure long travel distance for the monitor 7 while reducing slide stroke of the slide rail. Accordingly, when the monitor 7 is moved to one side in the right-and-left Y direction, the remaining amount of the slide rail 303 projecting from the monitor stand 6 on the opposite side in the right-and-left Y direction becomes small. In FIG. 32, the monitor 7 has moved to the leftmost in the right-and-left Y direction, and in this case, the remaining amount of the slide rail 303 and the supporting member 302 further projecting from the monitor stand 6 on the right side in the right-and-left Y direction becomes more smaller. In FIG. 34, the monitor 7 has moved to the rightmost in the right-and-left Y direction, thereby realizing the same effects. The position of the monitor 7 in FIG. 32 is employed for a training when the chair 4 is positioned in the right arm training position 321 (refer to FIG. 27), and the position of the monitor 7 in FIG. 34 is employed for a training when the chair 4 is positioned in the left arm training position 322.

According to the above-described configuration, the monitor arm 301 allows the position of the monitor 7 to be adjusted on both sides in the right-and-left Y direction relative to the monitor stand 6. Accordingly, as shown in FIG. 27, depending on whether the chair 4 is positioned in the right arm training position 321 or in the left arm training position 322, the monitor 7 is positioned in the right-and-left Y direction using the monitor arm 301, so that the monitor 7 can be positioned where the patient T can easily see it (for example, in front of the patient T). Particularly, since the monitor arm 301 supports the monitor 7 such that the monitor 7 can slide in the horizontal direction, it is easy to move the monitor 7 in the right-and-left Y direction.

As described above, the operation of moving the monitor 7 in the right-and-left Y direction is just sliding the monitor 7 in the right-and-left Y direction. In other words, it is not necessary to demount and mount the monitor 7. Accordingly, in the upper limb training apparatus 1, it is possible to, with a simple operation, place the monitor 7 at a position where the patient T can easily see the monitor 7.

Figure 33:
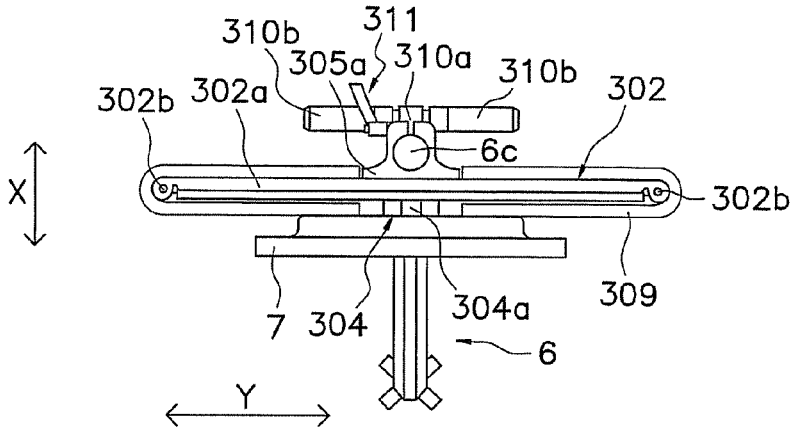
FIG. 33 is a schematic plane view for explaining about a positional relationship between a monitor, a monitor arm and a monitor rod.

The monitor arm 301 will be further described in detail. The monitor arm 301 further includes a belt 309. The belt 309 is an endless type, and is wound around the rotary rollers 302*b* of the supporting member 302. The belt 309 is flexible. The belt 309 covers the whole length of the slide rail 303. Accordingly, an operator can not directly touch the slide rail 303. To the belt 309, the first supporting bracket 304 and the second supporting bracket 305 are fixed, therefore, the first supporting bracket 304 and the slide rail 303 move together in the right-and-left Y direction via the belt 309. The first supporting bracket 304 and the second supporting bracket 305 are fixed to the belt 309, as shown in FIG. 33, such that they correspond to each other at the center of the supporting member 302 and the slide rail 303 in the right-and-left Y direction.

More specifically, as shown in FIG. 31, the belt 309 is disposed so as to extend along the inside of the second plate 302*f* of the frame member 302*a*, and is disposed so as to cover the slide rail 303 together with the frame member 302*a*. As is clear from the drawings, the width of the belt 309 (length in the vertical Z direction) is longer than the length between the edges of the upper and lower second plates 302*f*. Accordingly, the belt 309 closes the interior of the frame member 302*a* from outside.

According to the above-described configuration, if the operator moves the monitor 7 to one side in the right-and-left Y direction, the belt 309 is driven in accordance with movement of the first supporting bracket 304, so that the slide rail 303 is moved to the same side. As described above, since the first supporting bracket 304 and the slide rail 303 move in conjunction with each other, the monitor 7 can be moved by one action. Accordingly, the ease of operation for moving the monitor 7 is improved, e.g., the patient T having handicap in the arm can also easily move the monitor 7.

Particularly, since the slide moving amount of the first supporting bracket 304 relative to the monitor stand 6 is twice as much as the slide moving amount of the slide rail 303 relative to the monitor stand 6, the moving speed of the first supporting bracket 304 and the monitor 7 is twice as much as the moving speed of the slide rail 303. Accordingly, when the monitor 7 moves right and left, it is possible to move the monitor 7 quickly to a certain position.

Figure 35:
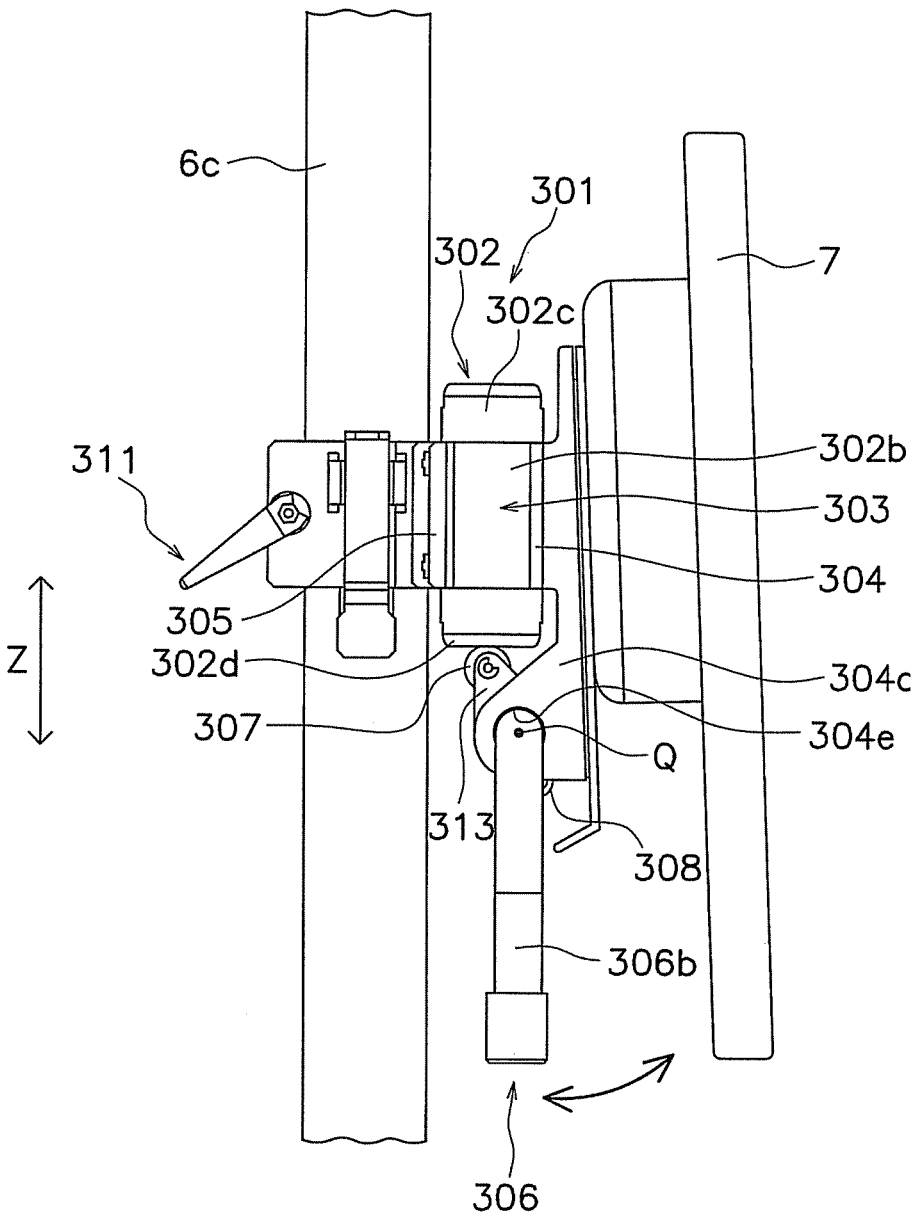
FIG. 35 is a lateral view of the monitor arm.

The monitor arm 301 further includes, as shown in FIG. 35, a monitor moving handle 306, a rubber roller 307, and a torsion spring 308. The monitor moving handle 306 is rotatably provided on the first supporting bracket 304 or the monitor 7. Specifically, it is supported by a pair of frames 304*d* extending from the first supporting bracket 304. The monitor moving handle 306 includes an extension portion 306*a* extending in the right-and-left Y direction, and a pair of handle portions 306*b* bent at right angle and extending from two ends of the extension portion 306*a*. The extension portion 306*a* is inserted into a hole 304*e* formed in the pair of frames 304*d* of the first supporting bracket 304.

The rubber roller 307 is fixed to the monitor moving handle 306. Specifically, the rubber roller 307 is fixed to a cam bracket 313 attached to the extension portion 306*a* of the monitor moving handle 306. The rubber roller 307 is a cylindrical member made of a material having a high friction coefficient (for example, having a surface layer made of silicone rubber), and extends in the right-and-left Y direction.

The torsion spring 308 urges the monitor moving handle 306 such that the rubber roller 307 is in contact with the bottom surface of the lower frame member 302*a* of the supporting member 302. The torsion spring 308 is attached to the frame 304*d*. The torsion spring 308 gives an elastic force, as shown in FIG. 35, such that the monitor moving handle 306 turns around an axial center Q of the extension portion 306*a* extending in the right-and-left Y direction, in a direction in which the rubber roller 307 gets into contact with the bottom surface of the lower frame member 302*a* (clockwise in FIG. 35). As a result, as shown in FIG. 35, the rubber roller 307 is pushed against the bottom surface of the lower frame 302*d* of the frame member 302*a* of the supporting member 302. As described above, since the rubber roller 307 is frictionally engaged with the supporting member 302, the first supporting bracket 304 can not move relative to the supporting member 302 and the slide rail 303. In addition, since the first supporting bracket 304 moves together with the slide rail 303, the slide rail 303 also can not move relative to the monitor stand 6.

In the state that the monitor 7 can not move in the right-and-left Y direction, as shown in FIG. 35, the handle portion 306*b* of the monitor moving handle 306 extends directly downward, as shown in FIG. 35.

If the operator turns the monitor moving handle 306 backward in the front-and-back X direction (right side in FIG. 35), the rubber roller 307 leaves the supporting member 302, so that the first supporting bracket 304 can move relative to the slide rail 303. In other words, the operator can move the first supporting bracket 304 and the monitor 7 in the right-and-left Y direction, while grabbing the monitor moving handle 306 so that the first supporting bracket 304 can move. As described above, since lock releasing action and monitor moving action can be performed successively, the operability of moving the monitor 7 becomes improved.

In this embodiment, since the monitor moving handle 306 has the handle portions 306*b* on both sides in the right and left direction, the operator can easily operate the monitor moving handle 306 when he is at either side relative to the monitor 7 in the right-and-left Y direction.

As shown in FIG. 27, fixed to the monitor stand 6 is a transportation handle 310 for transporting the upper limb training apparatus 1. The transportation handle 310 is attached to the upper end portion 6*c* of the monitor stand 6. The transportation handle 310 includes a fixed portion 310*a*, and a pair of handle portions 310*b* extending from the fixed portion 310*a* toward both sides in the right-and-left Y direction.

As described above, since the transportation handle 310 has a conspicuous and convenient position and shape, the operator naturally grabs the transportation handle 310 when transporting the upper limb training apparatus 1. In other words, the operator does not tend to grab the monitor 7 or the monitor arm 301 for transportation. Accordingly, the upper limb training apparatus 1 is unlikely to be damaged by an external force.

As shown in FIG. 28, the slide rail 303 is supported by the monitor stand 6 such that the slide rail 303 can move in the vertical Z direction. Specifically, the second supporting bracket 305 is fixed to the monitor stand 6 by a lock mechanism 311, and if the lock mechanism 311 is released, the second supporting bracket 305 can move in the vertical Z direction relative to the monitor stand 6 within a range corresponding to the upper end portion 6*c*. The lock mechanism 311 includes a spring (not shown), and is usually locked by the urging force of the spring. If a person releases the urging force, the monitor arm 301 can move in the vertical direction relative to the monitor stand 6. Accordingly, it is possible to set the monitor 7 to a height position of the face of the patient T.

(6) Other Embodiment

Although one embodiment according to the present invention was explained above, the present invention is not limited to the above-described embodiment. The embodiment can be altered in various ways without departing from the scope of the present invention. Particularly, a plurality of embodiments and variations can be arbitrarily combined with each other as necessary.

(a) According to the above-described embodiment, the upper limb training apparatus is used for function recovery training for the upper limb, but the upper limb training apparatus according to the present invention can also be applied to other uses. For example, it can be used to improve the function of the upper limb, i.e., for a training to increase muscles of the upper limb.

(b) Although the number of the elastic members, e.g., the plate-like convolution springs 94*a* and 94*b* is two in the above-described embodiment, the number of the plate-like convolution springs 94 may be three or more.

INDUSTRIAL APPLICABILITY

The present invention can be widely applied to an upper limb training apparatus used for training for recovering functions of the upper limb and strengthening muscles of the upper limb, for example.

EXPLANATION OF REFERENCE

1 upper limb training apparatus
3 training apparatus main body
4 chair
5 connecting mechanism
6 monitor stand
7 monitor
10 frame
11 fixed frame
12 movable frame
13 tilting resistance applying mechanism
14 tilting operation force detecting mechanism
15 operation rod
16 expansion and contraction resistance applying mechanism
17 expansion and contraction operation force detecting mechanism
17*a* potentiometer
17*b* sensor head
59 attachment fixed portion
70 attachment member
71 stay attached portion (main body attached portion)
72 shaft portion
80 axial movement allowance member
81 cylindrical portion
82 exterior portion
94 elastic member (absorbing member)
94*a*, 94*b*plate-like convolution spring
90 slide bearing
AT attachment

The invention claimed is:

1. An upper limb training apparatus for training limbs of a trainee, comprising:

a fixed frame configured to be placed on a floor surface;

a movable frame supported by the fixed frame such that the movable frame can tilt in all directions;

an operation rod to be operated by the trainee by hand and attached to the movable frame such that the operation rod can extend and contract, the operation rod including an operation rod main body, and an attachment fixed portion attached to a top end of the operation rod main body and to which an attachment is fixed; and an axial force detecting section configured to detect an axial force applied to the attachment fixed portion, the axial force detecting section further including an attachment member attached to the operation rod main body, an axial movement allowance member attached to the attachment member such that the axial movement allowance member can move in an axial direction, and an axial displacement detecting section that is configured to detect a position of the axial movement allowance member relative to the attachment member in the axial direction, wherein the attachment member includes a main body attached portion to be attached to the operation rod main body, and a shaft portion provided on the main body attached portion, wherein the axial movement allowance member includes a cylindrical portion slidably attached to the shaft portion, and an exterior portion covering the cylindrical portion and fixed to the main body attached portion, and wherein the attachment fixed portion includes an absorbing member configured to absorb forces in any directions other than the axial direction applied to the attachment fixed portion.

2. The upper limb training apparatus according to claim 1, wherein the absorbing member includes a plurality of elastic members, the elastic members being arranged between the cylindrical portion and the exterior portion and defining a predetermined gap between each other in an axial direction.

3. The upper limb training apparatus according to claim 2, wherein the elastic member includes a convolution spring.

4. The upper limb training apparatus according to claim 3, wherein the elastic member includes a flat plate-like convolution spring.

5. The upper limb training apparatus according to claim 4, wherein the elastic members include two flat plate-like convolution springs, the two flat plate-like convolution springs being arranged between the cylindrical portion and the exterior portion, defining a predetermined gap between each other in the axial direction, and being reversed relative to each other.

6. The upper limb training apparatus according to claim 2, further comprising a slide bearing arranged between the shaft portion and the cylindrical portion, the slide bearing being configured to allow the cylindrical portion to slide relative to the shaft portion.

7. The upper limb training apparatus according to claim 6, wherein the slide bearing is a bush made of resin.

8. The upper limb training apparatus according to claim 1, wherein the axial displacement detecting section is arranged inside the operation rod.

9. The upper limb training apparatus according to claim 1, wherein the axial displacement detecting section includes a linear potentiometer.

* * * * *